US007736079B2

(12) United States Patent
Tani

(10) Patent No.: US 7,736,079 B2
(45) Date of Patent: Jun. 15, 2010

(54) ROD-LIKE BODY FEEDING CONTAINER WITH COMPOUND SCREW MECHANISM

(75) Inventor: Yoshikazu Tani, Kita-ku (JP)

(73) Assignee: Tokiwa Corporation, Gifu (JP)

( * ) Notice: Subject to any disclaimer, the term of this patent is extended or adjusted under 35 U.S.C. 154(b) by 1111 days.

(21) Appl. No.: 11/393,776

(22) Filed: Mar. 31, 2006

(65) Prior Publication Data

US 2006/0222439 A1 Oct. 5, 2006

(30) Foreign Application Priority Data

Mar. 31, 2005 (JP) ..... 2005-103374

(51) Int. Cl.
*A45D 40/04* (2006.01)
*B43K 21/10* (2006.01)
*B43K 21/08* (2006.01)
*B43K 21/00* (2006.01)

(52) U.S. Cl. ..... 401/69; 401/64; 401/68; 401/70; 401/75; 401/84

(58) Field of Classification Search ..... 401/68–70, 401/75, 84, 101, 64, 116
See application file for complete search history.

(56) References Cited

U.S. PATENT DOCUMENTS 3,219,044 A * 11/1965 Bau ..... 401/75
3,256,980 A * 6/1966 Bau ..... 401/75
3,358,699 A * 12/1967 Bau ..... 401/70
5,366,311 A * 11/1994 Powers ..... 401/194
7,044,667 B2 * 5/2006 Tanaka et al. ..... 401/75

FOREIGN PATENT DOCUMENTS

JP 51-061353 * 5/1976
JP 52-50578 12/1977

* cited by examiner

*Primary Examiner*—Gregory L Huson
*Assistant Examiner*—Ryan A Varnum
(74) *Attorney, Agent, or Firm*—Bacon & Thomas, PLLC

(57) ABSTRACT

To prevent malfunction of a rod-like body feeding container, a pipe member (4) is moved forward with respect to a leading tube (3) by utilizing a first engagement portion (8) in accordance with a relative rotation between a main body (1) and a leading tube (3), a rod-like body (M) is moved forward with respect to the pipe member (4) by utilizing a second engagement portion (9) independently provided with the engagement portion (8) in accordance with the relative rotation so as to be protruded from the pipe member (4) to be in a use state on the basis of the forward moving operations, and the pipe member (4) is moved backward with respect to the leading tube (3) by utilizing the first engagement portion (8) in accordance with the relative rotation to feed back the pipe member (4) to a non-use position within the leading tube (3).

11 Claims, 38 Drawing Sheets

ROD-LIKE BODY FEEDING CONTAINER WITH COMPOUND SCREW MECHANISM

TECHNICAL FIELD

The present invention relates to a rod-like body feeding container for using a rod-like body such as a rod-like cosmetic material by feeding.

BACKGROUND ART

Conventionally, there has been known a rod-like cosmetic material container having a structure in which a cosmetic material in a molten state is injected into a pipe member so as to be formed as a rod-like cosmetic material by being cooled and solidified, a pipe member accommodating the rod-like cosmetic material is slidably accommodated within a leading tube, a main body tube (an outer tube) provided with a female thread in an inner portion is installed to a rear end of the leading tube so as to be relatively rotatable, a protruding lever is accommodated within the main body tube and the leading tube so as to engage an engagement projection provided in a rear end portion of the protruding lever with the female thread of the main body tube, and a leading end portion of the protruding lever is tightly fitted and inserted to an inner wall of the pipe member so as to be brought into contact with a rear end surface of the rod-like cosmetic material, wherein when the main body tube and the leading tube are relatively rotated in a feeding direction, the protruding lever moves forward on the basis of an engagement operation between the female thread of the main body tube and the engagement portion structured by the engagement projection of the protruding lever, and the pipe member tightly fitted and inserted to the protruding lever first moves forward on the basis of the forward movement of the protruding lever, and when the pipe member reaches a forward limit within the leading end portion of the leading tube, the rod-like cosmetic material brought into contact with the leading end surface of the protruding lever moves forward next, and the rod-like cosmetic material is set to a use state (refer, for example, to Japanese Unexamined Patent Publication No. 52-50578, patent document 1).

DISCLOSURE OF THE INVENTION

Problem to be Solved by the Invention

However, in the container mentioned above, as mentioned above, since the structure is made such that two members comprising the pipe member and the rod-like cosmetic material are fed out in sequence by the protruding lever which is moved forward by the engagement portion, if a manufacturing error or the like exists in a gap formed between the rod-like cosmetic material and the pipe member by a cooling solidification, and a gap provided between the pipe member and the leading tube, there is a risk that the rod-like cosmetic material is fed out before the pipe member in some cases.

The present invention is made for solving the problem mentioned above, and an object of the present invention is to provide a rod-like body feeding container in which a rod-like body such as a pipe member and a rod-like cosmetic material is desirably and accurately fed out and malfunction is not generated.

Means for Solving the Problem

In accordance with the present invention, there is provided a rod-like body feeding container comprising:

a main body;

a leading tube installed to a leading end side of the main body so as to be relatively rotatable;

a pipe member accommodated within the leading tube and slidably accommodating a rod-like body in an inner portion;

a first feeding mechanism moving forward or backward the pipe member with respect to the leading tube by utilizing a first engagement portion in accordance with the relative rotation between the main body and the leading tube; and a second feeding mechanism moving forward the rod-like body with respect to the pipe member by utilizing a different second engagement portion from the first engagement portion in accordance with the relative rotation between the main body and the leading tube.

In accordance with the rod-like body feeding container mentioned above, since the leading tube is installed to the leading end side of the main body tube so as to be relatively rotatable, the pipe member slidably accommodating the rod-like body in the inner portion is accommodated within the leading tube, the pipe member moves forward with respect to the leading tube by utilizing the first engagement portion in accordance with the relative rotation between the main body and the leading tube, and the rod-like body moves forward with respect to the pipe member by utilizing the second engagement portion in accordance with the relative rotation between the main body and the leading tube so as to protrude from the pipe member, it is possible to set the rod-like body to a use state on the basis of the forward moving operations. Further, since the pipe member moves backward with respect to the leading tube by utilizing the first engagement portion in accordance with the relative rotation between the main body and the leading tube, it is possible to feed back the pipe member to the accommodate position within the leading tube. As mentioned above, since there are independently provided with the engagement portion for feeding and feeding back the pipe member with respect to the leading tube, and the engagement portion for feeding the rod-like body with respect to the pipe member, it is possible to cancel the reversing of the feeding order which may be generated by using the single engagement portion, and it is possible to desirably and accurately feed the pipe member and the rod-like body.

Further, in accordance with the rod-like body feeding container, since the rod-like body is accommodated in the pipe member so as to be protected, and is used by being fed at a necessary amount, it is possible to use a narrow rod-like cosmetic material.

In this structure, if the rod-like body is slidably accommodated in the pipe member in a close contact state, it is possible to continuously use the rod-like body without the rod-like body coming off from the pipe member even in the case that the rod-like body is broken off due to an external force application such as an impact, a vibration or the like, for example, caused by a drop of the container or the like. In the above, the close contact state includes a state in which an entire of the rod-like body is brought into close contact with the pipe member, a state in which it is partly brought into close contact therewith, and a state in which it comes close thereto and is almost in a close contact state.

Further, as a structure of the rod-like body feeding container which can preferably achieve the operation mentioned above, particularly, there can be shown a structure in which a rod-like body moving body extruding the rod-like body within the pipe member by moving forward is provided, the first engagement portion is structured such that an engagement operation is first applied in the case that the main body and the leading tube are relatively rotate in a feeding direction corresponding to one direction and a feed-back direction corresponding to the other direction reverse to the one direction, thereby moving forward and backward the pipe member including the rod-like body moving body, and the engagement operation is stopped when the pipe member reaches the forward limit, and the second engagement portion is structured such that the engagement operation is applied in the case that the pipe member reaches the forward limit and the main body and the leading tube are further relatively rotated in the feeding direction in a state in which the engagement operation of the first engagement portion is stopped, thereby moving forward the rod-like body moving body. In accordance with the structure mentioned above, since the structure is made such that the rod-like body is pushed out within the pipe member on the basis of the forward movement of the rod-like body moving body so as to be slid and fed out, the rod-like body can be used up to the end.

Further, as a preferable structure in which the engagement operation of the first engagement portion is applied prior to the engagement operation of the second engagement portion, particularly, there can be shown a structure in which an actuation resistance of the second engagement portion is increased in comparison with an actuation resistance of the first engagement portion.

Further, when a lead of the first engagement portion is enlarged in comparison with a lead of the second engagement portion, it is possible to apply the engagement operation of the first engagement portion prior to the engagement operation of the second engagement portion, the pipe member to which the engagement operation of the first engagement portion is applied is quickly fed out to the use position in accordance with the large lead on the basis of the relative rotation in the feeding direction between the main body and the leading tube, the rod-like body moving body to which the engagement operation of the second engagement portion is applied is slowly fed out in accordance with the small lead on the basis of the further relative rotation in the feeding direction between the main body and the leading tube, the rod-like body suitably protrudes from the pipe member so as to be set to the use state, and the pipe member is quickly fed back to the accommodated position within the leading tube in accordance with the large lead on the basis of the relative rotation in the feed-back direction between the main body and the leading tube, so that usability (easiness in use) is improved. In the above, the lead means a distance at which the thread moves in an axial direction at a time of being rotated at one revolution.

Further, when the structure is made such that the leading end of the pipe member protrudes from and retracts into an opening in a leading end of the leading tube on the basis of the forward movement and the backward movement of the pipe member including the rod-like body moving body caused by the relative rotation in the feeding direction and the feed-back direction between the main body and the leading tube, in the case that the rod-like body is constituted, for example, by a rod-like cosmetic material, the leading end of the pipe member having a chance of appearing from the opening of the leading end of the leading tube so as to be brought into contact with the skin at a time of being used is retracted into the leading tube after being used so as to be accommodated. Accordingly, the structure is improved in a sanitary view.

Further, the first engagement portion is preferably structured such that when the main body and the leading tube are relatively rotated in the feed-back direction, and the pipe member including the rod-like body moving body is moved backward on the basis of the first applied engagement operation of the first engagement portion, and reaches the predetermined position at which the pipe member is accommodated within the leading tube, the engagement is canceled so as to slip the main body and the leading tube in such a manner that the engagement operation of the second engagement portion is not applied, and the engagement is returned when the main body and the leading tube are relatively rotated in the feeding direction in a state in which the engagement operation is canceled.

In the case of employing the structure mentioned above, when the main body and the leading tube are relatively rotated in the feed-back direction after the pipe member reaches the forward limit and the rod-like body protrudes from the pipe member so as to be set to the use state, the pipe member including the rod-like body moving body is moved backward on the basis of the first applied engagement operation of the first engagement portion and reaches the predetermined position at which the pipe member is accommodated within the leading tube, and then the engagement of the first engagement portion is canceled, and the main body and the leading tube slip in such a manner that the engagement operation of the second engagement portion is not applied. Accordingly, the rod-like body moving body does not move backward in this state, and the rod-like body is in a state of protruding from the pipe member. Further, when the main body and the leading tube are relatively rotated in the feeding direction, the engagement of the first engagement portion is returned, and the pipe member including the rod-like body moving body moves forward. Accordingly, since the rod-like body protrudes from the pipe member as mentioned above at a time when the pipe member reaches the forward limit, the rod-like body is immediately set to the use state.

Further, the second feeding mechanism may be structured such as to move backward the rod-like body with respect to the pipe member, by utilizing the second engagement portion in accordance with the relative rotation in the other direction between the main body and the leading tube.

As a particular structure, there can be shown a structure in which the first engagement portion is structured such that, when the main body and the leading tube are relatively rotated in the feed-back direction and the pipe member including the rod-like body moving body is moved backward on the basis of the first applied engagement operation of the first engagement portion and reaches a backward limit at which the pipe member is accommodated within the leading tube, the engagement operation is stopped, the second engagement portion is structured such that, when the main body and the leading tube are further relatively rotated in the feed-back direction in a state in which the pipe member reaches the backward limit and the engagement operation of the first engagement portion is stopped, the engagement operation is applied so as to move backward the rod-like body moving body, and the rod-like body moving body and the rod-like body are brought into contact with each other in an airtight manner within the pipe member. As mentioned above, if the rod-like body moving body and the rod-like body are brought into contact with each other in the airtight manner within the pipe member, the rod-like body which is brought into contact with the rod-like body moving body in the airtight manner is moved backward together with the rod-like body moving body, the leading end portion of the rod-like body protruding from the pipe member is accommodated within the pipe member, and the leading end portion of the rod-like body is also protected by the pipe member.

EFFECT OF THE INVENTION

As mentioned above, in accordance with the rod-like body feeding container of the present invention, since there are provided separately the engagement portion feeding and feeding back the pipe member with respect to the leading tube, and the engagement portion feeding the rod-like body to the pipe member, and the pipe member and the rod-like body are desirably and accurately fed, it is possible to prevent malfunction.

DESCRIPTION OF REFERENCE NUMERALS

Figure 1:
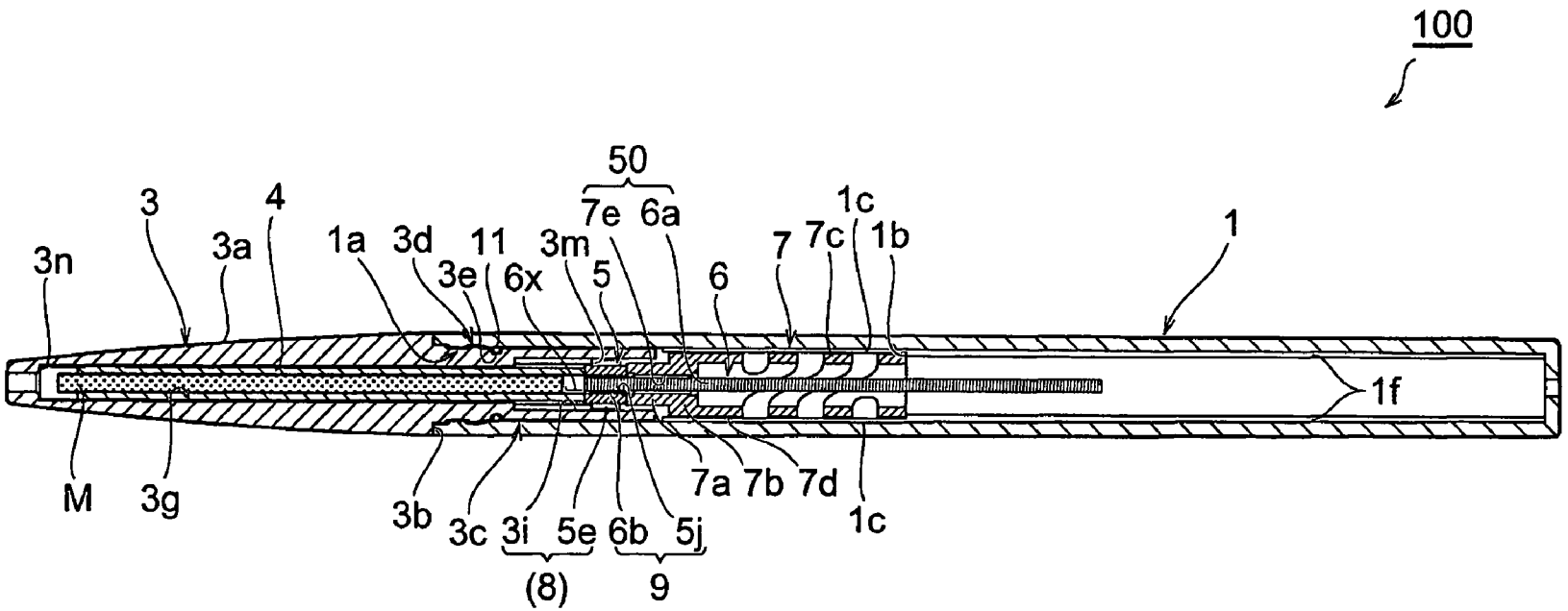
FIG. 1 is a vertical sectional view showing a rod-like body feeding container in accordance with a first embodiment of the present invention.

1, 51, 81 . . . main body tube (main body), 3, 53, 83 . . . leading tube, 3*i*, 53*i*, 83*i* . . . spiral groove of leading tube (first engagement portion), 3*n*, 53*n*, 83*f* . . . forward limit of pipe member, 4, 54, 64, 84 . . . pipe member, 5, 85 . . . pipe member moving body, 5*e*, 85*e* . . . engagement projection (first engagement portion) of pipe member moving body, 5*j*,

85*j* . . . female thread (second engagement portion) of pipe member moving body, 6, 56, 86 . . . rod-like body moving body, 6*b*, 56*b*, 86*b* . . . male thread (second engagement portion) of rod-like body moving body, 6*x*, 56*x*, 86*x*, 96*x* . . . piston, 7*c*, 85*d* . . . pipe member side spring portion, 8, 58, 88 . . . first engagement portion (first feeding mechanism), 9, 59, 89 . . . second engagement portion (second feeding mechanism), 50, 70, 80 . . . rotation preventing portion (first and second feeding mechanism), 100, 200, 300 . . . rod-like body feeding container, M, M2, M3 . . . rod-like body.

BEST MODE FOR CARRYING OUT THE INVENTION

A description will be given below of a preferable embodiment of a rod-like body feeding container in accordance with the present invention with reference to FIGS. 1 to 40. In this case, in each of the drawings, the same reference numerals are attached to the same elements, and an overlapping description will be omitted.

Figure 5:
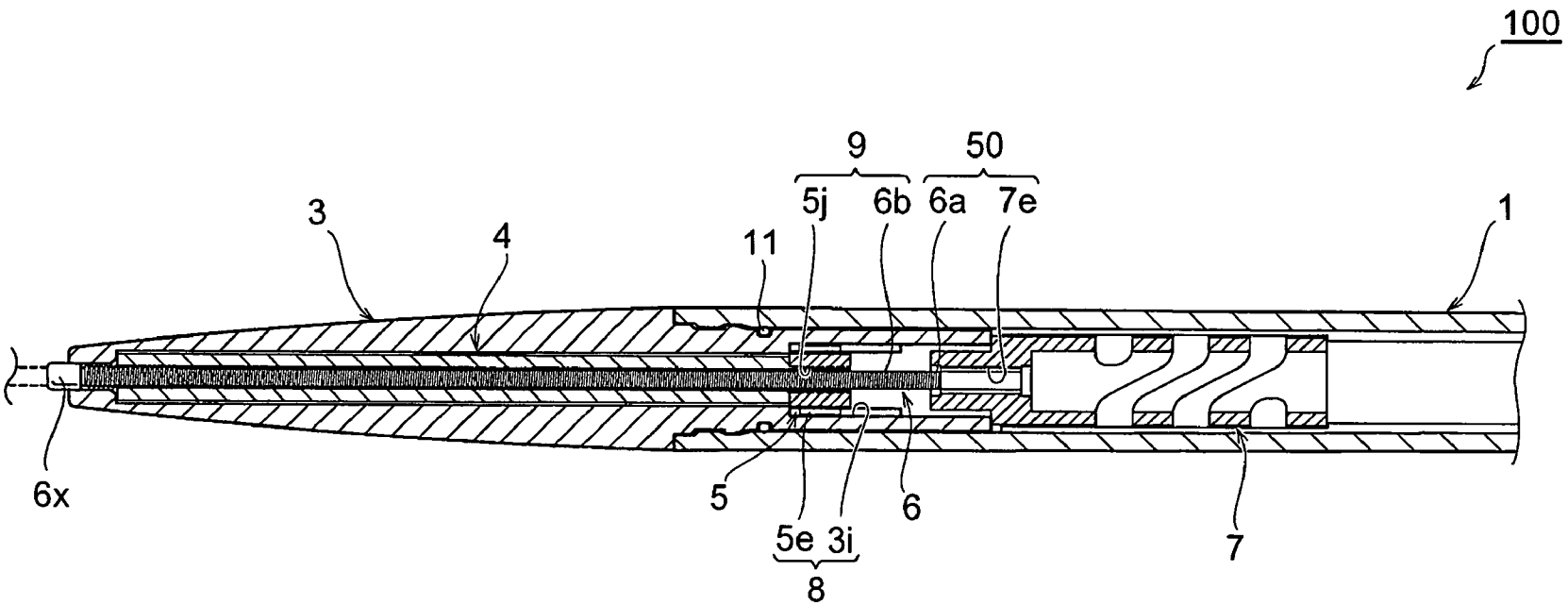
FIG. 5 is a vertical sectional view showing the rod-like body feeding container in accordance with the first embodiment of the present invention, and shows a state in which the pipe member moves forward to the maximum on the basis of an operation of the user and the rod-like body moving body moves forward to the maximum.
Figure 6:
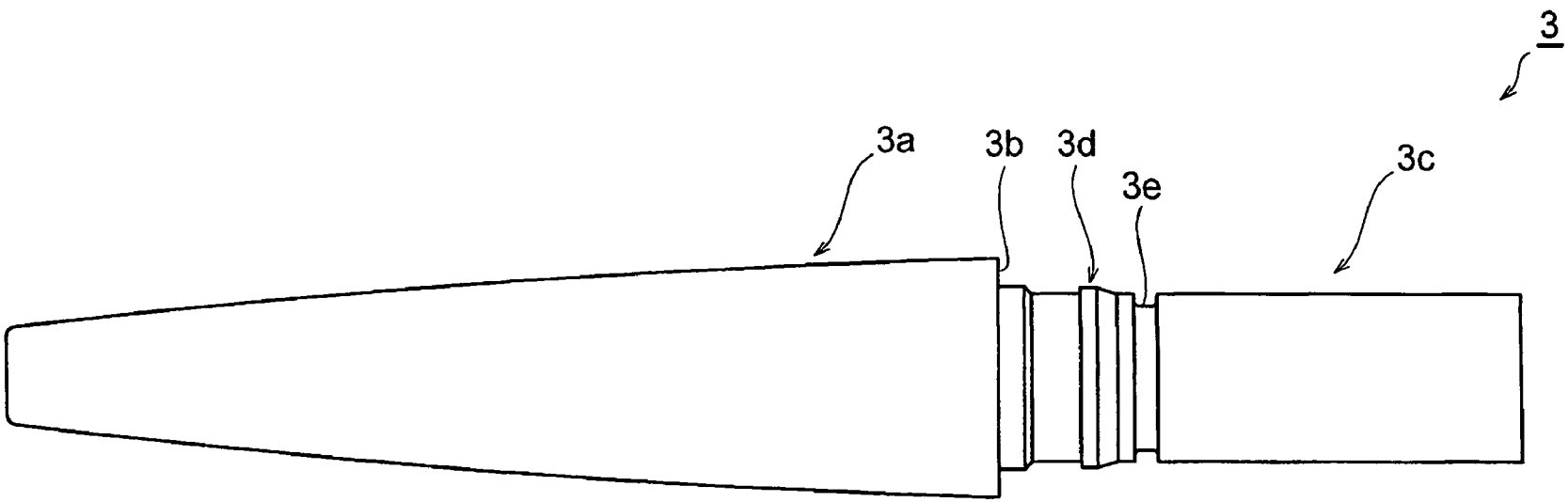
FIG. 6 is a side view showing a leading tube in FIGS. 1 to 5.
Figure 7:
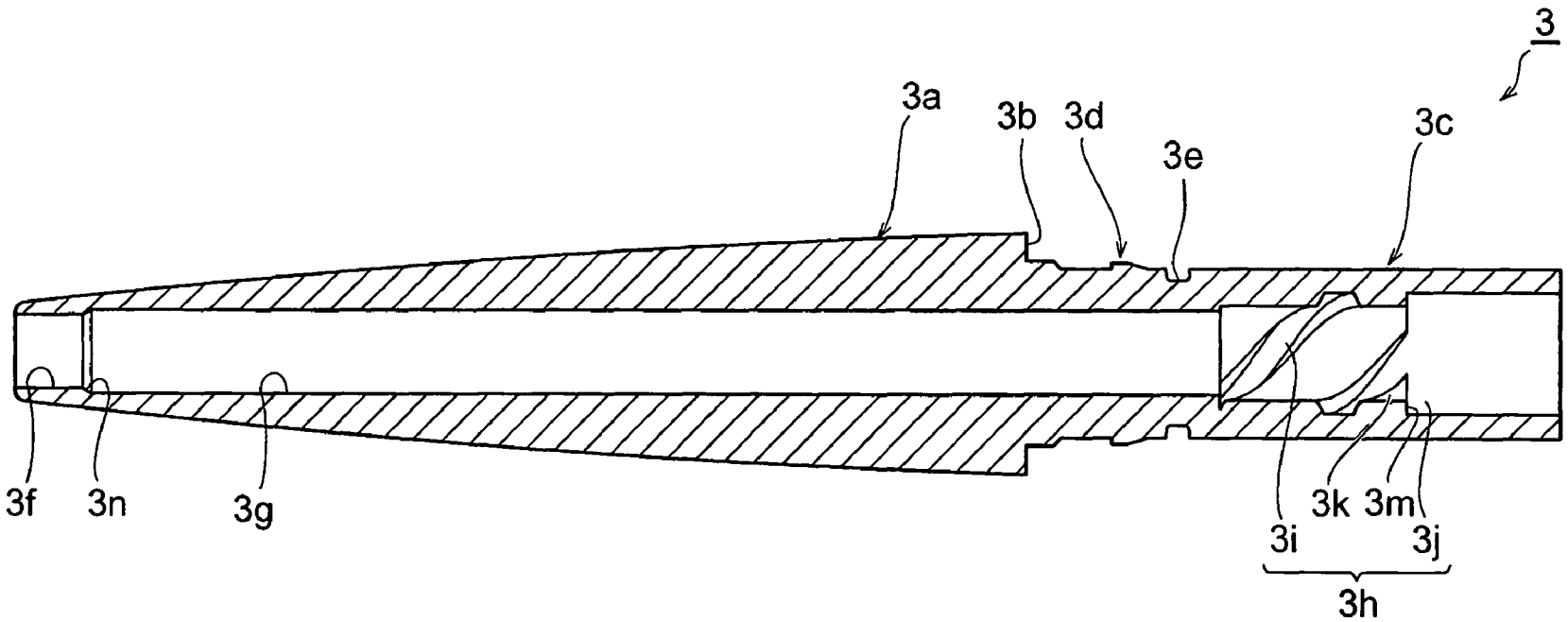
FIG. 7 is a vertical sectional view of the leading tube shown in FIG. 6.
Figure 8:
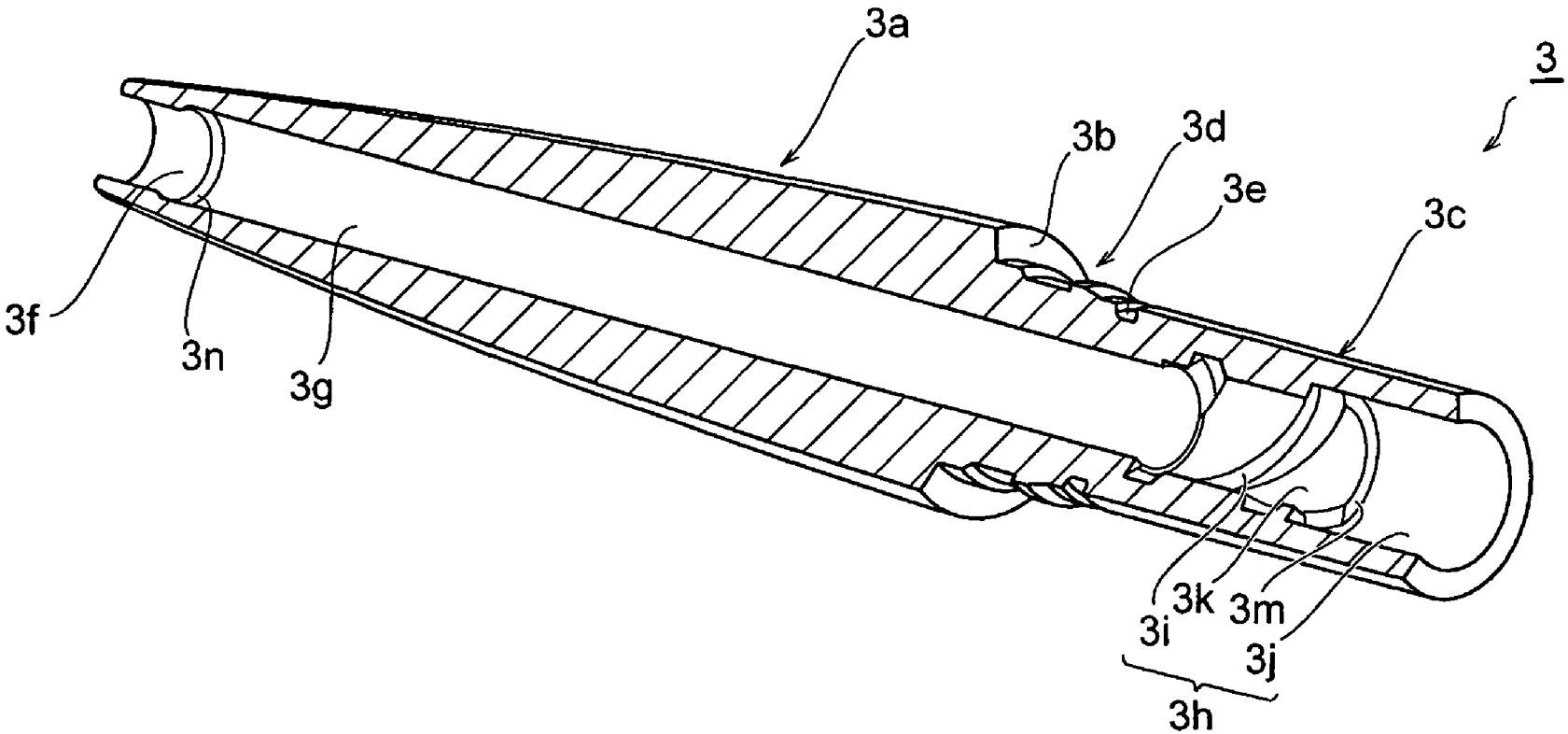
FIG. 8 is a vertical sectional perspective view of the leading tube shown in FIG. 6.
Figure 13:
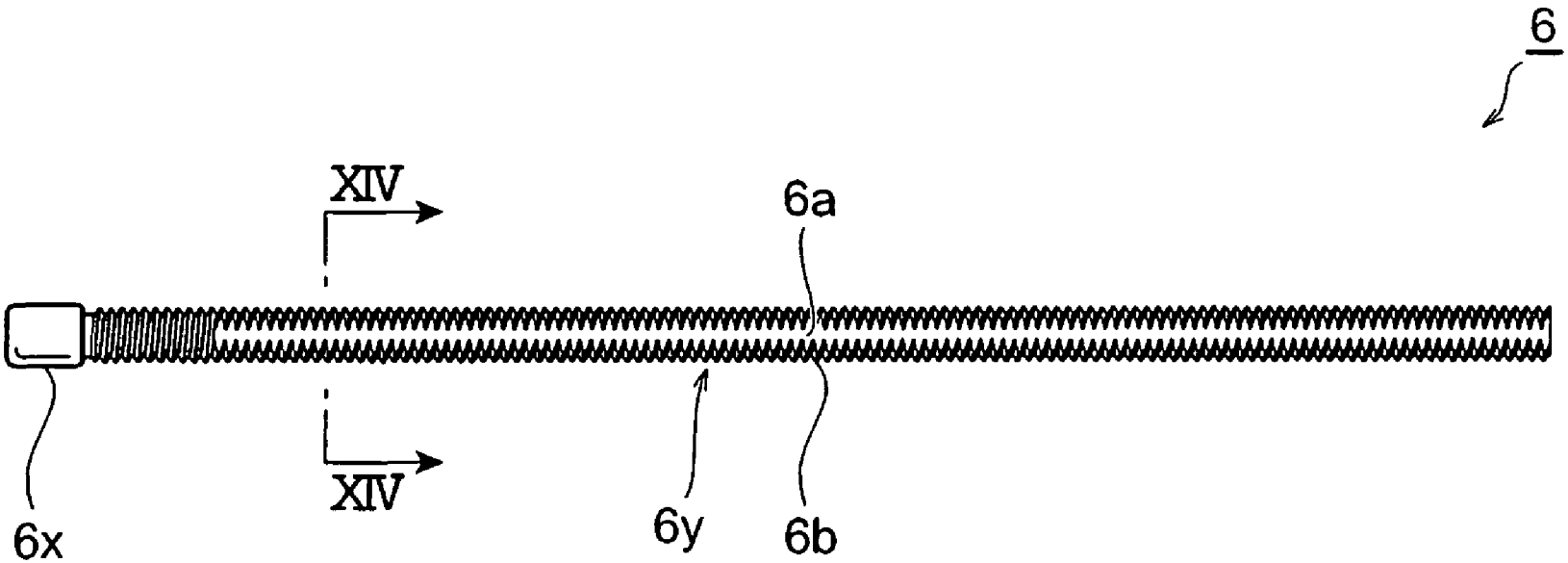
FIG. 13 is a side view showing the rod-like body moving body in FIGS. 1 to 5.
Figure 14:
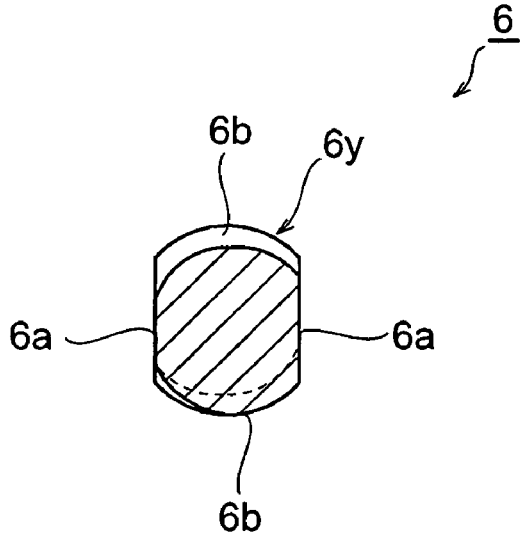
FIG. 14 is a view as seen from an arrow XIV-XIV in FIG. 13.
Figure 15:
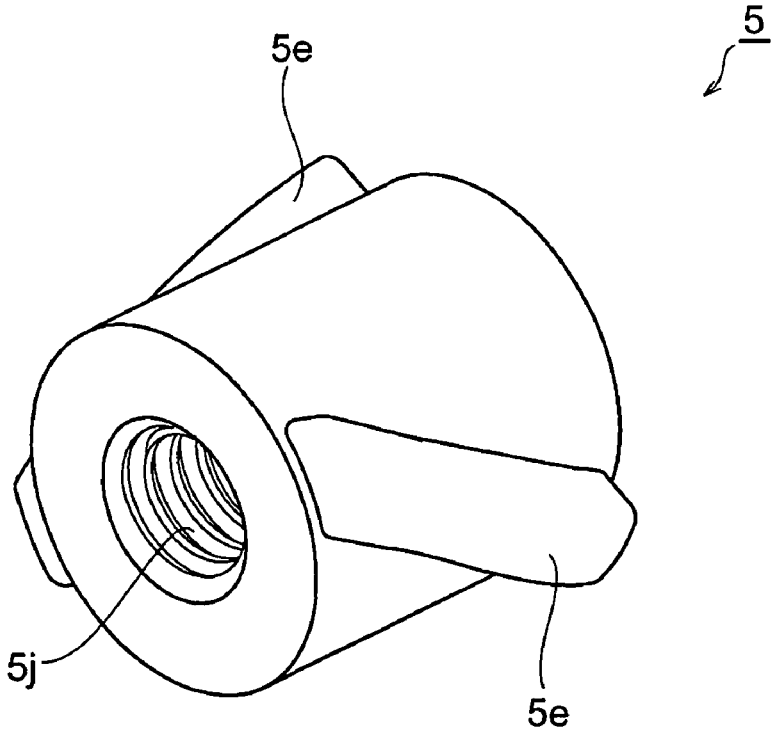
FIG. 15 is a perspective view showing a pipe member moving body in FIGS. 1 to 5.
Figure 16:
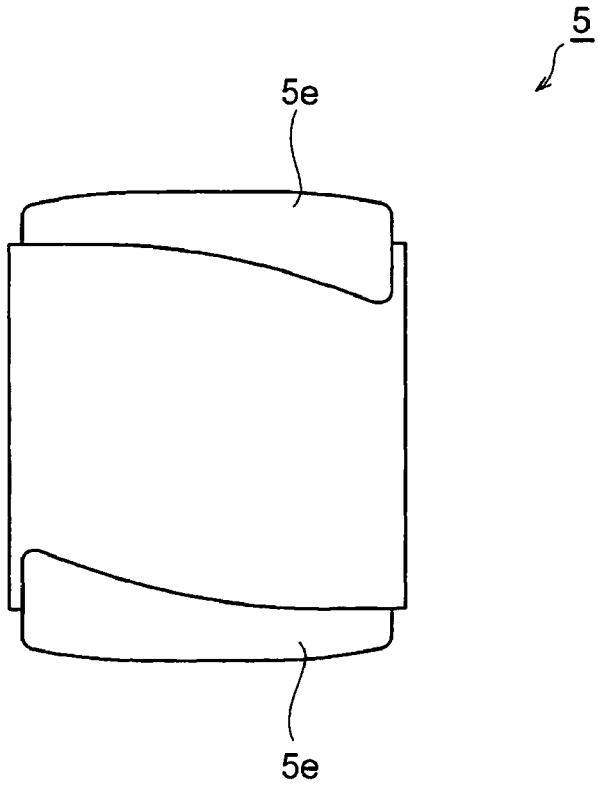
FIG. 16 is a side view of the pipe member moving body shown in FIG. 15.
Figure 17:
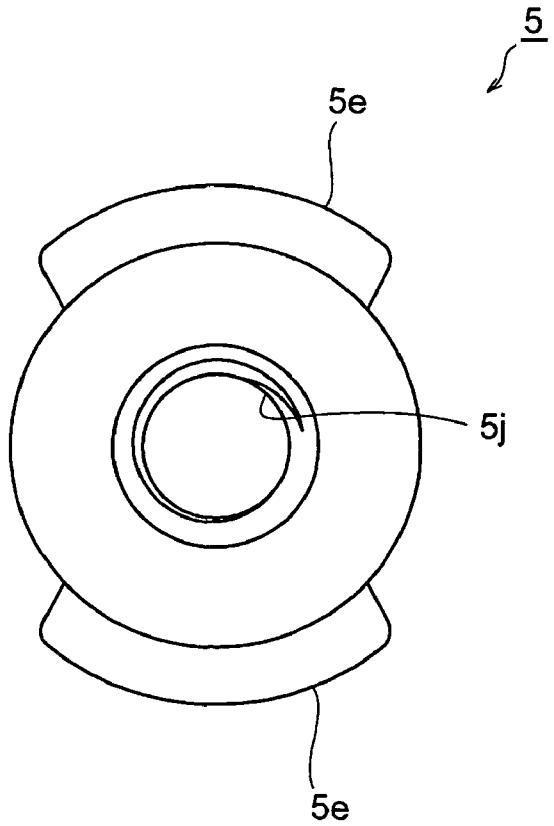
FIG. 17 is a left side view of the pipe member moving body shown in FIG. 16.
Figure 35:
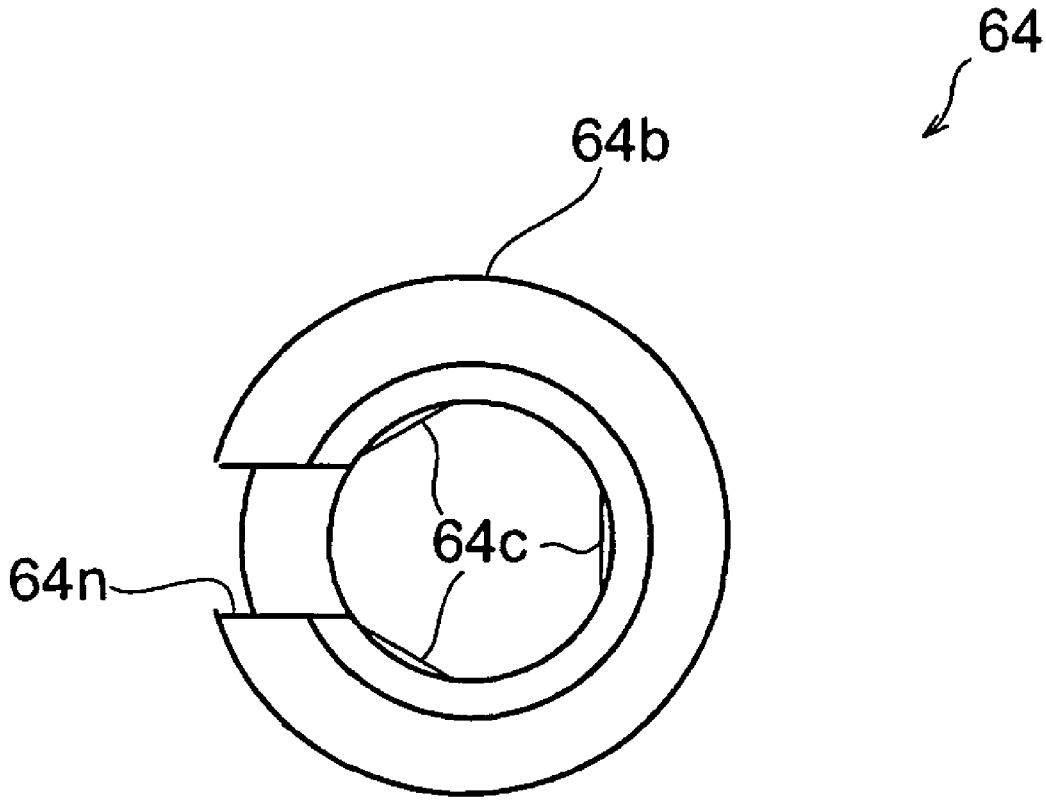
FIG. 35 is a right side view of the pipe member shown in FIG. 33.
Figure 36:
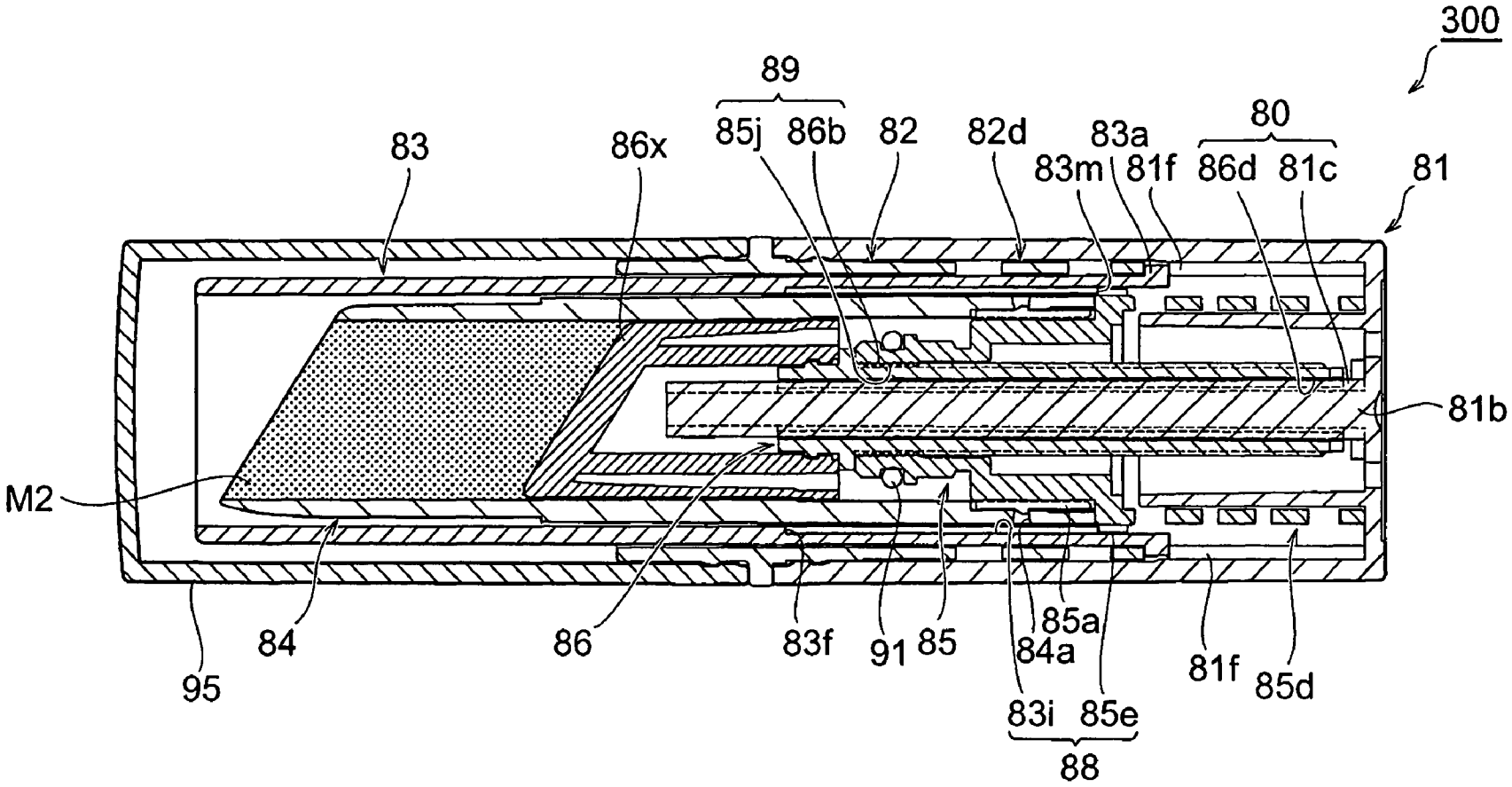
FIG. 36 is a vertical sectional view showing a rod-like body feeding container in accordance with a third embodiment of the present invention.
Figure 37:
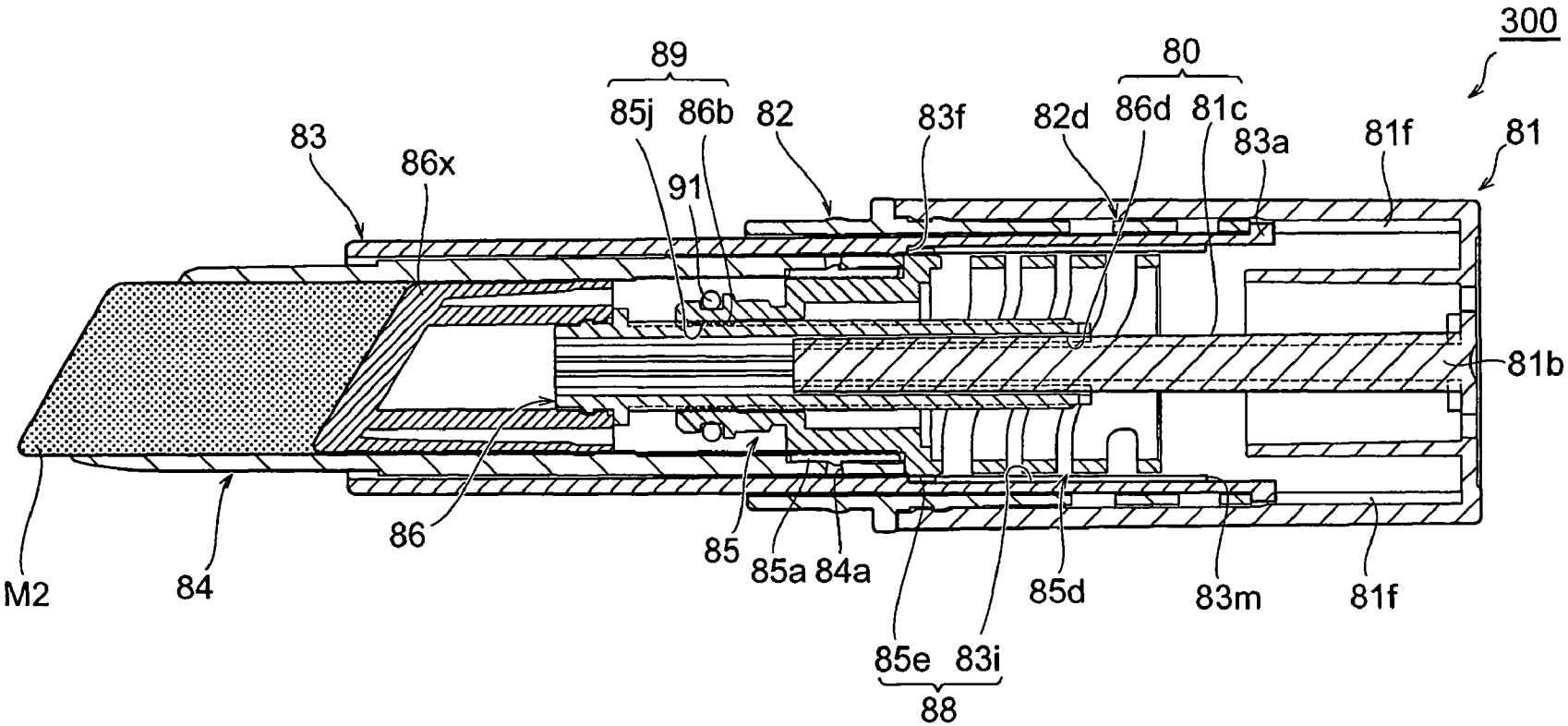
FIG. 37 is a vertical sectional view showing the rod-like body feeding container in accordance with the third embodiment of the present invention, and shows a state in which a pipe member moves forward to the maximum on the basis of an operation of a user and a rod-like body moving body subsequently moves forward to a use state.
Figure 38:
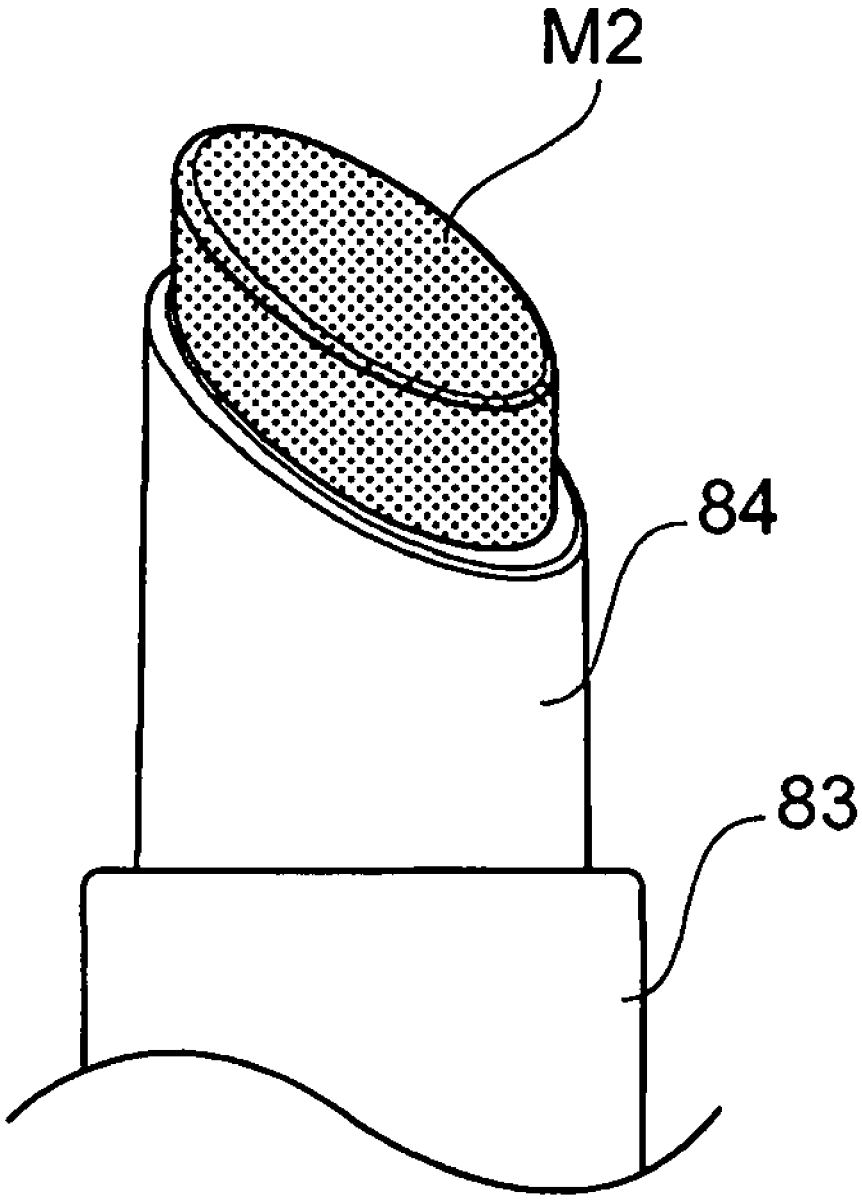
FIG. 38 is an enlarged view of a leading end portion of a rod-like body in the rod-like body feeding container shown in FIG. 37 and a portion near the same.
Figure 39:
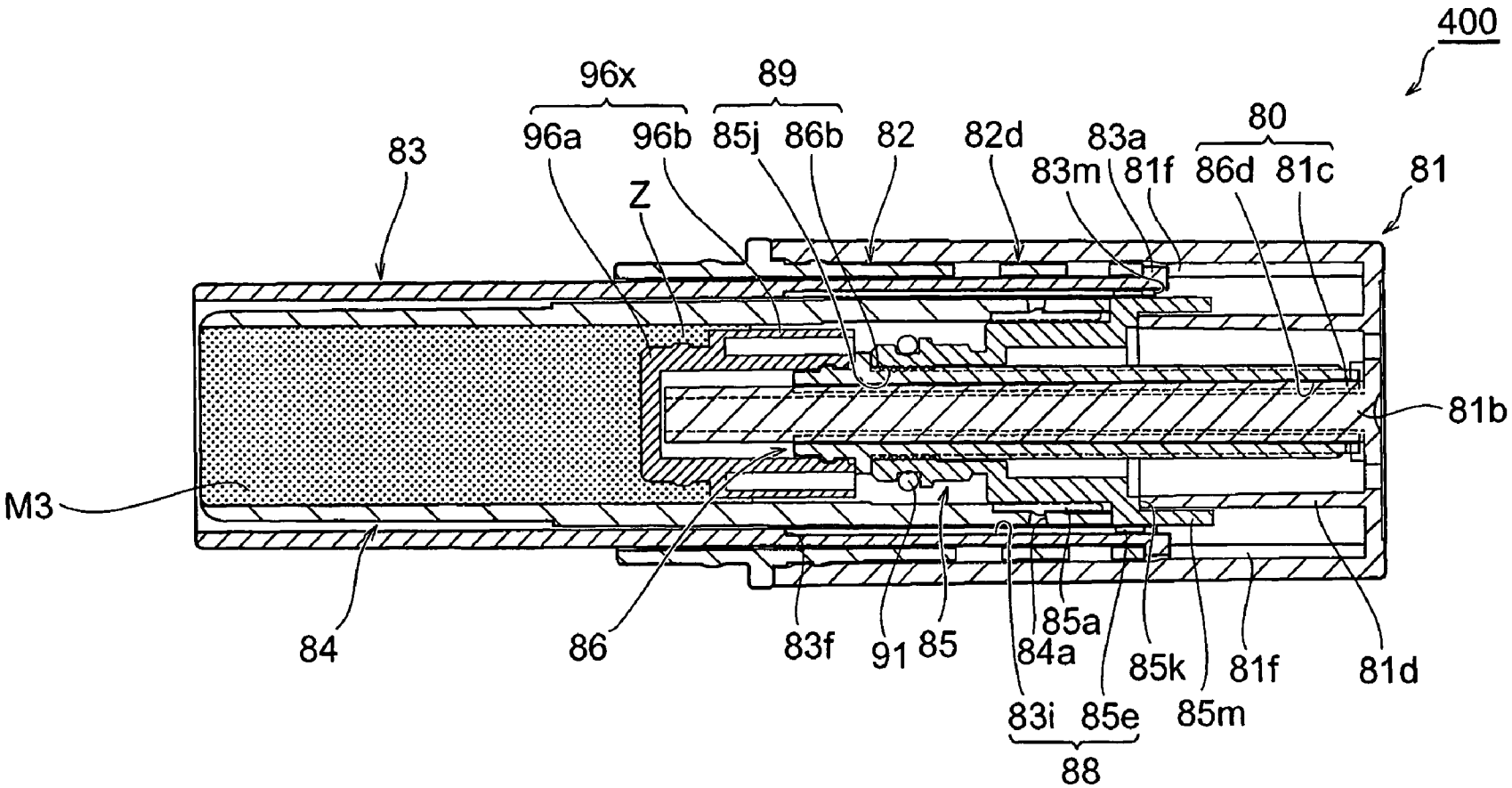
FIG. 39 is a vertical sectional view showing a rod-like body feeding container in accordance with a fourth embodiment of the present invention.
Figure 40:
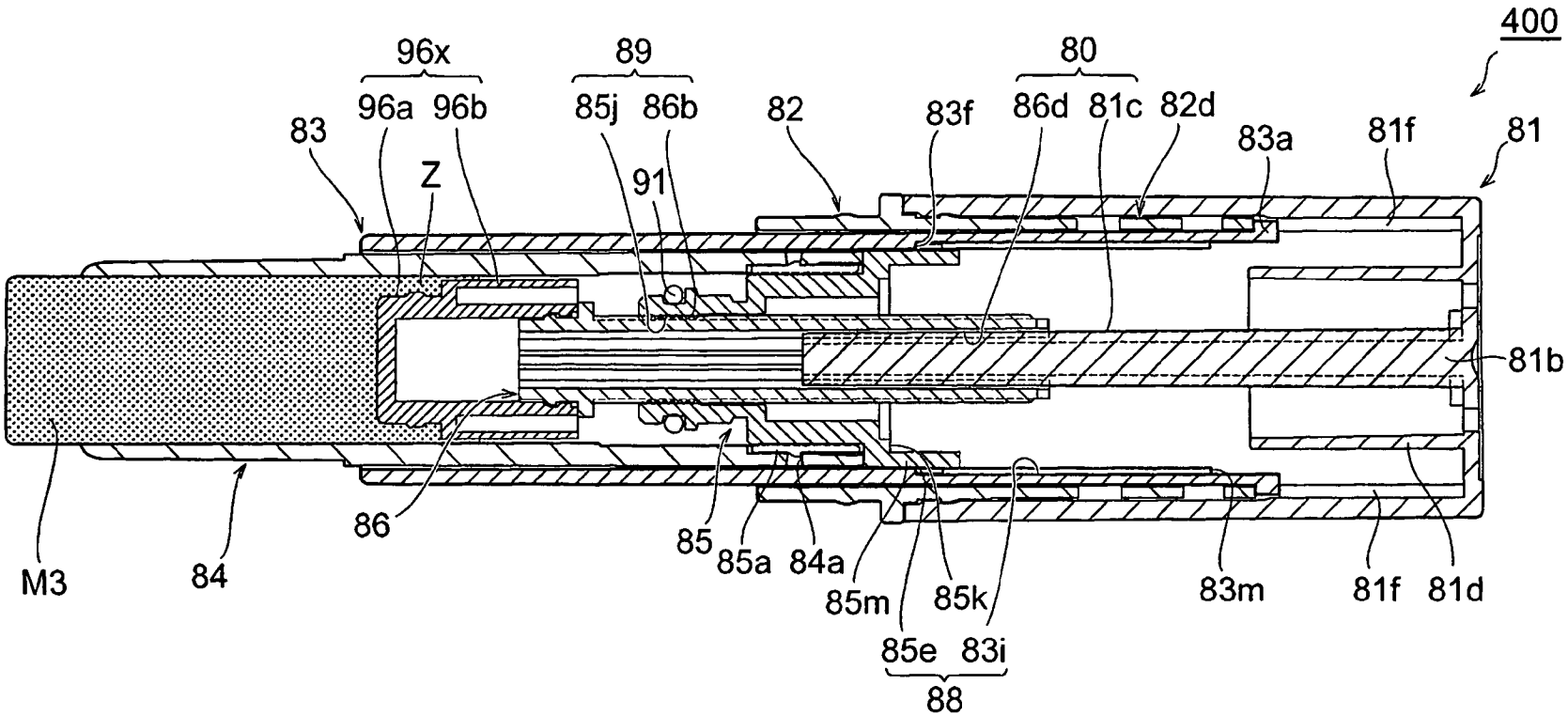
FIG. 40 is a vertical sectional view showing the rod-like body feeding container in accordance with the fourth embodiment of the present invention, and shows a state in which a pipe member moves forward to the maximum on the basis of an operation of a user and a rod-like body moving body subsequently moves forward to a use state.

FIGS. 1 to 18 show a first embodiment in accordance with the present invention, FIGS. 19 to 35 show a second embodiment in accordance with the present invention, FIGS. 36 to 38 show a third embodiment in accordance with the present invention, and FIGS. 39 and 40 show a fourth embodiment in accordance with the present invention, respectively. FIGS. 1 to 5 are vertical sectional views showing respective states of a rod-like body feeding container in accordance with the first embodiment of the present invention, FIGS. 6 to 8 are views showing a leading tube, FIGS. 9 to 12 are views showing a spring member, FIGS. 13 and 14 are views showing a rod-like body moving body, and FIGS. 15 to 18 are views showing a pipe member moving body. The rod-like body feeding container in accordance with the present embodiment accommodates a rod-like body and can appropriately feed the rod-like body on the basis of an operation of a user.

In this case, as the rod-like body, it is possible to employ various rod-like cosmetic material, for example, an eye liner, an eyebrow liner, a lip liner, a lipstick and the like, a rod-like core of a writing instrument or the like, and it is possible to employ a comparatively hard rod-like body, and a very soft rod-like body. Further, it is possible to employ a small-diameter core having an outer diameter of 1 mm or less, and a rod-like body having an outer diameter of 10 mm or more.

As shown in FIG. 1, a rod-like body feeding container 100 is provided with a main body tube (a main body) 1 forming a rear side from a leading end side of the container, and a leading tube 3 forming a leading end side of the container and coupled to the main body tube 1 so as to be relatively rotatable and be immobile in an axial direction, as an outer shape structure. Further, an inner side of the container is approximately provided with a pipe member moving body 5 moving forward and backward in the case that the main body tube 1 and the leading tube 3 are relatively rotated, a pipe member 4 accommodating a rod-like body M therein and moving forward and backward in accordance with the forward and backward movement of the pipe member moving body 5, a rod-like body moving body 6 having a piston 6*x* fitted and inserted into the pipe member 4 so as to be brought into contact with a rear end surface of the rod-like body M in a leading end, moving forward and backward in accordance with the forward and backward movement of the pipe member moving body 5 and moving forward when the pipe member 4 reaches a forward limit and the main body tube 1 and the leading tube 3 are relatively rotated further in the same direction, a spring member 7 energizing the pipe member moving body 5 to a front side when the pipe member moving body 5 is moved backward to a predetermined position, a first engagement portion 8 (refer to FIGS. 2, 3 and 5) making the movement of the pipe member moving body 5 possible, and a second engagement portion 9 making the movement of the rod-like body moving body 6 possible.

Figure 4:
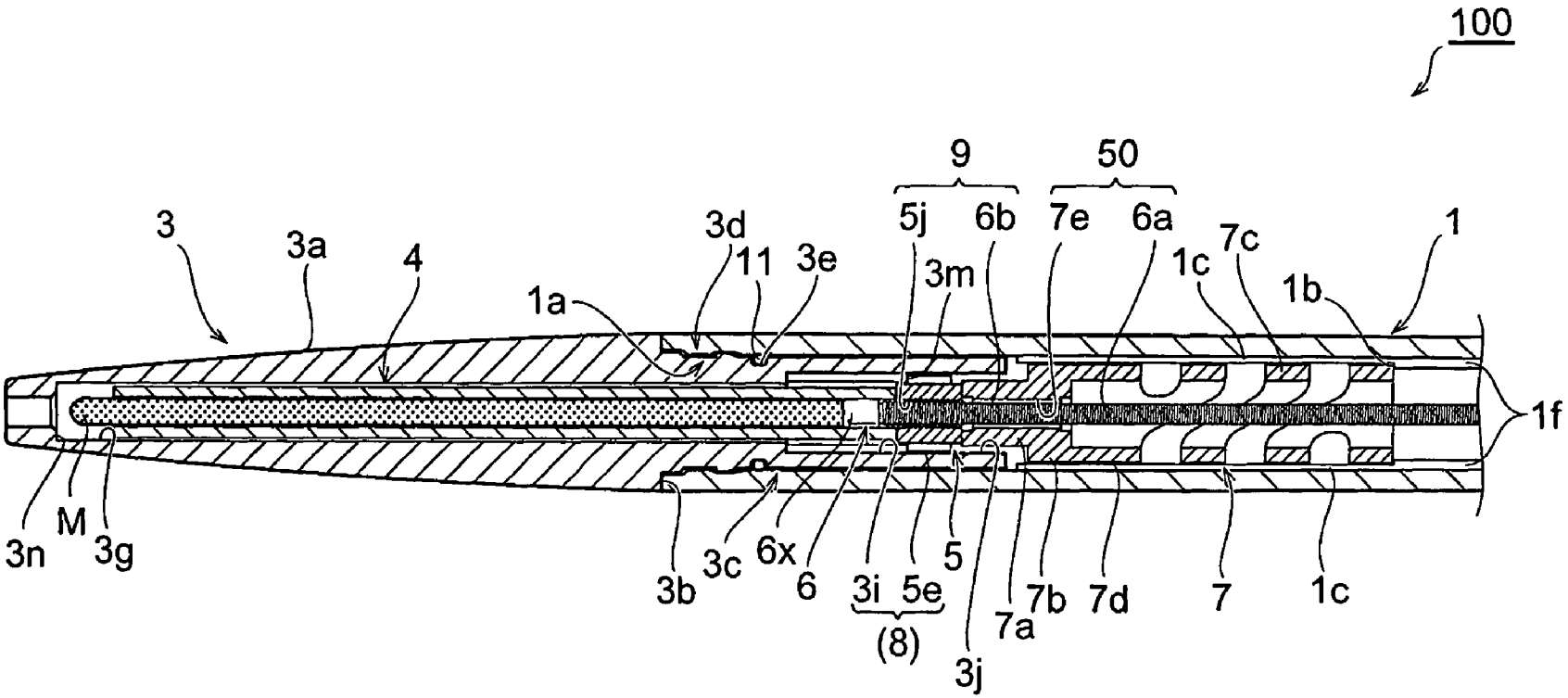
FIG. 4 is a vertical sectional view showing the rod-like body feeding container in accordance with the first embodiment of the present invention, and shows a state in which the pipe member moves backward to the maximum on the basis of an operation of the user after using.

The main body tube 1 is structured as a closed-end cylindrical shape, as shown in FIGS. 1 and 4, and is provided with an annular concavo-convex portion 1*a* for installing the leading tube 3 in an inner peripheral surface in a leading end side thereof. A lot of protrusions if extending long toward a leading end side from a bottom portion are provided in an inner peripheral surface of the main body tube 1 in parallel along a peripheral direction so as to be arranged in a knurling shape. The protrusion if is structured such that a protruding degree toward an inner side (toward an axis) of a rear side portion from the middle in an axial direction is enlarged in comparison with a protruding degree toward an inner side of the portion from a leading end to the middle in the axial direction, and a step surface 1*b* is set to a position where the protruding degree is changed. The step surface 1*b* of the protrusion 1*f* is provided for bringing a rear end surface of the spring member 7 into contact therewith, and a front side portion 1*c* from the step portion 1*b* of the protrusion 1*f* is provided for installing the spring member 7.

The leading tube 3 is formed as a stepped cylindrical shape having a large-diameter portion 3*a* serving as a leading end side knob portion protruding from a leading end of the main body tube 1, and a small-diameter portion 3*c* connected to a rear end of the large-diameter portion 3*a* via an outer peripheral step surface 3*b* while having an outer peripheral surface formed in a small diameter, as shown in FIGS. 6 to 8. The large-diameter portion 3*a* is formed as a tapered shape in which an outer diameter becomes smaller gradually toward a leading end, and the small-diameter portion 3*c* is formed so as to have such a dimension as to be inserted to the main body tube 1, and is provided with an annular concavo-convex portion 3*d* for engaging with the annular concavo-convex portion 1*a* of the main body tube 1 in an axial direction, in an outer peripheral surface close to the outer peripheral step surface 3*b*. Further, the small-diameter portion 3*c* is provided with an annular groove portion 3*e* for installing an O-ring 11, in an outer peripheral surface at a rear side position from the annular concavo-convex portion 3*d*.

As shown in FIGS. 7 and 8, a tube hole provided through in an axial direction of the leading tube 3 is formed as a rod-like body hole 3*f*, in which only the rod-like body M moves forward and backward, from an opening in a leading end to a portion near the leading end, is formed as a pipe member hole 3*g*, which has a larger diameter than the rod-like body hole 3*f* so as to accommodate the pipe member 4 and in which the pipe member 4 moves forward and backward, from a rear end of the rod-like body hole 3*f* to a portion near a rear end portion of the tube hole, and is formed as a pipe member moving body hole 3*h*, which accommodates the pipe member moving body 5 and in which the pipe member moving body 5 moves forward and backward, from a rear end of the pipe member hole 3*g* to a rear end of the tube hole. A front half portion of the pipe member moving body hole 3*h* is provided with a spiral groove (a tube side thread) 3*i* serving as a female thread structuring one side of the first engagement portion (the engagement mechanism) 8, and a step surface 3*m* in which an inner peripheral surface 3*k* side is set higher (an inner diameter at the inner peripheral surface 3*k* side is smaller) is formed in a boundary portion between an inner peripheral surface 3*j* in the rear half portion and the inner peripheral surface 3*k* except the spiral groove 3*i* in the front half portion. Further, a step surface 3*n* between the rod-like body hole 3*f* and the pipe member hole 3*g* in the leading tube 3 is set as a forward limit of the pipe member 4. In this case, a leading end of the spiral groove 3*i* of the leading tube 3 may be set to a forward limit of an engagement projection 5*e* mentioned below, in correspondence to the forward limit of the pipe member 4.

The leading tube 3 is installed to the main body tube 1 so as to be relatively rotatable and immobile in an axial direction, as shown in FIGS. 1 and 4, by fitting an O-ring 11 to the annular groove portion 3*e*, inserting the small-diameter portion 3*c* into the main body tube 1, contacting the outer peripheral step surface 3*b* with the leading end surface of the main body tube 1 and engaging the annular concavo-convex portion 3*d* with the annular concavo-convex portion 1*a* of the main body tube 1. Further, the O-ring 11 fitted and attached to the annular groove portion 3*e* of the leading tube 3 is brought into contact with the inner peripheral surface of the main body tube 1, whereby a rotational resistance giving a good feeling is generated at a time when the main body tube 1 and the leading tube 3 are relatively rotated.

Figure 9:
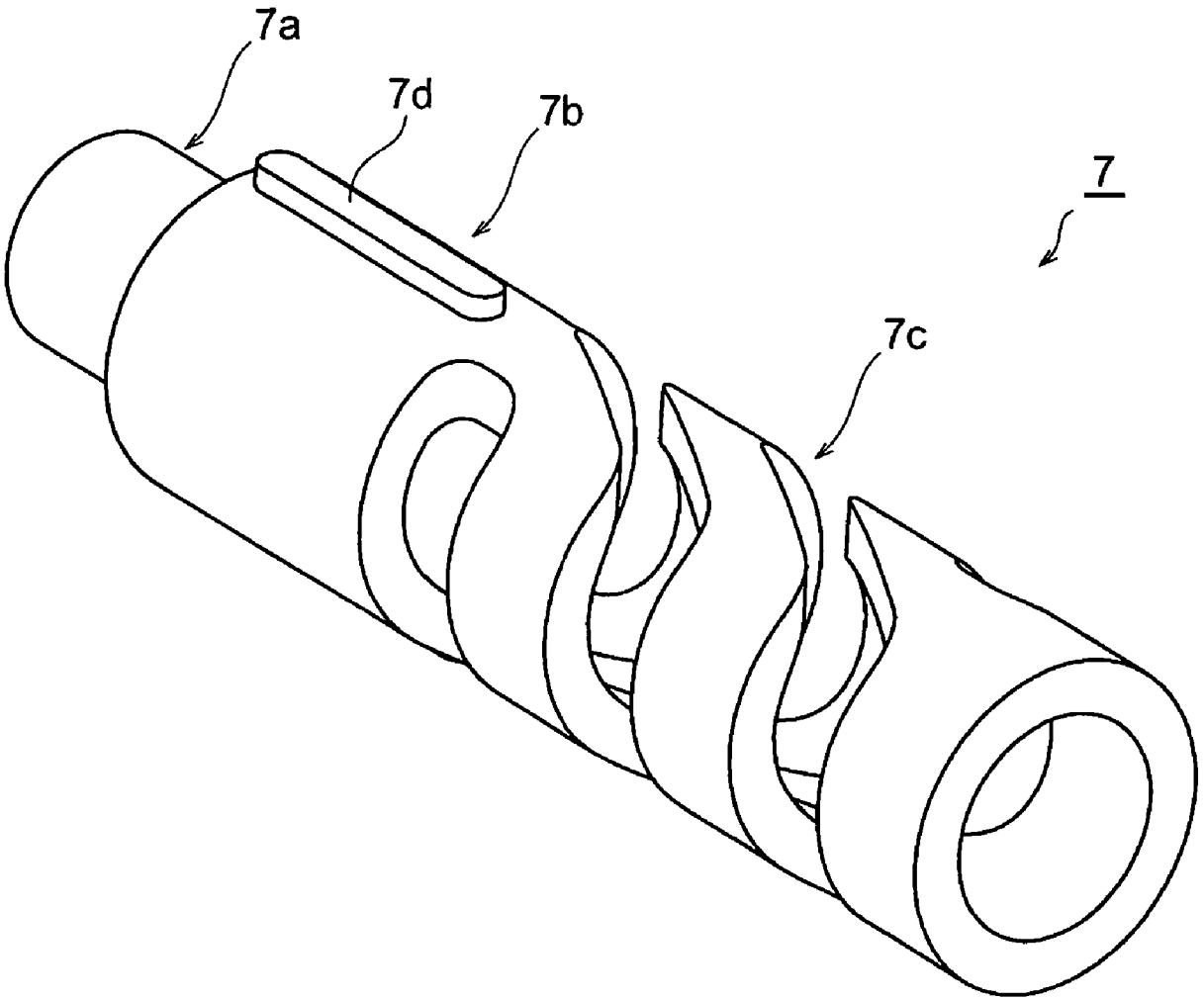
FIG. 9 is a perspective view showing a spring member in FIGS. 1 to 5.

The spring member 7 is formed as an injection molded product by a resin which is continuously provided with an outer diameter small-diameter portion 7*a* in a leading end, an outer diameter large-diameter portion 7*b* connected to a rear end of the outer diameter small-diameter portion 7*a*, and a spring portion (a pipe member side spring portion) 7*c* freely expanding and contracting in an axial direction and connected to a rear end of a stepped cylinder portion having the outer diameter large-diameter portion 7*b*. The outer diameter small-diameter portion 7*a* is set to such a dimension that the outer diameter small-diameter portion 7*a* can be inserted to the hole forming the inner peripheral surface 3*j* in the rear end portion of the leading tube 3. Further, the outer diameter large-diameter portion 7*b* of the spring member 7 is provided with protrusions 7*d* and 7*d* moving forward to a portion between the front side portions 1*c* and 1*c* from the step surface 1*b* of the protrusion 1*f* of the main body tube 1 so as to be engaged with the main body tube 1 in a rotational direction, at opposing positions in an outer peripheral surface, as shown in FIGS. 9, 11 and 12.

Figure 10:
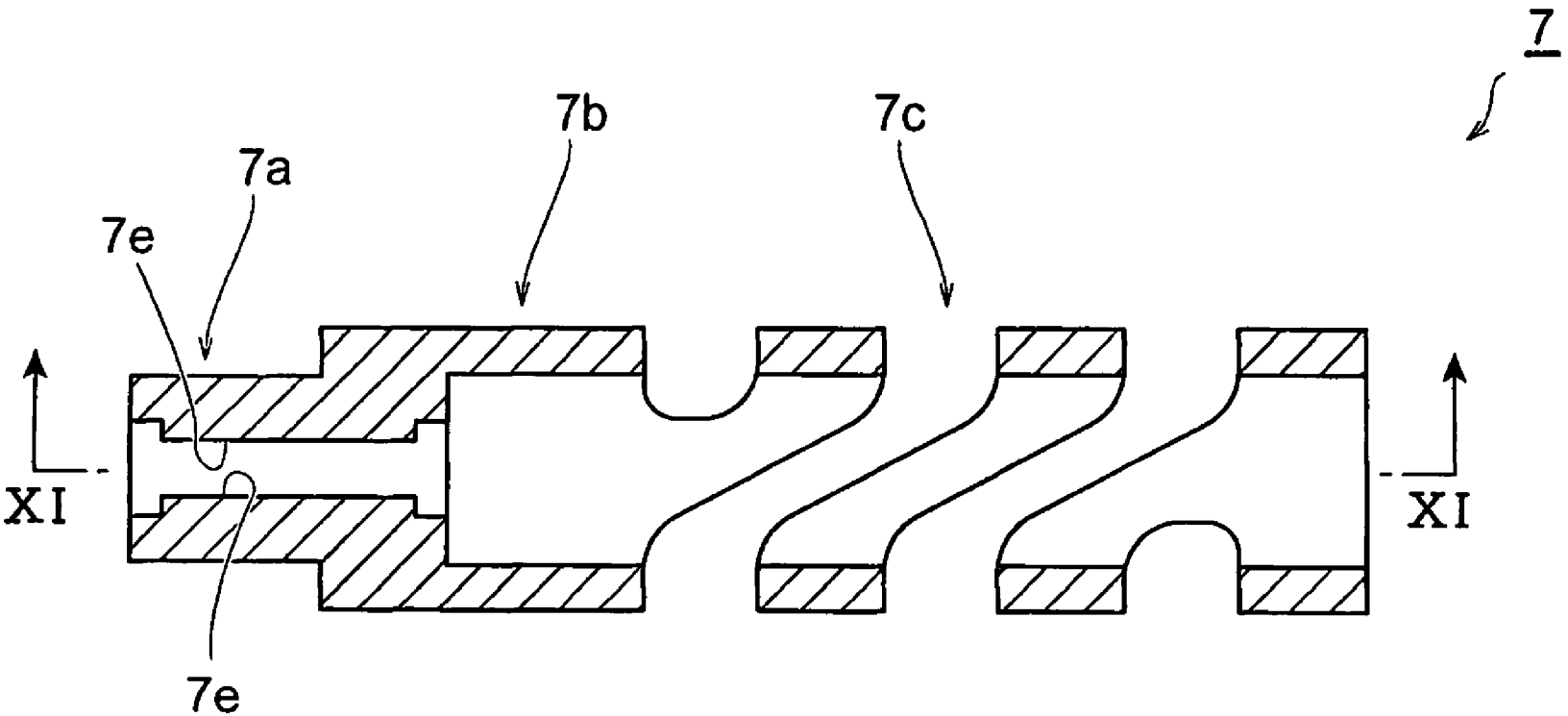
FIG. 10 is a vertical sectional view of the spring member shown in FIG. 9.
Figure 11:
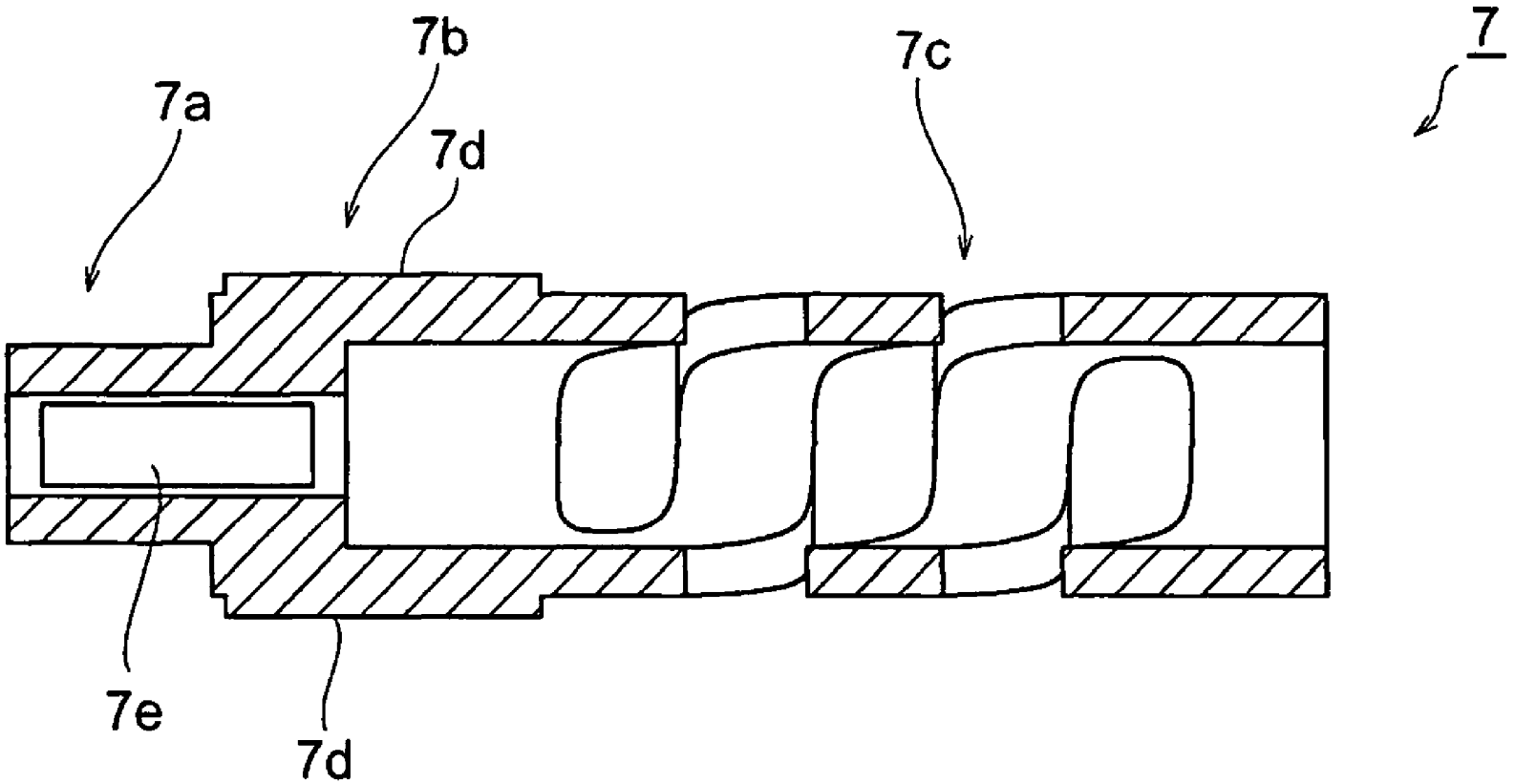
FIG. 11 is a view as seen from an arrow XI-XI in FIG. 10.
Figure 12:
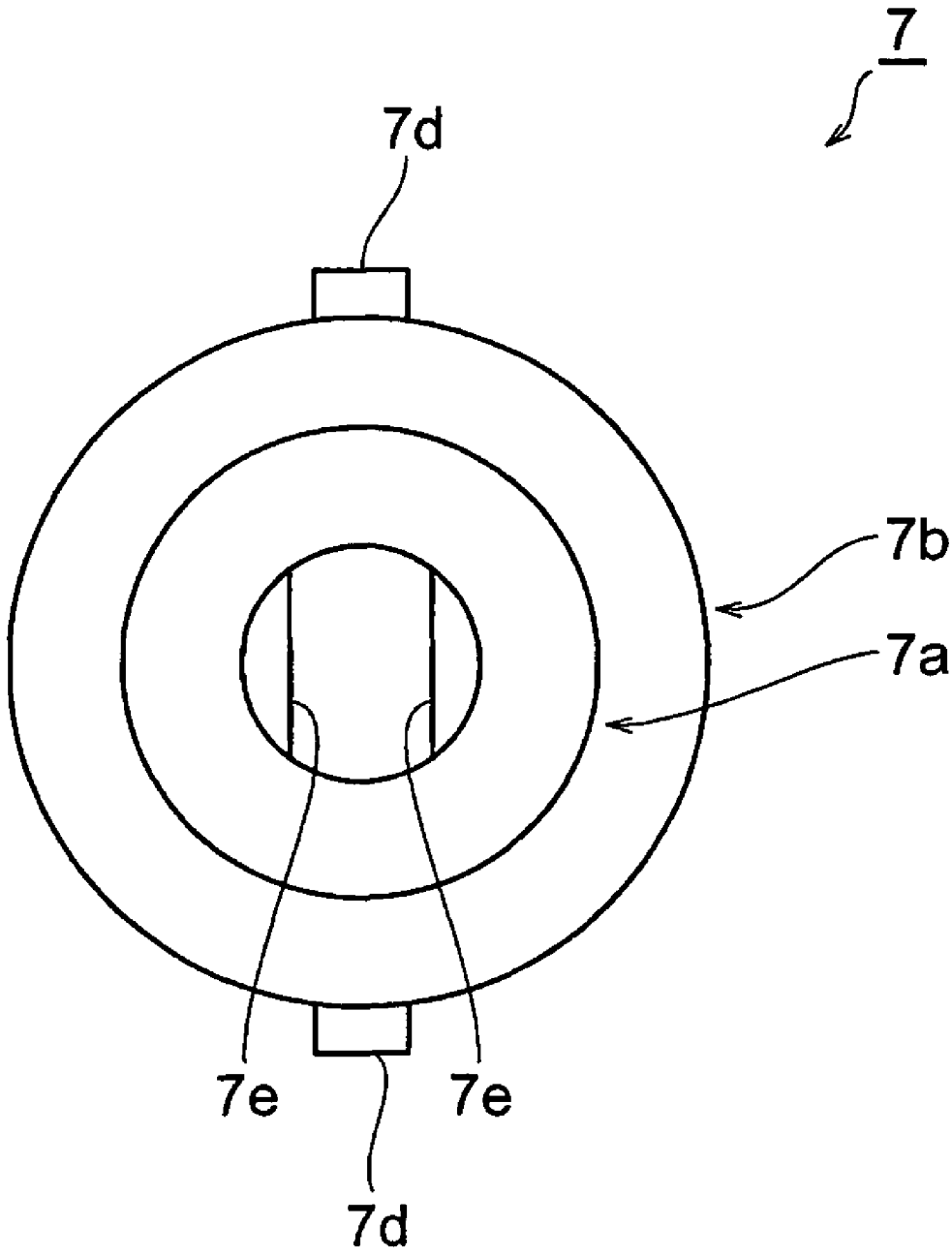
FIG. 12 is a left side view of the spring member shown in FIG. 11.

Further, as shown in FIGS. 10 to 12, a tube hole from a portion near a leading end of the spring member 7 to an approximately center of the outer diameter large-diameter portion 7*b* is formed in a non-circular shape in a transverse section having two flat surface portions 7*e* and 7*e* formed in an inner periphery in a facing manner, and these two flat surface portions 7*e* and 7*e* are set to a rotation prevention constituting one side of a rotation preventing portion (a rotation preventing mechanism) 50.

As shown in FIGS. 1 and 4, the spring member 7 is inserted into the main body tube 1, and the protrusion 7*d* of the outer diameter large-diameter portion 7*b* is engaged with the portion between the front side portions 1*c* and 1*c* from the step surface 1*b* of the protrusion 1*f* of the main body tube 1 in a state in which a rear end surface thereof is contacted to the step surface 1*b* of the main body tube 1, and the front half portion of the outer diameter small-diameter portion 7*a* is inserted to the hole forming the inner peripheral surface 3*j* in the rear end portion of the leading tube 3, thereby being engaged with the main body tube 1 so as to be non-rotatable and slidable in the axial direction.

Figure 18:
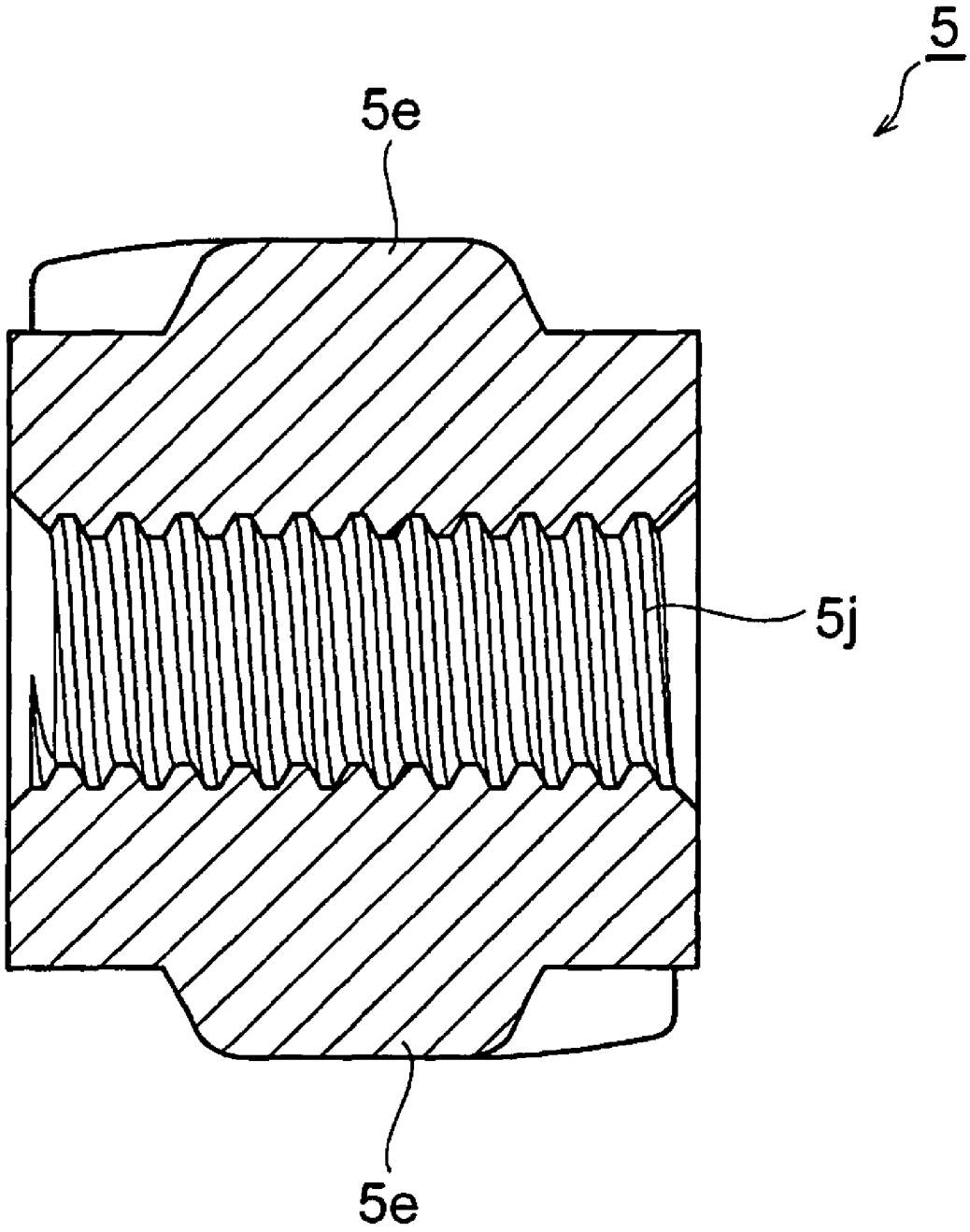
FIG. 18 is a vertical sectional view of the pipe member moving body shown in FIG. 16.

As shown in FIGS. 15 to 18, the pipe member moving body 5 is formed in a short cylindrical shape, and is provided with a pair of engagement projections (pipe member side threads) 5*e* serving as a male thread constituting the other side of the first engagement portion (the engagement mechanism) 8 in an outer peripheral surface thereof. Further, an inner peripheral surface of the pipe member moving body 5 is provided with a female thread 5*j* constituting one side of the second engagement portion (the engagement mechanism) 9, as shown in FIG. 18.

As shown in FIGS. 1 and 4, the pipe member moving body 5 is inserted into a rear portion of the leading tube 3, and is set to a state of being pressed against the step surface 3*m* of the leading tube 3 by the spring portion 7*c* of the spring member 7 in a state in which a rear end surface thereof is brought into contact with a leading end surface of the spring member 7, and the engagement projection 5*e* comes off from the rear end of the spiral groove 3*i* of the leading tube 3 so as to cancel the engagement. In this state, a predetermined space by which the leading end surface of the outer diameter large-diameter portion 7*b* moves forward on the basis of an energizing force of the spring portion 7*c* is formed between the leading end surface of the outer diameter large-diameter portion 7*b* of the spring member 7 and the rear end surface of the leading tube 3.

The rod-like body moving body 6 is formed, as an injection molded product of a resin, by connecting a thread rod 6*y* long in an axial direction to a rear end of the piston 6*x* in the leading end, as shown in FIG. 13. The thread rod 6*y* is provided with two flat surface portions 6*a* and 6*a* formed so as to oppose on the outer periphery from the rear end to the portion near the leading end portion, and a male thread 6*b* formed in an outer periphery over an entire length of the thread rod 6*y*, as shown in FIGS. 13 and 14. Accordingly, the male thread 6*b* in the portion having the two flat surface portions 6*a* and 6*a* of the thread rod 6*y* is formed in a circular arc shape. Further, a forming region of the male thread 6*b* in a front side of the two flat surface portions 6*a* and 6*a* corresponds to a moving length of the rod-like body M. Further, the male thread 6*b* of the rod-like moving body 6 structures the other side of the second engagement portion (the engagement mechanism) 9, and the two flat surface portions 6*a* and 6*a* are set to the rotation prevention constituting the other side of the rotation preventing portion (the rotation preventing mechanism) 50.

As shown in FIGS. 1 and 4, the rod-like body moving body 6 is inserted into the pipe member moving body 5 and the spring member 7, and is set to a state in which the two flat surface portions 6*a* and 6*a* are inserted between two flat surface portions 7*e* and 7*e* of the spring member 7, and the male thread 6*b* is engaged with the female thread 5*j* of the pipe member moving body 5.

Further, in the first engagement portion 8 (refer to FIG. 2) structured by the engagement projection 5*e* of the pipe member moving body 5 and the spiral groove 3*i* of the leading tube 3, and the second engagement portion 9 structured by the female thread 5*j* of the pipe member moving body 5 and the male thread 6*b* of the rod-like body moving body 6, a lead of the first engagement portion 8 is made larger than a lead of the second engagement portion 9, as shown in FIGS. 7 and 18. Accordingly, the engagement operation of the first engagement portion 8 is applied prior to the engagement operation of the second engagement portion 9.

The pipe member 4 is formed in a cylindrical shape as shown in FIGS. 1 and 4, and the rod-like body M is filled by injecting a rod-like body forming material in a molten state to the inner portion thereof so as to cool and solidify. The rod-like body M is slidably accommodated in a close contact state in the pipe member 4. In this case, the close contact state means a state in which an entire of the rod-like body M is brought into close contact with the pipe member 4, a state in which it is partly brought into close contact therewith, and a state in which it comes close thereto and is almost in a close contact state.

The pipe member 4 is inserted into the pipe member hole 3*g* of the leading tube 3, a rear end portion thereof is fitted and inserted to the piston 6*x* and a rear end surface thereof is contacted to the leading end surface of the pipe member moving body 5. In this state, the piston 6*x* is set to a state of being tightly brought into contact with the inner peripheral surface of the pipe member 4. Further, in this state, a predetermined space in which the pipe member 4 moves forward is formed between the leading end surface of the pipe member 4 and the step surface 3*n* corresponding to the forward limit of the pipe member 4 in the leading tube 3, and the rod-like body M is retracted in the leading tube 3 so as to be accommodated.

Figure 2:
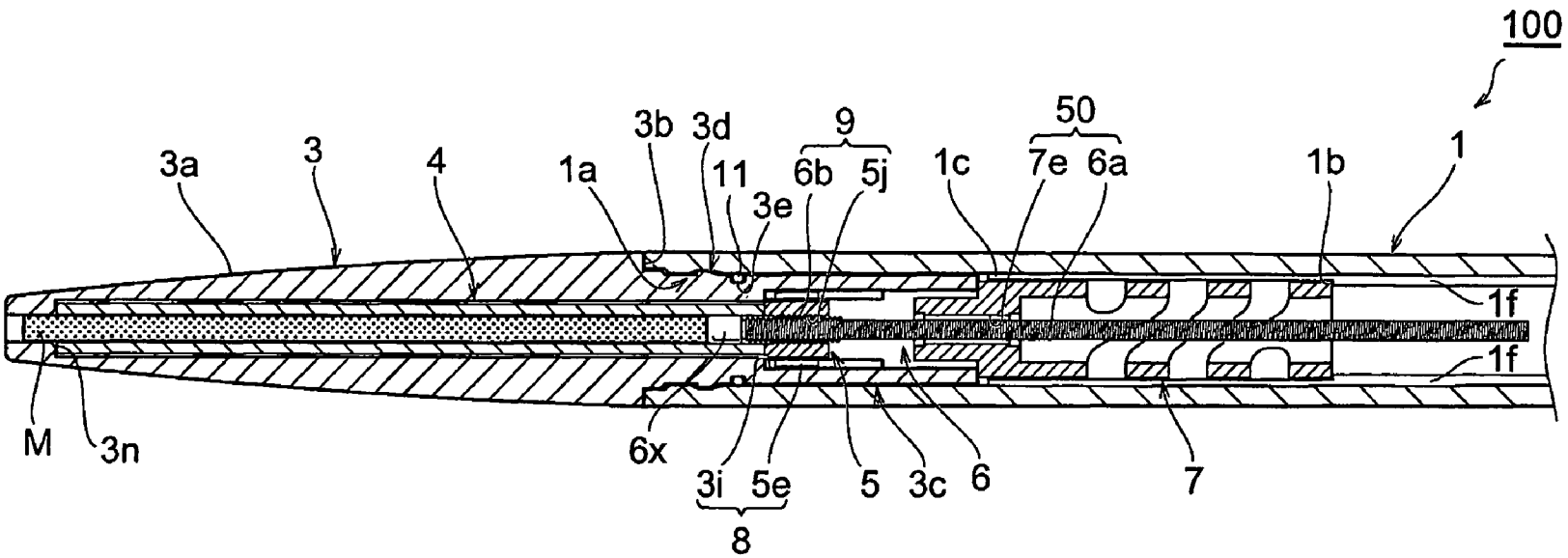
FIG. 2 is a vertical sectional view showing the rod-like body feeding container in accordance with the first embodiment of the present invention, and shows a state in which a pipe member moves forward to the maximum on the basis of an operation of a user.

Further, the rod-like body feeding container is bought as a rod-like body feeding container 100 in an original state shown in FIG. 1 by a user, and is structured in such a manner as to incorporate a first feeding mechanism constituted by the first engagement portion 8 (refer to FIG. 2) structured by the engagement projection 5*e* of the pipe member moving body 5 and the spiral groove 3*i* of the leading tube 3, and the rotation preventing portion 50 structured by the two flat surface portions 7*e* of the spring member 7 and the two flat surface portions 6*a* of the rod-like body moving body 6, and a second feeding mechanism constituted by the second engagement portion 9 structured by the female thread 5*j* of the pipe member moving body 5 and the male thread 6*b* of the rod-like body moving body 6, and the rotation preventing portion 50. When the main body tube 1 and the leading tube 3 are relatively rotated in a feeding direction (one direction) by a user, the leading tube 3 and the pipe member moving body 5 are first relatively rotated because the lead of the first engagement portion 8 is larger (rougher) than that of the second engagement portion 9. Accordingly, the engagement is canceled by being detached from the rear end of the spiral groove 3*i* of the leading tube 3, and the engagement projection 5*e* of the pipe member moving body 5 pressed against the step surface 3*m* of the leading tube 3 by the spring portion 7*c* of the spring member 7 is engaged with the spiral groove 3*i* of the leading tube 3, whereby the engagement operation of the first engagement portion 8 is actuated.

when the relative rotation in the feeding direction is carried on, the engagement operation of the first engagement portion 8 is applied first because the lead of the first engagement portion 8 is made larger in comparison with the lead of the second engagement portion 9 as mentioned above. Accordingly, the pipe member moving body 5 moves forward together with the rod-like body moving body 6 in cooperation with the rotation preventing portion 50 constituted by the two flat surface portions 6*a* of the rod-like body moving body 6 and the two flat surface portions 7*e* of the spring member 7, the pipe member 4 and the rod-like body M are moved forward by being pressed by them, and the pipe member 4 moves forward to the step surface 3*n* corresponding to the forward limit within the leading end of the leading tube 3, as shown in FIG. 2.

At this time, since the lead of the first engagement portion 8 is made larger in comparison with the lead of the second engagement portion 9, the pipe member 4 reaches the use position corresponding to the forward limit quickly in accordance with the large lead of the first engagement portion 8. Further, when the pipe member 4 reaches the step surface 3*n* corresponding to the forward limit, the forward movement is inhibited, and the engagement operation of the first engagement portion 8 is stopped.

Figure 3:
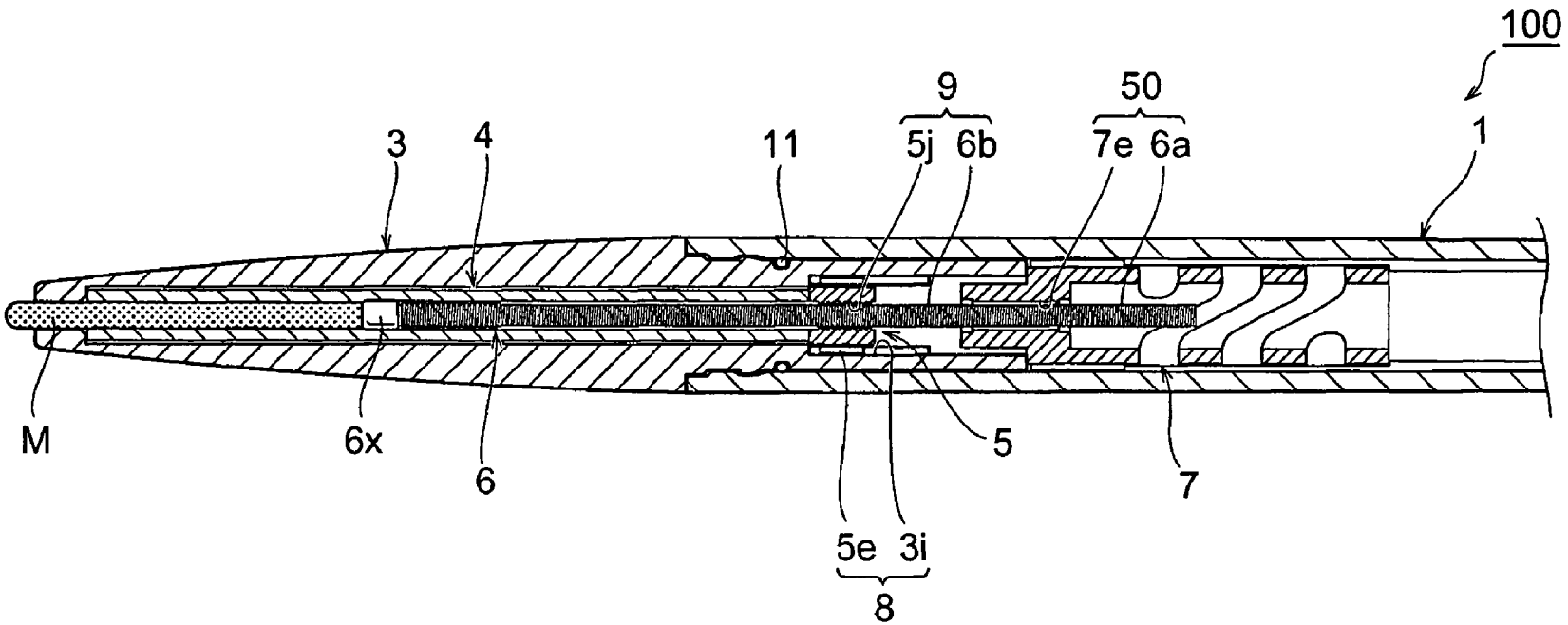
FIG. 3 is a vertical sectional view showing the rod-like body feeding container in accordance with the first embodiment of the present invention, and shows a state in which the pipe member moves forward to the maximum on the basis of an operation of the user and a rod-like body moving body subsequently moves forward to a use state.

When the main body tube 1 and the leading tube 3 are relatively rotated in the feeding direction successively, the engagement operation of the second engagement portion 9 is applied because the engagement operation of the first engagement portion 8 is stopped. Accordingly, the piston 6*x* moves forward while sliding within the pipe member 4 as shown in FIG. 3 in cooperation with the rotation preventing portion 50, the rod-like body M is moved forward by being pressed by the piston 6*x*, and the leading end portion of the rod-like body M appears from the opening of the leading tube 3.

At this time, since the lead of the second engagement portion 9 is made smaller in comparison with the lead of the first engagement portion 8, the rod-like body moving body 6 is slowly fed in accordance with the small lead of the second engagement portion 9, and the rod-like body M is suitably fed from the pipe member 4 so as to suitably appear from the inner side of the leading tube 3 and be set to the use state.

When the main body tube 1 and the leading tube 3 are relatively rotated in the feed-back direction (the other direction reverse to one direction) after being used, the engagement operation of the first engagement portion 8 is first applied because the lead of the first engagement portion 8 is made larger in comparison with the lead of the second engagement portion 9 as mentioned above. The pipe member moving body 5 is moved backward together with the rod-like body moving body 6 in cooperation with the rotation preventing portion 50.

At this time, as mentioned above, since the piston 6*x* is in the state of being tightly brought into contact with the inner peripheral surface of the pipe member 4, the piston 6*x* is moved backward together with the pipe member 4, and is moved backward together with the rod-like body M tightly brought into contact with the inner peripheral surface of the pipe member 4, and the pipe member 4 and the leading end portion of the rod-like body M are retracted from the opening of the leading end of the leading tube 3, as shown in FIG. 4.

At this time, since the lead of the first engagement portion 8 is made larger in comparison with the lead of the second engagement portion 9, the pipe member 4 is fed back quickly in accordance with the larger lead of the first engagement portion 8. Further, when the pipe member 4 is fed back to the accommodated position within the leading tube 3, the engagement projection 5*e* of the pipe member moving body 5 is set to a state in which the engagement is canceled by being detached from the rear end of the spiral groove 3*i* of the leading tube 3 and the engagement projection is pressed against the step surface 3*m* of the leading tube 3 by the spring portion 7*c* of the spring member 7.

Accordingly, in this state, even if the main body tube 1 and the leading tube 3 are relatively rotated further in the feed-back direction, the main body tube 1 and the leading tube 3 slip, the engagement operation of the second engagement portion 9 is not applied, the rod-like body moving body 6 is not moved backward, and the rod-like body M is in a state of protruding from the pipe member 4 (refer to FIG. 4).

Further, when the main body tube 1 and the leading tube 3 are relatively rotated in the feeding direction by the user for making the rod-like body M in the use state, in the state shown in FIG. 4, the engagement projection 5*e* of the pipe member moving body 5, which is detached from the rear end of the spiral groove 3*i* of the leading tube 3, whereby the engagement is canceled, and is pressed against the step surface 3*m* of the leading tube 3 by the spring portion 7*c* of the spring member 7, is again engaged with the spiral groove 3*i* of the leading tube 3, and the engagement operation of the first engagement portion 8 is again applied.

When the relative rotation in the feeding direction is carried on, the pipe member 4 including the rod-like body moving body 6 is moved forward on the basis of the engagement operation of the first applied first engagement portion 8, as mentioned above, and the pipe member 4 reaches the forward limit. At this time, since the rod-like body M protrudes from the pipe member 4 as mentioned above, the leading end portion of the rod-like body M protruding from the pipe member 4 appears from the inner side of the leading tube 3 so as to be immediately set to the use state, as shown in FIG. 3.

In the case that the protruding degree of the rod-like body M from the leading tube 3 is small at a time when the rod-like body M appears from the inner side of the leading tube 3, or at a time when the rod-like body M appearing from the inner side of the leading tube 3 is consumed by using, it is preferable to relatively rotate the main body tube 1 and the leading tube 3 successively in the feeding direction. Since the engagement operation of the first engagement portion 8 is stopped, the engagement operation of the second engagement portion 9 is applied, and the rod-like body M is fed out. Further, the same motion as mentioned above is executed after being used. The motion mentioned above is repeated.

As mentioned above, in accordance with the rod-like body feeding container 100 of the present embodiment, since the pipe member 4 is moved forward with respect to the leading tube 3 by utilizing the first engagement portion 8 in accordance with the relative rotation between the main body tube 1 and the leading tube 3, and the rod-like body M is moved forward with respect to the pipe member 4 so as to protrude from the pipe member 4 by utilizing the second engagement portion 9 in accordance with the relative rotation between the main body tube 1 and the leading tube 3, the rod-like body M is set to the use state on the basis of the forward moving motions. Further, since the pipe member 4 is moved backward with respect to the leading tube 3 by utilizing the first engagement portion 8 in accordance with the relative rotation between the main body tube 1 and the leading tube 3, the pipe member 4 is fed back to the accommodated position within the leading tube 3. In particular, the rod-like body moving body 6 extruding the rod-like body M within the pipe member 4 on the basis of the forward movement is provided, the first engagement portion 8 is structured such that the engagement operation is first applied when the main body tube 1 and the leading tube 3 are relatively rotated in the feeding direction and the feed-back direction, thereby moving forward and backward the pipe member 4 including the rod-like body moving body 6, and the engagement operation is stopped when the pipe member 4 reaches the forward limit, and the second engagement portion 9 is structured such that the engagement operation is applied when the main body tube 1 and the leading tube 3 are relatively rotated further in the feeding direction in a state in which the pipe member 4 reaches the forward limit and the engagement operation of the first engagement portion 8 is stopped, thereby moving forward the rod-like body moving body 6. Accordingly, it is possible to solve the problem that the feeding order is reversed which may be generated in the case that the single engagement portion is used, and it is possible to desirably and accurately feed the pipe member 4 and the rod-like body M. Therefore, it is possible prevent malfunction.

Further, in accordance with the rod-like body feeding container 100, since the rod-like body M is filled within the pipe member 4 so as to be formed, and the rod-like body M is accommodated in the pipe member 4 so as to be protected, and is used by being fed only at a necessary amount, the rod-like body M can be formed into a thin rod-like body or a fragile and soft rod-like body having a reduced strength.

Further, in accordance with the rod-like body feeding container 100, since the rod-like body M is accommodated in the pipe member 4 so as to be slidable in the close contact state, the rod-like body M can be continuously used without coming off from the pipe member 4 even in the case that the rod-like body M is broken due to an external force application such as an impact, a vibration or the like, for example, caused by dropping of the container 100 or the like.

Further, in accordance with the rod-like body feeding container 100, since the structure is made such that the rod-like body M is extruded within the pipe member 4 on the basis of the forward movement of the rod-like body moving body 6 so as to be slid and fed, it is possible to use the rod-like body M to the end. In this case, FIG. 5 shows the rod-like body feeding container 100 at a time of using the rod-like body M to the end so as to feed the rod-like body moving body 6 to the maximum.

Further, in accordance with the rod-like body feeding container 100, since the lead of the first engagement portion 8 is made larger in comparison with the lead of the second engagement portion 9, the engagement operation of the first engagement portion 8 is securely applied prior to that of the second engagement portion 9, the pipe member 4, to which the engagement operation of the first engagement portion 8 is applied, is fed to the use position quickly in accordance with the large lead, on the basis of the relative rotation in the feeding direction between the main body tube 1 and the leading tube 3, the rod-like body moving body 6, to which the engagement operation of the second engagement portion 9 is applied, is fed slowly in accordance with the small lead on the basis of the further relative rotation in the feeding direction between the main body tube 1 and the leading tube 3, the rod-like body M suitably protrudes from the pipe member 4 so as to be set to the use state, and the pipe member 4 is quickly fed back to the accommodated position within the leading tube 3 in accordance with the large lead on the basis of the relative rotation in the feed-back direction between the main body tube 1 and the leading tube 3 after being used. As a result, a usability (easiness in use) is improved. Further, since the lead of the second engagement portion 9 is small (fine), it is possible to prevent the rod-like body M from being erroneously fed too much.

Further, when the main body tube 1 and the leading tube 3 are relatively rotated in the feed-back direction after the pipe member 4 reaches the forward limit and the rod-like body M protrudes from the pipe member 4 so as to be set to the use state, the pipe member 4 including the rod-like body moving body 6 is moved backward on the basis of the engagement operation of the first operated first engagement portion 8, and the pipe member 4 reaches a predetermined position at which the pipe member 4 is accommodated within the leading tube 3. Then, the engagement of the first engagement portion 8 is canceled, the main body tube 1 and the leading tube 3 slip in such a manner that the engagement operation of the second engagement portion 9 is not applied, and the rod-like body M is set to the state of protruding from the pipe member 4 so as to prevent the rod-like body moving body 6 from moving backward due to the slip. When the main body tube 1 and the leading tube 3 are relatively rotated in the feeding direction, the first engagement portion 8 is returned to be engaged, and the pipe member 4 including the rod-like body moving body 6 is moved forward. In accordance with the structure, when the pipe member 4 reaches the forward limit, the rod-like body M in which the leading end portion protrudes from the pipe member 4 is immediately set to the use state, and the usability (easiness in use) is further improved.

In this case, in the present embodiment, as the preferable structure, the rod-like body M is filled in the pipe member 4 by injecting the rod-like body forming material in the molten state in the pipe member 4 so as to cool and solidify, however, it is possible to fit and insert a previously manufactured rod-like body to the pipe member 4 in a close contact state so as to use. In this case, it is preferable to use a pipe member 64 shown in FIGS. 32 to 35 mentioned below. Further, the pipe member 4 and the pipe member moving body 5 may be integrated in accordance with an engagement, or may be constituted by an integrally molded product.

Figure 22:
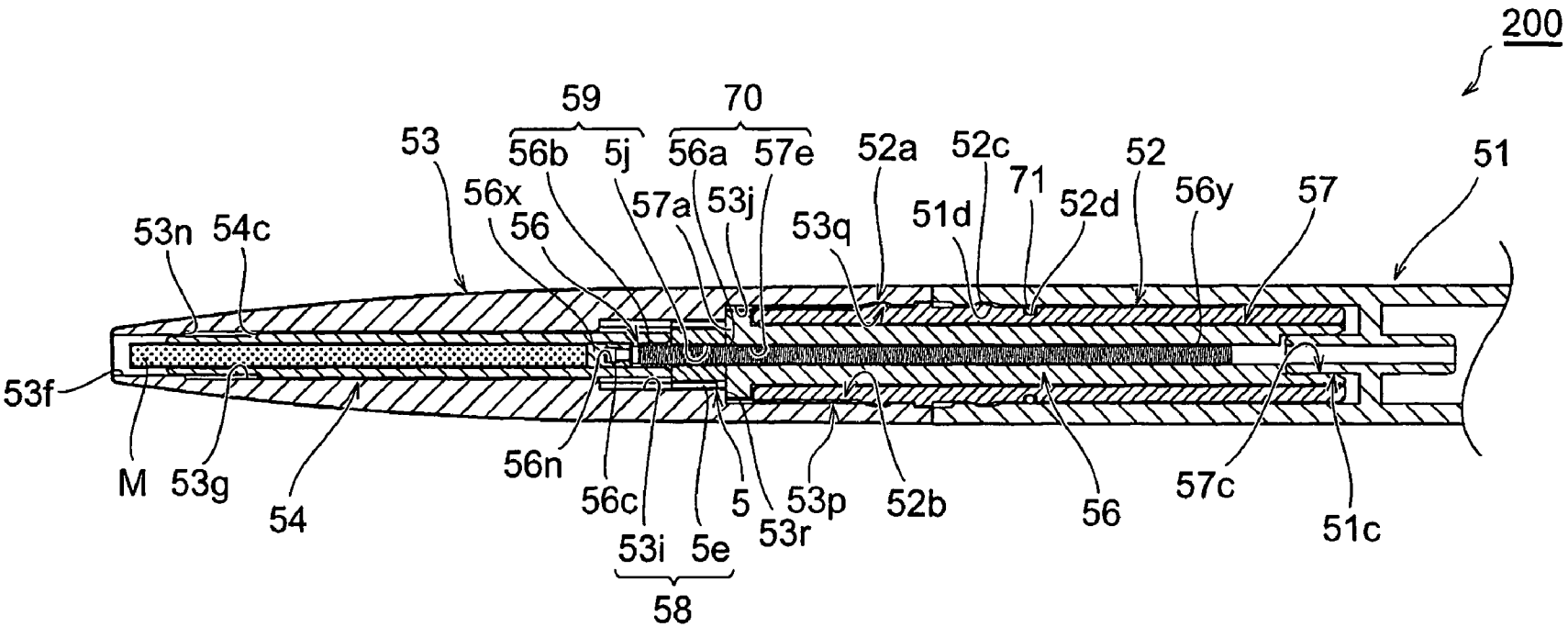
FIG. 22 is a vertical sectional view showing the rod-like body feeding container in accordance with the second embodiment of the present invention, and shows a state in which the pipe member moves backward to the maximum on the basis of an operation of the user after using.
Figure 23:
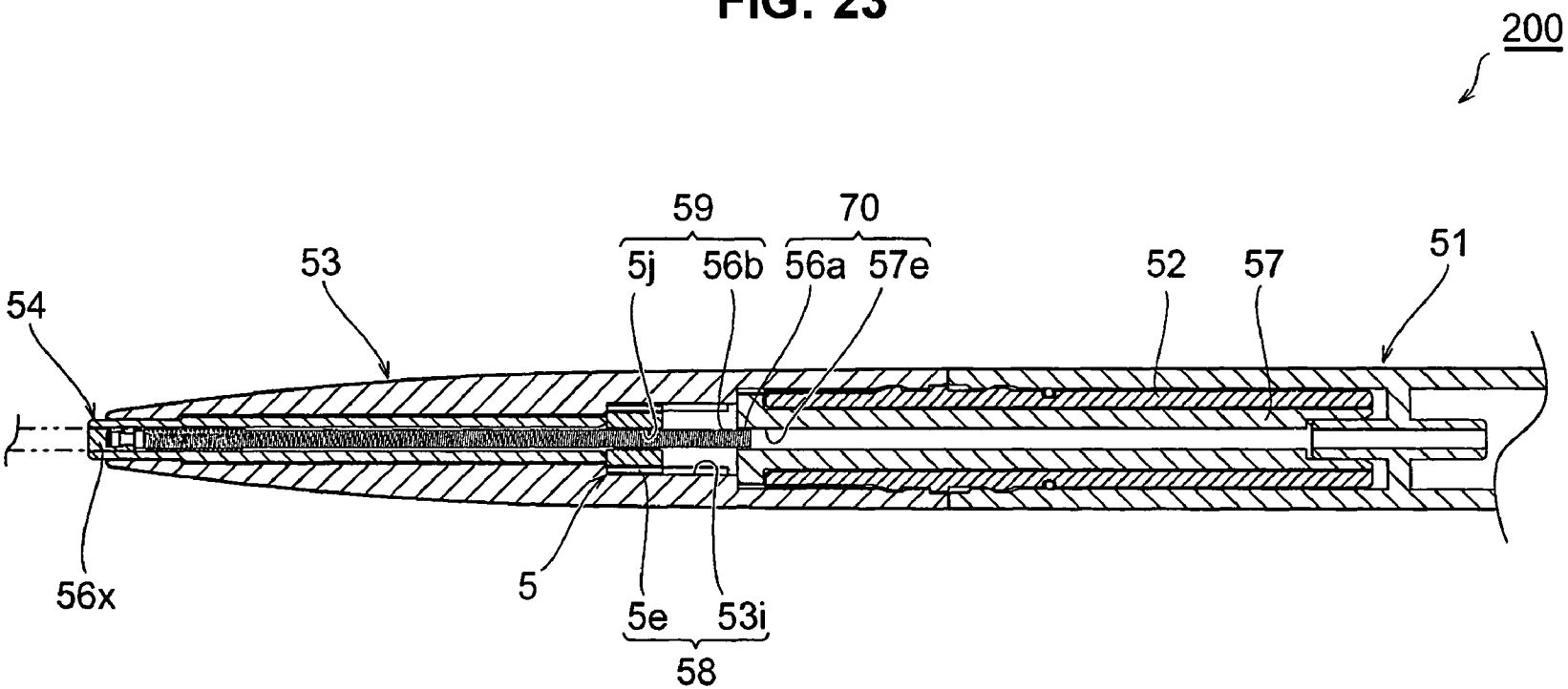
FIG. 23 is a vertical sectional view showing the rod-like body feeding container in accordance with the second embodiment of the present invention, and shows a state in which the pipe member moves forward to the maximum on the basis of an operation of the user and the rod-like body moving body moves forward to the maximum.
Figure 24:
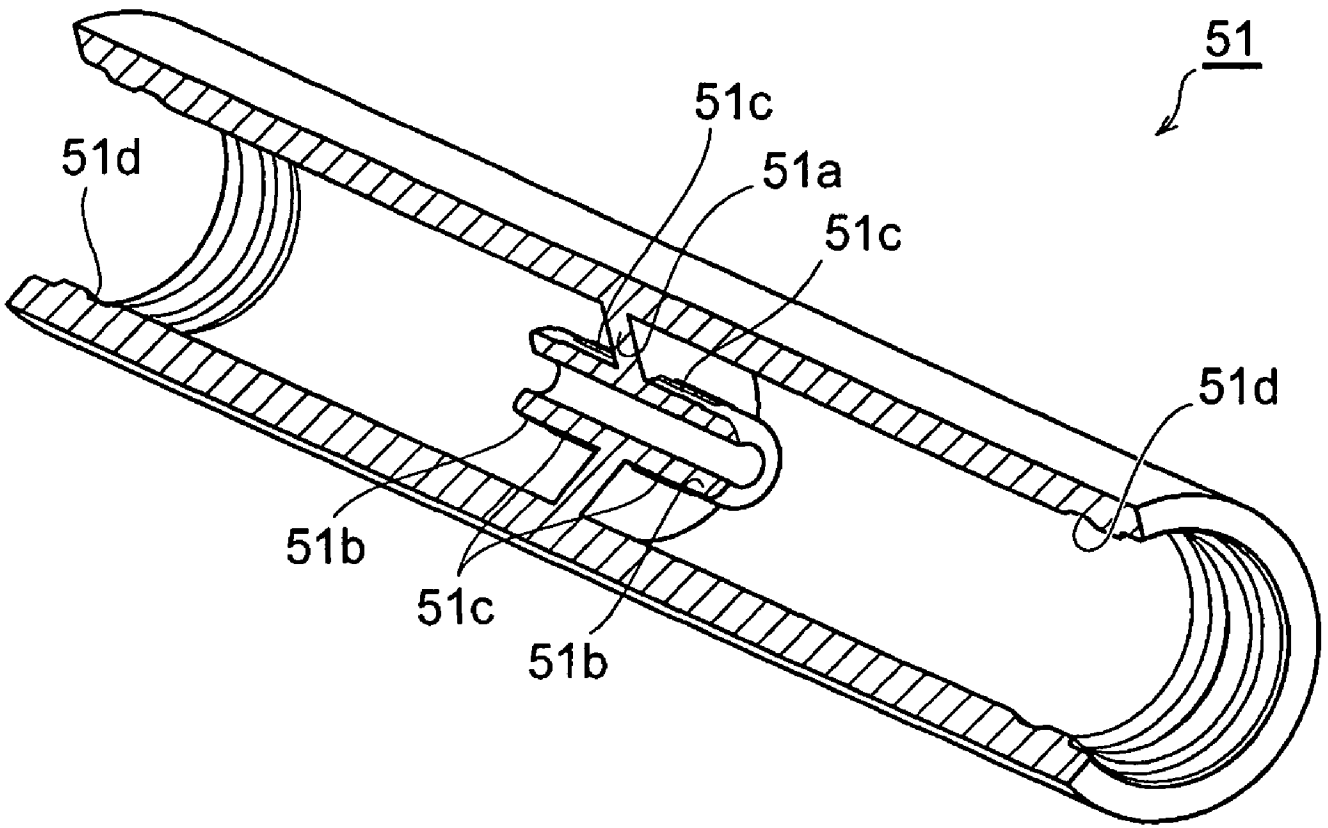
FIG. 24 is a sectional perspective view showing a main body tube in FIGS. 19 to 23.
Figure 25:
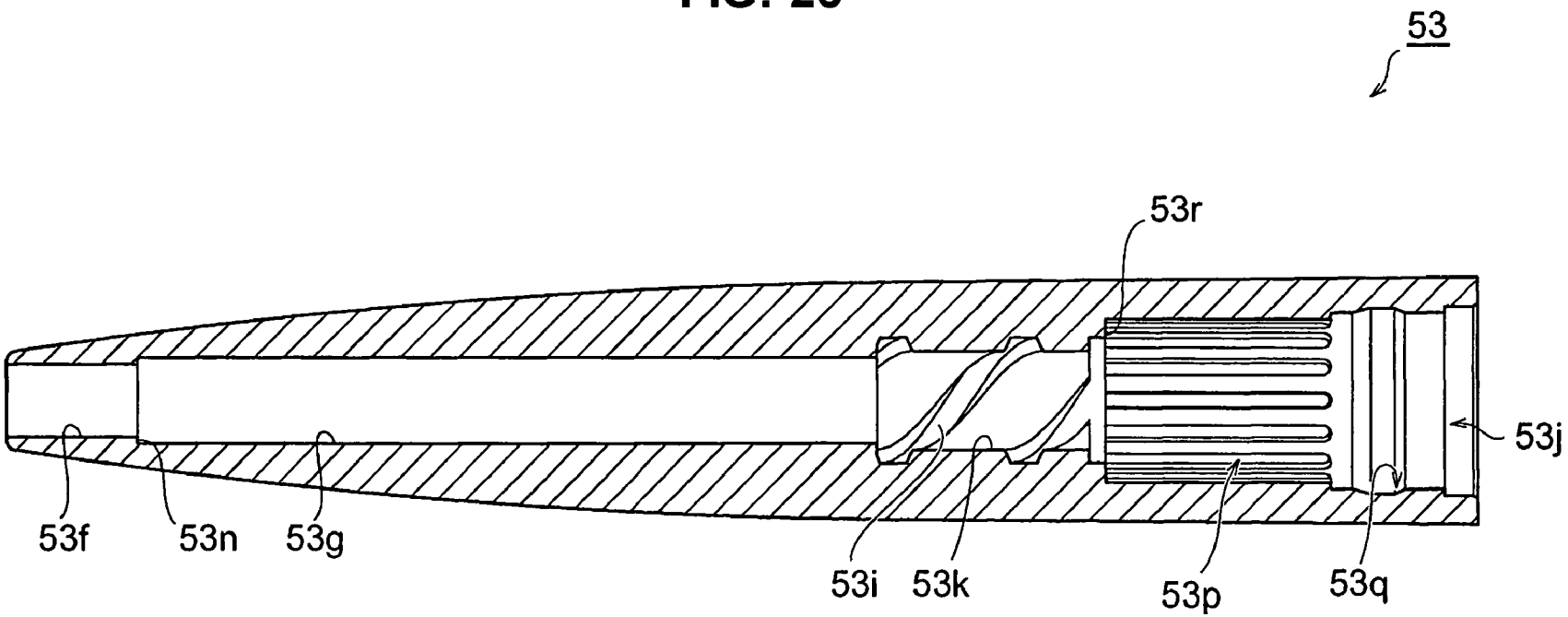
FIG. 25 is a vertical sectional view showing a leading tube in FIGS. 19 to 23.
Figure 26:
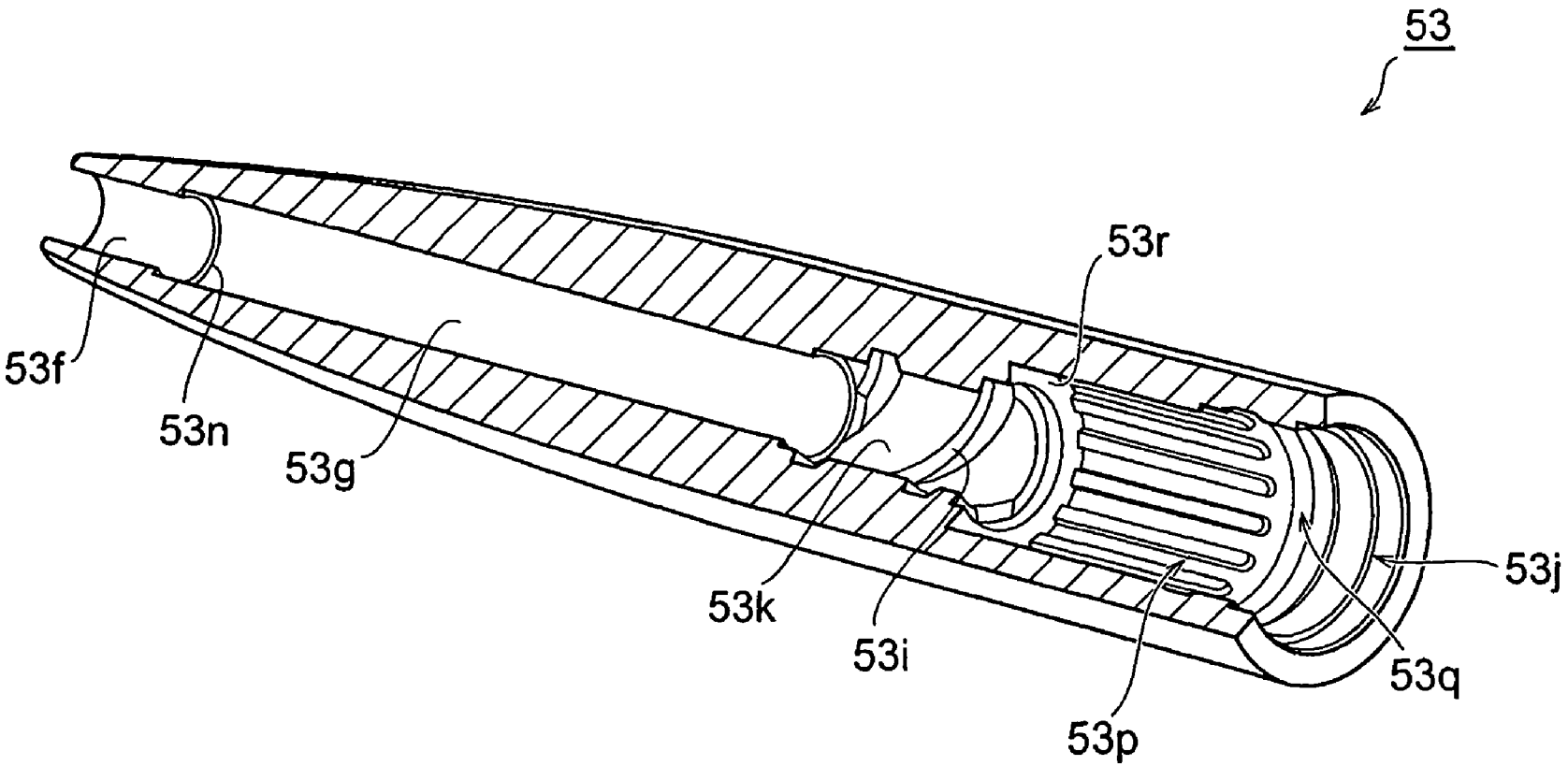
FIG. 26 is a sectional perspective view showing the leading tube in FIGS. 19 to 23.
Figure 27:
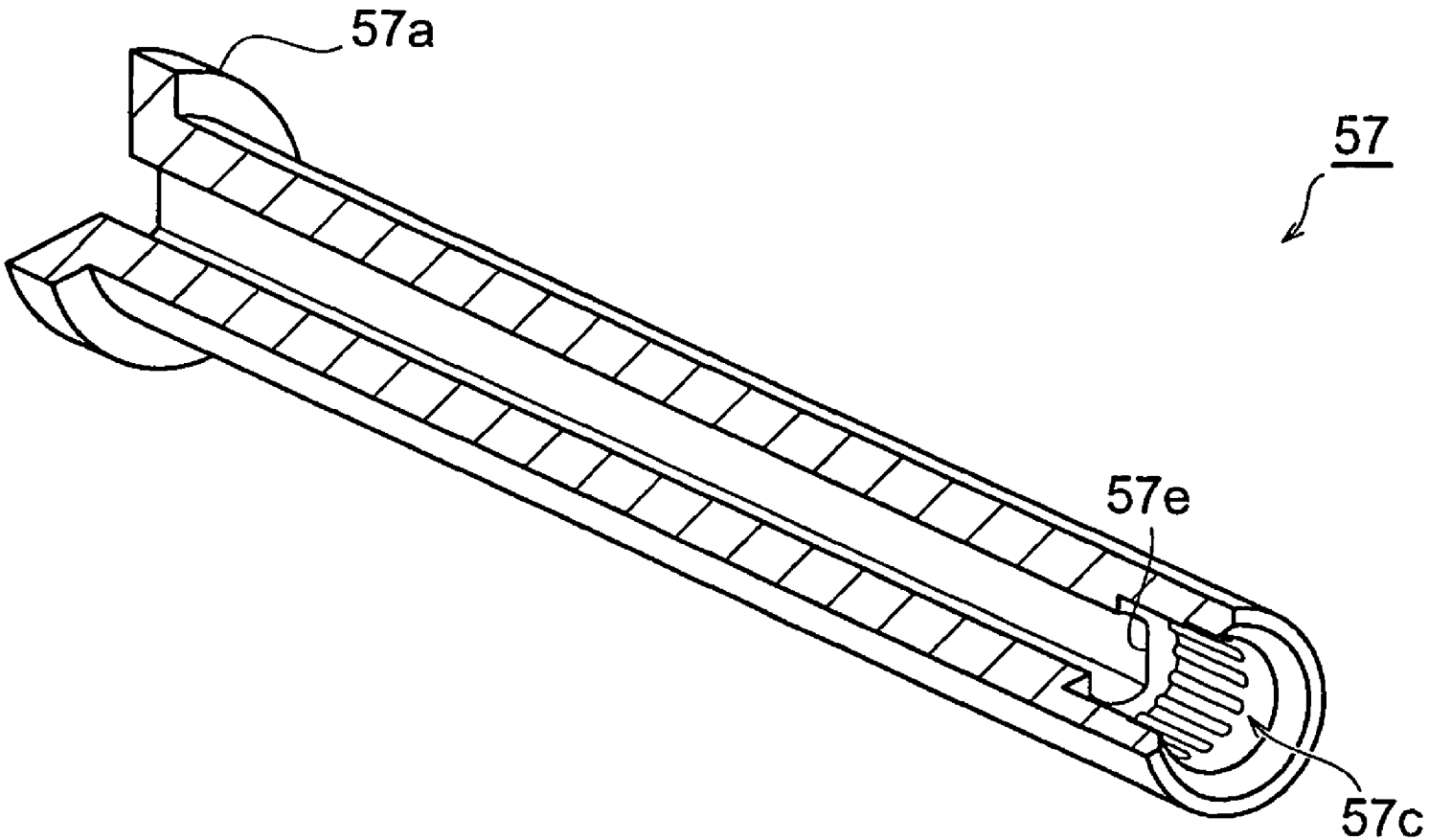
FIG. 27 is a sectional perspective view showing a rotation preventing member in FIGS. 19 to 23.
Figure 28:
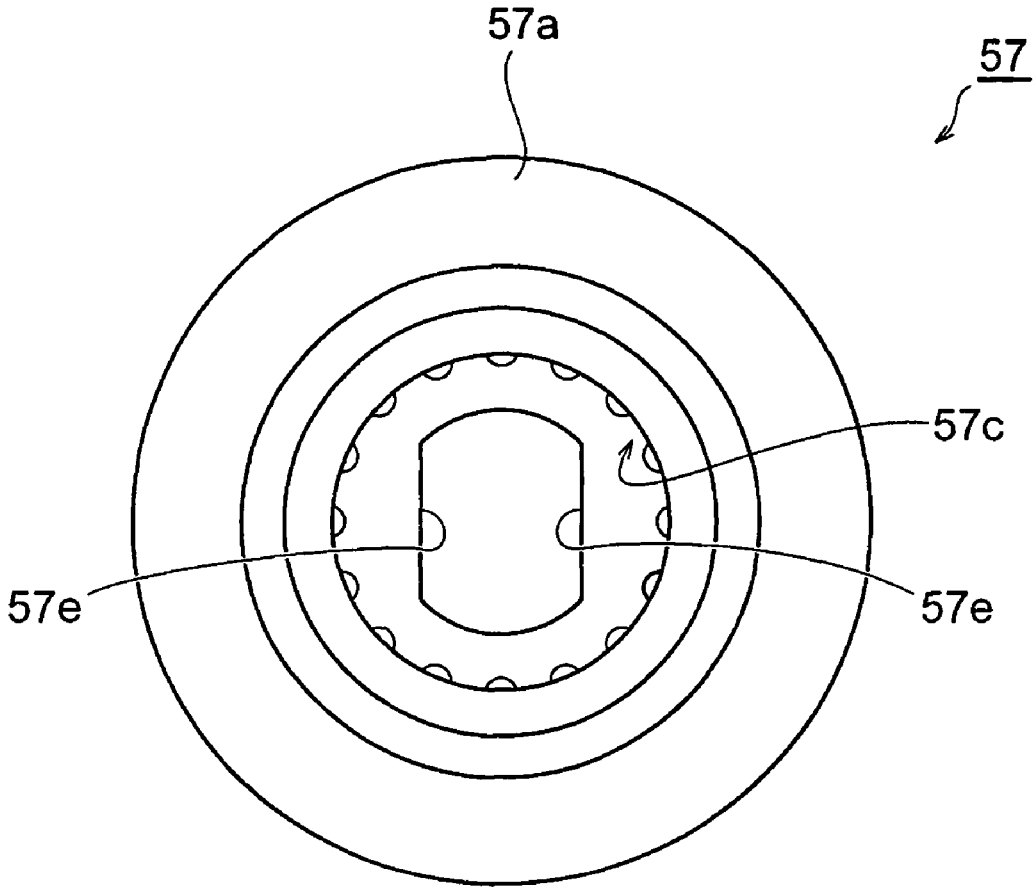
FIG. 28 is a right side view of the rotation preventing member shown in FIG. 27.
Figure 29:
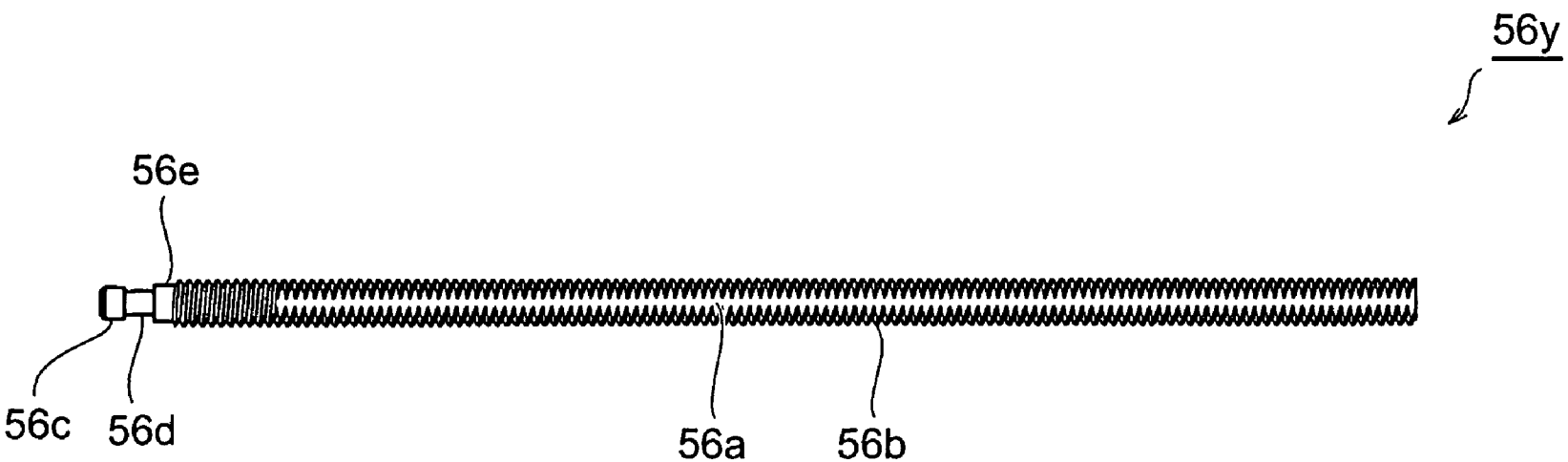
FIG. 29 is a sectional perspective view showing a coupling member in FIGS. 19 to 23.
Figure 30:
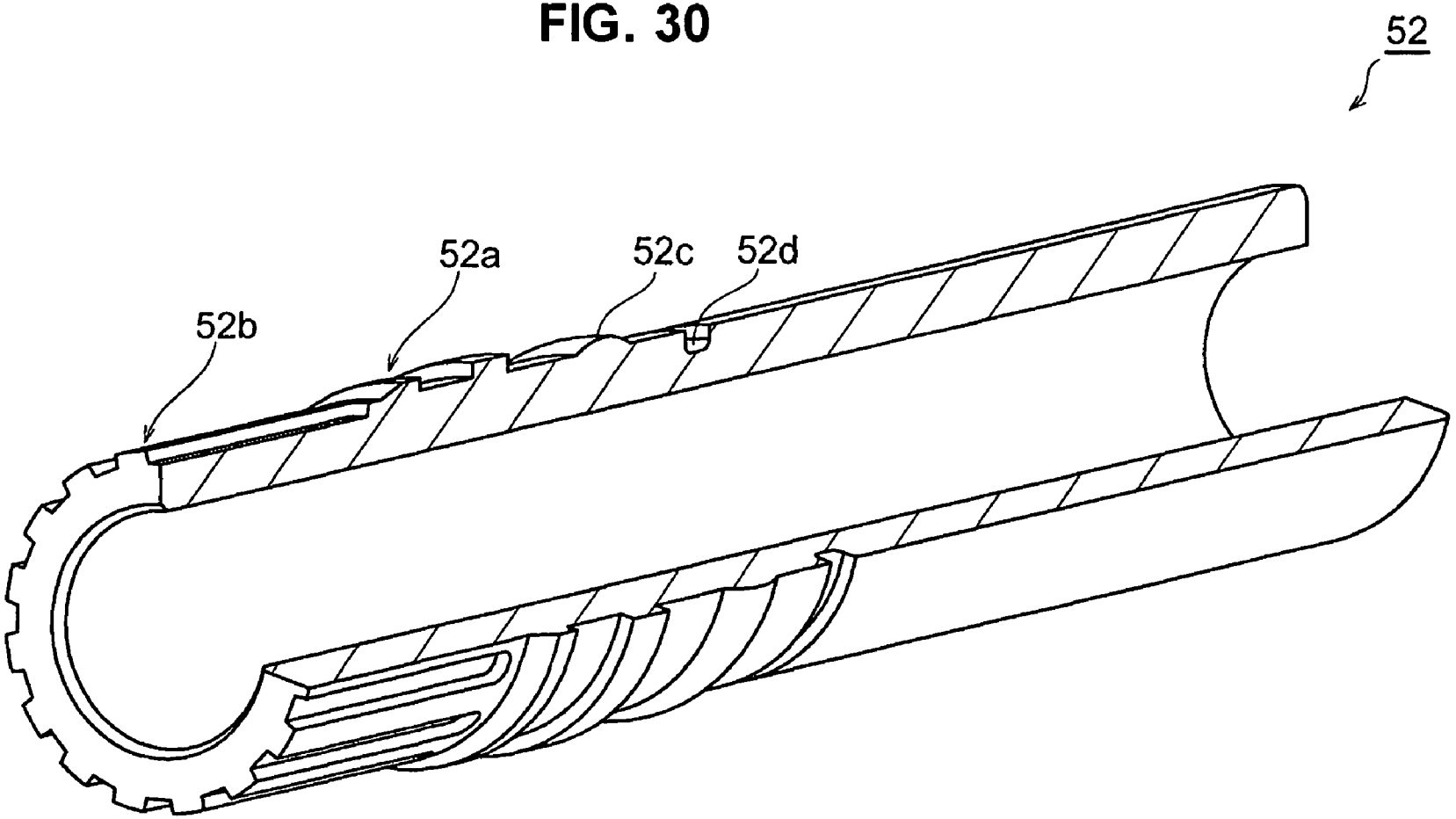
FIG. 30 is a side view showing a thread rod constituting a rod-like body moving body in FIGS. 19 to 23.
Figure 31:
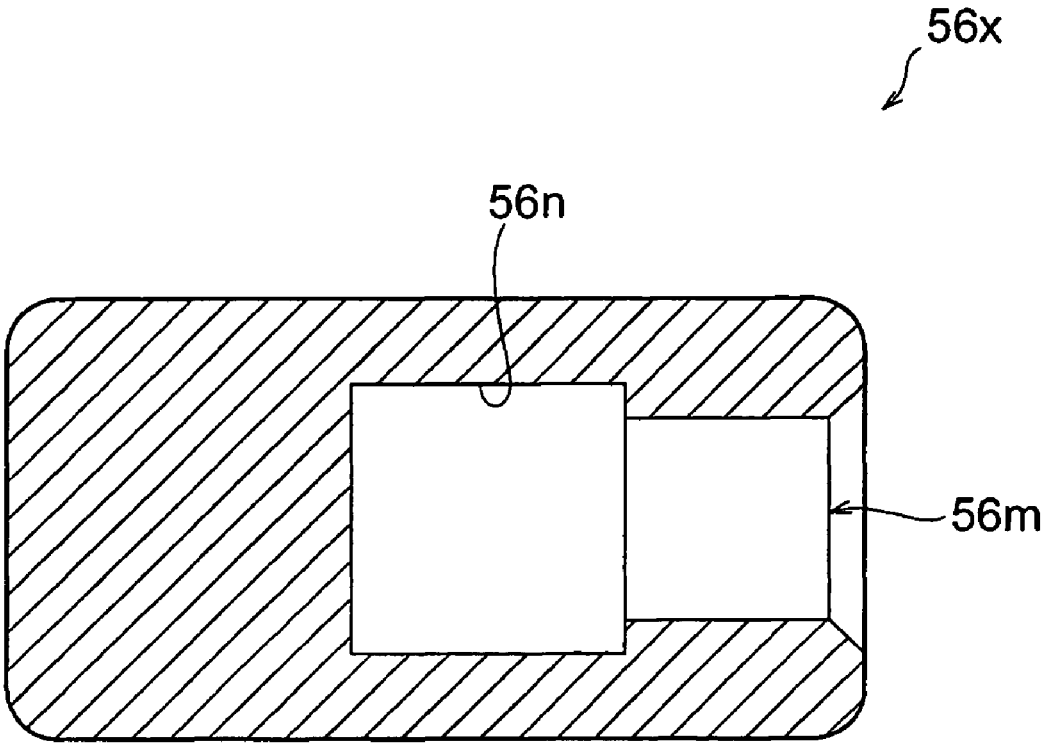
FIG. 31 is a vertical sectional view showing a piston constituting the rod-like body moving body in FIGS. 19 to 23.

FIGS. 19 to 23 are respective vertical sectional views showing respective states of a rod-like body feeding container in accordance with a second embodiment of the present invention, FIG. 24 is a sectional perspective view showing a main body tube, FIGS. 25 and 26 are respective views showing a leading tube, FIGS. 27 and 28 are respective views showing rotation preventing member, FIG. 29 is a sectional perspective view showing a coupling member, FIG. 30 is a side view showing a thread rod, FIG. 31 is a vertical sectional view showing a piston, and FIGS. 32 to 35 are respective views showing a pipe member used in place of the pipe member in FIGS. 19 to 23.

Figure 19:
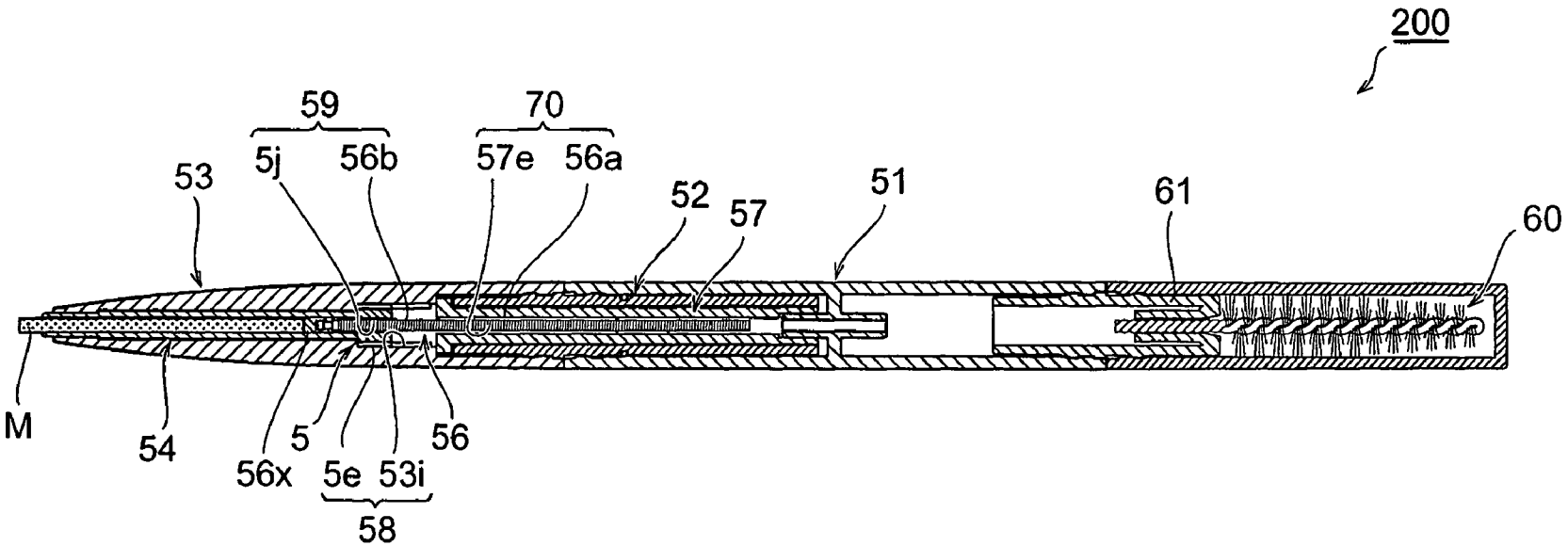
FIG. 19 is a vertical sectional view showing a rod-like body feeding container in accordance with a second embodiment of the present invention.

As shown in FIG. 19, a rod-like body feeding container 200 in accordance with the second embodiment is provided with a leading tube 53 forming a leading end side corresponding to one part (a left side in the drawing) of the container, and a main body tube 51 forming a rear side from the leading tube 53 as an outer structure. Further, as shown in FIG. 22, an inner side of the container is approximately provided with a coupling member 52 for coupling the leading tube 53 to the main body tube 51 so as to be relatively rotatable and immobile in an axial direction, a rotation preventing member 57 constituting a rotation preventing portion (a rotation preventing mechanism), a pipe member moving body 5 moving forward and backward in the case that the main body tube 51 and the leading tube 53 are relatively rotated, a pipe member 54 accommodating a rod-like body M therein and moving forward and backward in accordance with the forward and backward movement of the pipe member moving body 5, a rod-like body moving body 56 having a piston 56*x* fitted and inserted into the pipe member 54 so as to be brought into contact with a rear end surface of the rod-like body M in a leading end, moving forward and backward in accordance with the forward and backward movement of the pipe member moving body 5, moving forward when the pipe member 54 reaches a forward limit and the main body tube 51 and the leading tube 53 are relatively rotated further in the feeding direction and moving backward when the pipe member 54 reaches a backward limit and the main body tube 51 and the leading tube 53 are relatively rotated further in the feed-back direction, a first engagement portion 58 making the movement of the pipe member moving body 5 possible, and a second engagement portion 59 making the movement of the rod-like body moving body 56 possible. Further, as shown in FIG. 19, a brush holder 61 holding a brush 60 is installed to the other side (a right side in the drawing) of the main body tube 61.

Further, the rod-like body feeding container 200 in accordance with the second embodiment is mainly different from the rod-like body feeding container 100 in accordance with the first embodiment in a point that the leading end of the pipe member 54 protrudes from and retract into the inner side of the leading tube 53 in accordance with the relative rotation in the feeding direction and the feed-back direction between the main body tube 51 and the leading tube 53, and the rod-like body M is fed back in accordance with the relative rotation in the feed-back direction between the main body tube 51 and the leading tube 53. A description will be in detail given below of a structure thereof.

The main body tube 51 is structured in a cylindrical shape in which both ends are opened, as shown in FIG. 24. The main body tube 51 is sectioned by a middle partition 51*a* at an approximately middle position within the tube and, within both side tubes from the middle partition 51*a*, there are defined spaces respectively accommodating a rear portion of an assembly having the rod-like body M, and a rear portion of the brush holder 61 holding the brush 60.

The middle partition 51*a* sectioning both the spaces is provided with shaft bodies 51*b* toward an outer side in an axial direction in a center thereof, and a plurality of protrusions 51*c* extending in an axial direction are provided in an outer peripheral surface of the shaft body 51*b* so as to have a uniform interval along a peripheral direction. The protrusion 51*c* of the shaft body 51*b* toward the side of the assembly having the rod-like body M is provided for installing the rotation preventing member 57. Further, the main body tube 51 is provided with annular groove portions 51*d* for respectively installing the coupling member 52 and the brush holder 61 in inner peripheral surfaces close to both end openings.

As shown in FIG. 29, the coupling member 52 is formed in an approximately cylindrical shape, and is structured such that an approximately front half portion is inserted to the leading tube 53 and an approximately rear half portion is inserted to the main body tube 51. The coupling member 52 is provided with an annular concavo-convex portion 52*a* in an outer peripheral surface in a leading end side, and a knurling 52*b*, in which a lot of concavo-convex shapes are provided in parallel in a peripheral direction and the concavo-convex shapes extend in an axial direction, in an outer peripheral surface in a front side of the annular concavo-convex portion, as a structure to which the leading tube 53 is installed. Further, the coupling member 52 is provided with an annular protruding portion 52*c* in an outer peripheral surface near a rear side of the annular concavo-convex portion 52*a*, as a structure which is engaged with the annular groove portion 51*d* of the main body tube 51 in the axial direction. Further, the coupling member 52 is provided with an annular groove portion 52*d* for installing an O-ring 71, in an outer peripheral surface near a rear side of the annular protruding portion 52*c*.

As shown in FIG. 22, the coupling member 52 is installed to the main body tube 51 so as to be rotatable and immobile in the axial direction by installing the O-ring 71 to the annular groove portion 52*d*, inserting the approximately rear half portion thereof into the main body tube 51 and engaging the annular protruding portion 52*c* with the annular groove portion 51*d* of the main body tube 51.

The leading tube 53 is structured in a tapered cylindrical shape in which an outer diameter is narrowed gradually toward a leading end, as shown in FIGS. 25 and 26. A tube hole provided through in the axial direction in the leading tube 53 is structured as a first pipe member hole 53*f*, in which the leading end portion of the pipe member 54 moves forward and backward, from a leading end opening to a portion near the leading end, structured as a second pipe member hole 53*g*, which is formed so as to have a larger diameter than the first pipe member hole 53*f* and accommodates a rear side from the leading end portion of the pipe member 54 and in which it moves forward and backward, from a rear end of the first pipe member hole 53*f* to a position a little rear side from a center in the axial direction of the tube hole, structured as a pipe member moving body hole 53*k*, which is formed so as to have a larger diameter than the second pipe member hole 53*g* and accommodates the pipe member moving body 5 and in which the pipe member moving body 5 moves forward and backward, from a rear end of the second pipe member hole 53*g* to the middle to the rear end of the tube hole, and structured as a member accommodating hole 53*j*, which is formed so as to have a larger diameter than the pipe member moving body hole 53*k* and accommodates front side portions of the coupling member 52 and the rotation preventing member 57, from a rear end of the pipe member moving body hole 53*k* to a rear end of the tube hole.

The pipe member moving body hole 53*k* is provided with a spiral groove (a tube side thread) 53*i* serving as a female thread constituting one side of a first engagement portion 58, in an inner peripheral surface, and the member accommodating hole 53*j* is provided with a knurling 53*p*, in which a lot of concavo-convex shapes are provided in parallel in a peripheral direction and the concavo-convex shapes extend in the axial direction, as a structure which is engaged with the knurling 52*b* of the coupling member 52 in a rotational direction, in an inner peripheral surface of a front half portion, and is provided with an annular concavo-convex portion 53*q* as a structure which is engaged with the annular concavo-convex portion 52*a* of the coupling member 52 in an axial direction, in an inner peripheral surface of a rear half portion. Further, a step surface 53*n* between the first pipe member hole 53*f* and the second pipe member hole 53*g* of the leading tube 53 is structured such as to correspond to a forward limit of the pipe member 54. In this case, the structure may be made such that a leading end of the spiral groove 53*i* of the leading tube 53 is formed as the forward limit of the engagement projection 5*e* of the pipe member moving body 5 so as to correspond to the forward limit of the pipe member 54.

The leading tube 53 is structured, as shown in FIG. 22, such that a rear end portion thereof is fitted over a front half portion of the coupling member 52, a rear end surface is contacted to the leading end surface of the main body tube 51, and the annular concavo-convex portion 53*q* is engaged with the annular concavo-convex portion 52*a* of the coupling member 52, whereby the leading tube 53 is installed to the coupling member 52 so as to be immobile in the axial direction, and the knurling 53*p* is engaged with the knurling 52*b* of the coupling member 52, whereby the leading tube 53 is installed to the coupling member 52 so as to be non-rotatable. Accordingly, the leading tube 53 is installed to the main body tube 51 via the coupling member 52 so as to be relatively rotatable and immobile in the axial direction. Under this state, the O-ring 71 installed to the annular groove portion 52*d* of the coupling member 52 is brought into contact with the inner peripheral surface of the main body tube 51, whereby a rotational resistance having a good feeling is generated at a time when the main body tube 51 and the leading tube 53 are relatively rotated.

The rotation preventing member 57 is structured as a cylindrical shape having a collar portion 57*a* in a leading end portion, as shown in FIGS. 27 and 28, and the collar portion 57*a* is structured such as to have such a dimension as to move forward into the front side of the knurling 53*p* of the leading tube 53.

A tube hole of the rotation preventing member 57 is formed in a non-circular cross sectional shape having two flat surface portions 57*e* and 57*e* formed in an inner periphery in a facing manner from a leading end to a portion near a rear end portion, and these two flat surface portions 57*e* and 57*e* are set to a rotation prevention constituting one side of the rotation preventing portion 70.

Further, a portion in the rear side of the two flat surface portions 57*e* and 57*e* of the tube hole of the rotation preventing member 57 is formed as a circular cross sectional shaped hole having a larger diameter than the non-circular cross sectional shaped hole having the two flat surface portions 57*e* and 57*e*, and an inner peripheral surface of the circular cross sectional shaped hole is provided with a knurling 57*c* in which a lot of concavo-convex shapes are provided in parallel in a peripheral direction and the concavo-convex shapes extend in the axial direction, as a structure which is engaged with the protrusion 51*c* of the main body tube 51 in the rotational direction.

The rotation preventing member 57 is structured, as shown in FIG. 22, such that the knurling 57*c* in the rear end portion is engaged with the protrusion 51*c* of the main body tube 51 in a state in which the collar portion 57*a* is inserted into the member accommodating hole 53*j* of the leading tube 53, the portion in the rear side of the collar portion 57*a* is inserted into the coupling member 52, and the collar portion 57*a* is pinched between a step surface 53*r* (refer to FIGS. 25 and 26) between the pipe member moving body hole 53*k* and the member accommodating hole 53*j*, and the leading end surface of the coupling member 52, whereby the rotation preventing member 57 is installed to the main body tube 51 so as to be immobile in the axial direction and non-rotatable.

The pipe member moving body 5 is the same as the pipe member moving body 5 in accordance with the first embodiment, is provided with a pair of engagement projections (pipe member side threads) 5*e* serving as a male thread constituting the other side of the first engagement surface 58 in an outer peripheral surface, and is provided with a female thread 5*j* constituting one side of the second engagement portion 59 in an inner peripheral surface.

The pipe member moving body 5 is inserted into the pipe member moving body hole 53*k* of the leading tube 53, and is set to a state in which a rear end surface is brought into contact with a leading end surface of the collar portion 57*a* of the rotation preventing member 57, and the engagement projection 5*e* is engaged with the spiral groove 53*i* of the leading tube 53.

The rod-like body moving body 56 is structured as a structure having a piston 56*x* in a leading end, and a thread rod 56*y* long in an axial direction at a rear end of the piston 56*x*. The thread rod 56*y* is provided with a large-diameter portion 56*c* for installing the piston 56*x* to the leading end thereof, as shown in FIG. 30. Further, the thread rod 56*y* is structured such that a rear side from the large-diameter portion 56*c* is formed as a short small-diameter portion 56*d*, and a portion from a rear end of the small-diameter portion 56*d* to a rear end of the thread rod 56*y* is formed as a shaft body 56*e* having a larger diameter than the small-diameter portion 56*d*. The thread rod 56*y* is provided with two flat surface portions 56*a* and 56*a* (similar to the two flat surface portions 6*a* and 6*a* described in the first embodiment, refer to FIG. 14) formed so as to oppose on the outer periphery from the rear end of the shaft body 56*e* to the portion near the leading end portion of the shaft body 56*e*, and a male thread 56*b* formed in an outer periphery from the rear end of the shaft body 56*e* to the leading end of the shaft body 56*e*. Accordingly, the male thread 56*b* in the portion having the two flat surface portions 56*a* and 56*a* of the thread rod 56*y* is formed in a circular arc shape. Further, the male thread 56*b* of the rod-like body moving body 56 constitutes the other side of the second engagement portion 59, and the two flat surface portions 56*a* and 56*a* are set to a rotation prevention constituting the other side of the rotation preventing portion 70.

As shown in FIG. 31, the piston 56*x* is structured in a cylindrical shape, for example, by a resin, a rubber or the like, and is provided with a concave portion 56*m* depressed from the rear end surface thereof. A front side of the concave portion 56*m* is formed as a large-diameter concave portion 56*n* for engaging with the large-diameter portion 56*c* of the thread rod 56*y* in an axial direction.

As shown in FIG. 22, the piston 56*x* is fitted over the leading end portion of the thread rod 56*y*, and a large-diameter concave portion 56*n* thereof is engaged with the large-diameter portion 56*c* of the thread rod 56*y*, whereby the piston 56*x* is installed to the thread rod 56*y* so as to be immobile in the axial direction.

The rod-like body moving body 56, to which the piston 56*x* is installed, is inserted into the pipe member moving body 5 and the rotation preventing member 57, and the two flat surface portions 56*a* and 56*a* are inserted between the two flat surface portions 57*e* and 57*e* of the rotation preventing member 57, and the male thread 56*b* is engaged with the female thread 5*j* of the pipe member moving body 5.

Further, in the first engagement portion 58 constituted by the engagement projection 5*e* of the pipe member moving body 5 and the spiral groove 53*i* of the leading tube 53, and the second engagement portion 59 constituted by the female thread 5*j* of the pipe member moving body 5 and the male thread 56*b* of the rod-like body moving body 56, as shown in FIG. 18 (refer to the pipe member moving body 5 in accordance with the first embodiment) and FIG. 26, a lead of the first engagement portion 58 is made larger in comparison with a lead of the second engagement portion 59. Accordingly, the engagement operation of the first engagement portion 58 is applied prior to the engagement operation of the second engagement portion 59.

Figure 20:
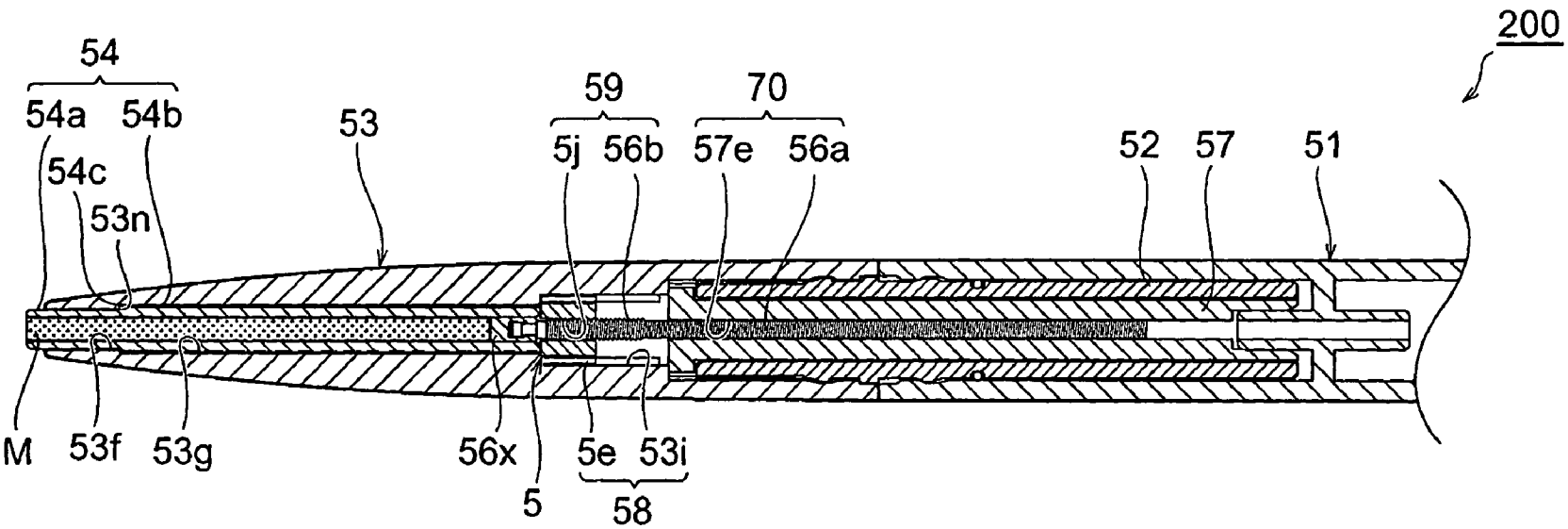
FIG. 20 is a vertical sectional view showing the rod-like body feeding container in accordance with the second embodiment of the present invention, and shows a state in which a pipe member moves forward to the maximum on the basis of an operation of a user.

As shown in FIG. 20, the pipe member 54 is structured as a stepped cylindrical shape in which a leading end portion is formed as an outer diameter small-diameter portion 54*a* and a portion from a rear end of the outer diameter small-diameter portion 54*a* to a rear end of the pipe member 54 is formed as an outer diameter large-diameter portion 54*b* having a larger diameter than the outer diameter small-diameter portion 54*a*, and is formed in a corresponding shape to the first pipe member hole 53*f* and the second pipe member hole 53*g* of the leading tube 53. A length from the leading end of the outer diameter small-diameter portion 54*a* of the pipe member 54 to the step surface 54*c* between the outer diameter small-diameter portion 54*a* and the outer diameter large-diameter portion 54*b* is set longer than the length of the first pipe member hole 53*f* of the leading tube 53. The rod-like body M is filled in the pipe member 54 by injecting the rod-like body forming material in the molten state so as to cool and solidify. The rod-like body M is accommodated in the pipe member 54 so as to be slidable in a close contact state.

As shown in FIG. 22, the pipe member 54 is inserted into the first and second pipe member holes 53*f* and 53*g* of the leading tube 53, a rear end portion thereof is fitted and inserted to the piston 56*x* and a rear end surface thereof is contacted to the leading end surface of the pipe member moving body 5.

In this state, the piston 56*x* is tightly brought into contact with the inner peripheral surface of the pipe member 54, and is set to a state in which the piston 56*x* and the rod-like body M are in contact in an airtight manner within the pipe member 54. Further, in this state, a predetermined space, in which the pipe member 54 moves forward, is formed between the step surface 54*c* of the pipe member 54 and the step surface 53*n* corresponding to the forward limit of the pipe member 54 in the leading tube 53, and the rod-like body M is retracted in the leading tube 53 so as to be accommodated.

Further, the rod-like body feeding container is bought as the rod-like body feeding container 200 in an original state shown in FIG. 22 by a user, and is structured in such a manner as to incorporate a first feeding mechanism constituted by the first engagement portion 58 structured by the engagement projection 5*e* of the pipe member moving body 5 and the spiral groove 53*i* of the leading tube 53, and the rotation preventing portion 70 structured by the two flat surface portions 57*e* of the rotation preventing member 57 and the two flat surface portions 56*a* of the rod-like body moving body 56, and a second feeding mechanism constituted by the second engagement portion 59 structured by the female thread 5*j* of the pipe member moving body 5 and the male thread 56*b* of the rod-like body moving body 56, and the rotation preventing portion 70. In this case, in FIG. 22, the leading end of the rod-like body M appears from the inner side of the pipe member 54, however, in the initial state, the rod-like body is accommodated in the pipe member 54 and the leading end of the rod-like body M and the leading end of the pipe member 54 are made approximately flush.

Further, when the main body tube 51 and the leading tube 53 are relatively rotated in a feeding direction by the user, the engagement operation of the first engagement portion 58 is immediately applied because the engagement projection 5*e* of the pipe member moving body 5 is engaged with the spiral groove 53*i* of the leading tube 53. The same operations as the first embodiment are executed thereafter, the pipe member 54 including the rod-like body moving body 56 quickly moves forward in accordance with the large lead of the first engagement portion 58 on the basis of the further relative rotation in the feeding direction, the step surface 54*c* reaches the step surface 53*n* of the leading tube 53 as shown in FIG. 20, and the engagement operation of the first engagement portion 58 is stopped.

At this time, the leading end of the pipe member 54 appears from the inner side of the leading tube 53 at a predetermined length.

Figure 21:
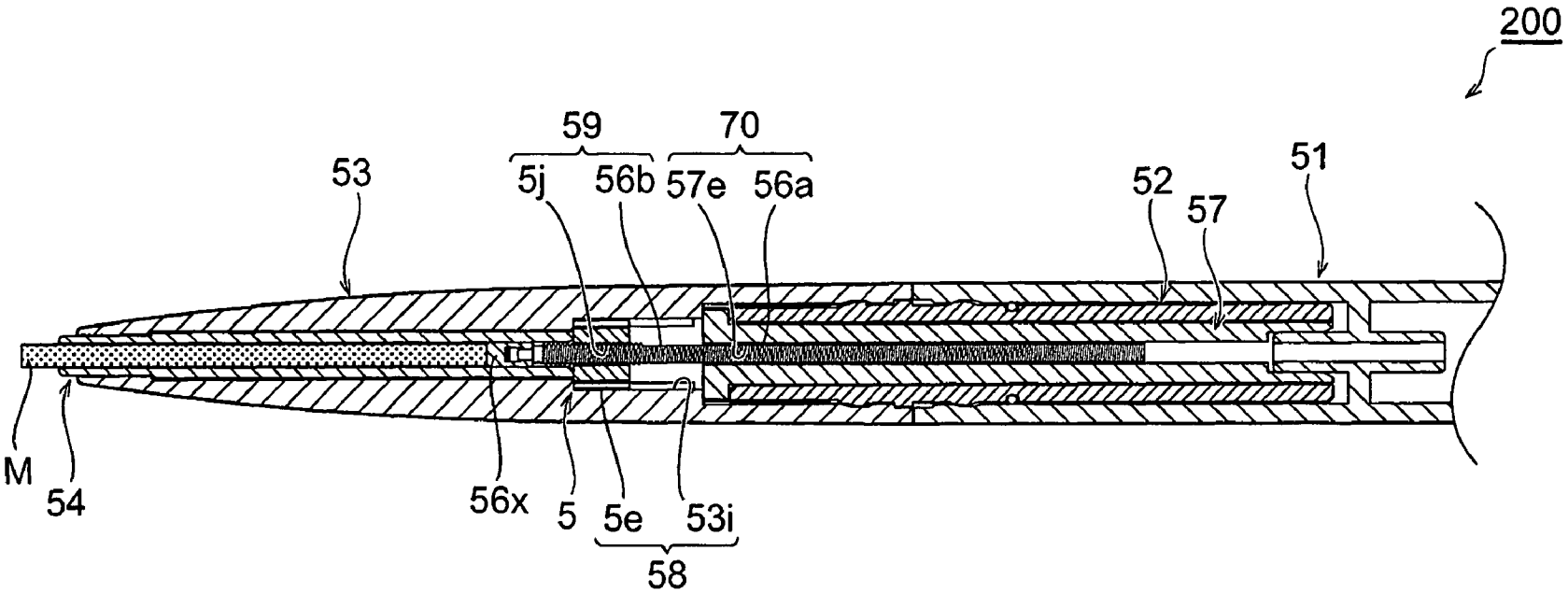
FIG. 21 is a vertical sectional view showing the rod-like body feeding container in accordance with the second embodiment of the present invention, and shows a state in which the pipe member moves forward to the maximum on the basis of an operation of the user and a rod-like body moving body subsequently moves forward to a use state.

When the main body tube 51 and the leading tube 53 are relatively rotated in the feeding direction successively, the engagement operation of the second engagement portion 59 is applied, the rod-like body moving body 56 is slowly fed out in accordance with the small lead of the second engagement portion 59, and the rod-like body M is suitably extruded from the pipe member 54 and set to be in use state, as shown in FIG. 21.

When the main body tube 51 and the leading tube 53 are relatively rotated in the feed-back direction after being used, the engagement operation of the first engagement portion 58 is first applied, the pipe member 54 including the rod-like body moving body 56 is quickly moved backward in accordance with the large lead of the first engagement portion 58. As shown in FIG. 22, when the pipe member 54 and the leading end of the rod-like body M are retracted from the opening of the leading end of the leading tube 53, the pipe member 54 is fed back to the accommodated position within the leading tube 53, and the rear end surface of the pipe member moving body 5 reaches the rearward limit where the rear end of the pipe member moving body 5 is contacted to the leading end surface of the rotation preventing member 57, the engagement projection 5*e* of the pipe member moving body 5 is inhibited from moving backward further, and the engagement operation of the first engagement portion 58 is stopped. Accordingly, when the main body tube 51 and the leading tube 53 are relatively rotated in the feeding direction again by the user, and the pipe member 54 reaches the forward limit, the leading end portion of the rod-like body M protruding from the pipe member 54 appears from the inner side of the leading tube 53 and is immediately set to the use state, as shown in FIG. 21, because the rod-like body M protrudes from the pipe member 54 as mentioned above.

On the other hand, when the pipe member 54 reaches the backward limit, and the main body tube 51 and the leading tube 53 are relatively rotated in the feed-back direction successively, the engagement operation of the second engagement portion 59 is applied because the engagement operation of the first engagement portion 58 is stopped. Therefore, the pipe member 54 including the rod-like body moving body 56 is moved backward in cooperation with the rotation preventing portion 70. At this time, since the piston 56*x* and the rod-like body M are set to the state in which they are in contact in an airtight manner within the pipe member 54, the rod-like body M is moved backward together with the piston 56*x*, and the leading end portion of the rod-like body M is accommodated within the pipe member 54.

Further, as shown in FIG. 23, it is possible to use the rod-like body M to the end by feeding the rod-like body moving body 56 to the maximum.

As mentioned above, in accordance with the rod-like body feeding container 200 of the present embodiment, in addition to the effects of the first embodiment, the following effect can be obtained. Since the leading end of the pipe member 54 protrudes from and retracts from the inner side of the leading tube 53 on the basis of the forward movement and the backward movement of the pipe member 54 including the rod-like body moving body 56 caused by the relative rotation in the feeding direction and the feed-back direction between the main body tube 51 and the leading tube 53, the leading end of the pipe member 54, which may appear from the opening of the leading end of the leading tube 54 at a time of being used so as to be brought into contact with the skin, is retracted into the leading tube 53 so as to be accommodated therein after being used, in the case that the rod-like body M is constituted, for example, by a rod-like cosmetic material. Accordingly, a sanitation is improved.

Further, in accordance with the rod-like body feeding container 200 of the present embodiment, the second feeding mechanism is structured such as to move backward the rod-like body M with respect to the pipe member 54 by utilizing the second engagement portion 59 in accordance with the relative rotation in the feed-back direction between the main body tube 51 and the leading tube 53. Specifically, the first engagement portion 58 is structured such that, when the main body tube 51 and the leading tube 53 are relatively rotated in the feed-back direction, the pipe member 54 including the rod-like body moving body 56 is moved backward on the basis of the engagement operation of the first operated first engagement portion 58 and the pipe member 54 reaches the backward limit where the pipe member 54 is accommodated in the leading tube 54, the engagement operation is stopped, the second engagement portion 59 is structured such that, when the main body tube 51 and the leading tube 53 are relatively rotated further in the feed-back direction in the state in which the pipe member 54 reaches the backward limit and the engagement operation of the first engagement portion 58 is stopped, the engagement operation is applied so as to move backward the rod-like body moving body 56, and the piston 56*x* and the rod-like body M are brought into contact in the airtight manner within the pipe member 54. Accordingly, the rod-like body M which is brought into contact with the piston 56*x* in the airtight manner is moved backward together with the rod-like body moving body 56, and the leading end portion of the rod-like body M protruding from the pipe member 54 is accommodated in the pipe member 54, and the leading end portion of the rod-like body M is protected by the pipe member 54.

In this case, the structure may be made such that a rubber O-ring is wound around a leading end side outer periphery of the rod-like body moving body 56 or an outer periphery of the piston 56*x* so as to achieve a further airtightness. Further, the pipe member 54 and the pipe member moving body 5 may be integrated in accordance with an engagement, or may be constituted by an integral molded product.

Further, in the first embodiment, the rod-like body moving body may be structured such that the piston in the leading end portion is installed to the thread rod as in the second embodiment, or the piston and the thread rod may be integrated as in the first embodiment, in the second embodiment.

Further, the structure may be made such that the coupling member 52 and the main body tube 51 are detachably fitted so that replacement with a refill can be done after consuming the rod-like body M. Also, it is possible to attach a rod-like body having different color tone or thickness to an opposite side end portion, and it is possible to freely assemble with an applicator such as a brush or the like.

Meanwhile, the second embodiment is preferably structured such that the rod-like body M is filled in the pipe member 54 by injecting the rod-like body forming material in the molten state into the pipe member 54 so as to cool and solidify, however, it is possible to fit and insert the previously manufactured rod-like body to the pipe member so as to use. It is preferable that the pipe member in this case employs a structure in FIGS. 32 to 35.

Figure 32:
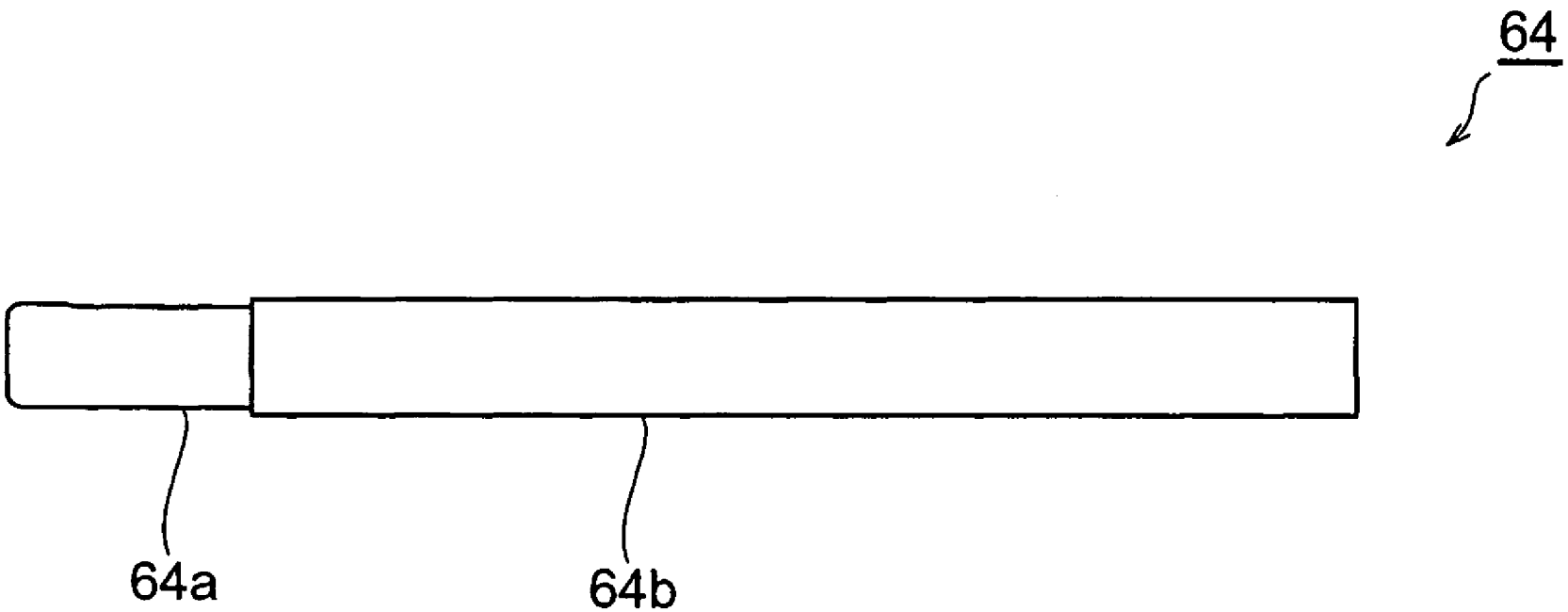
FIG. 32 is a side view showing a pipe member used in place of the pipe member in FIGS. 19 to 23.
Figure 33:
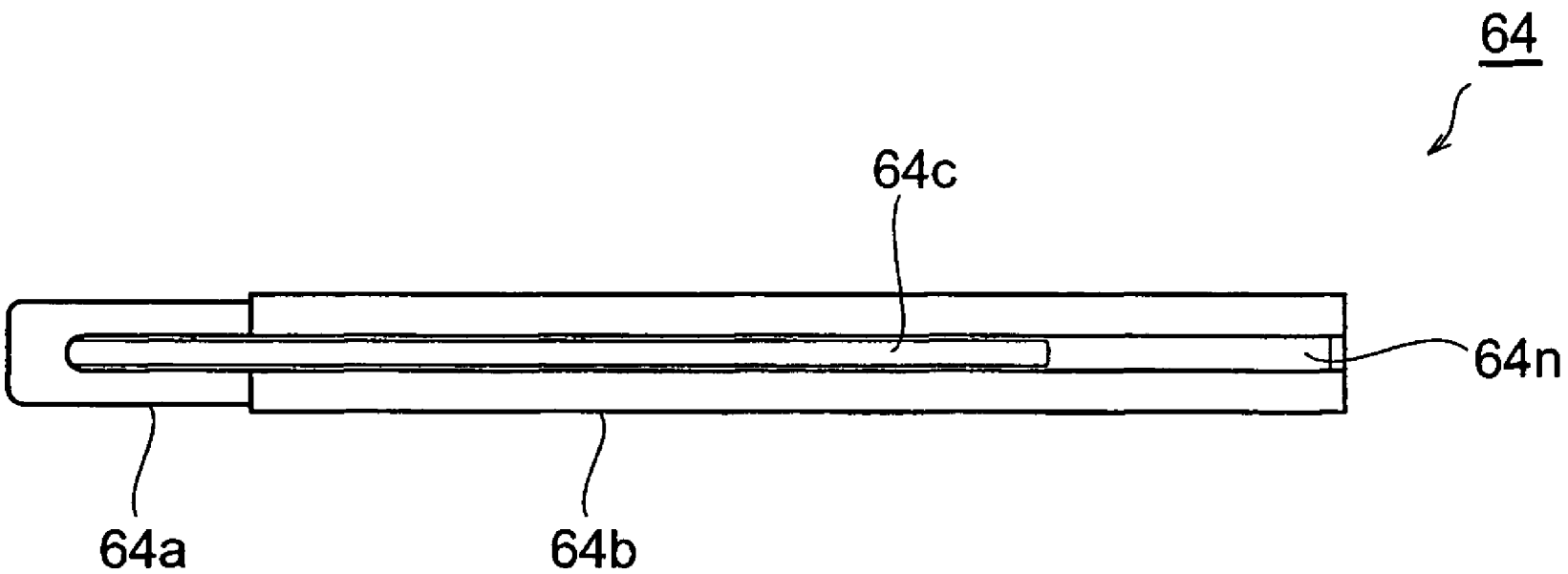
FIG. 33 is a top view of the pipe member shown in FIG. 32.
Figure 34:
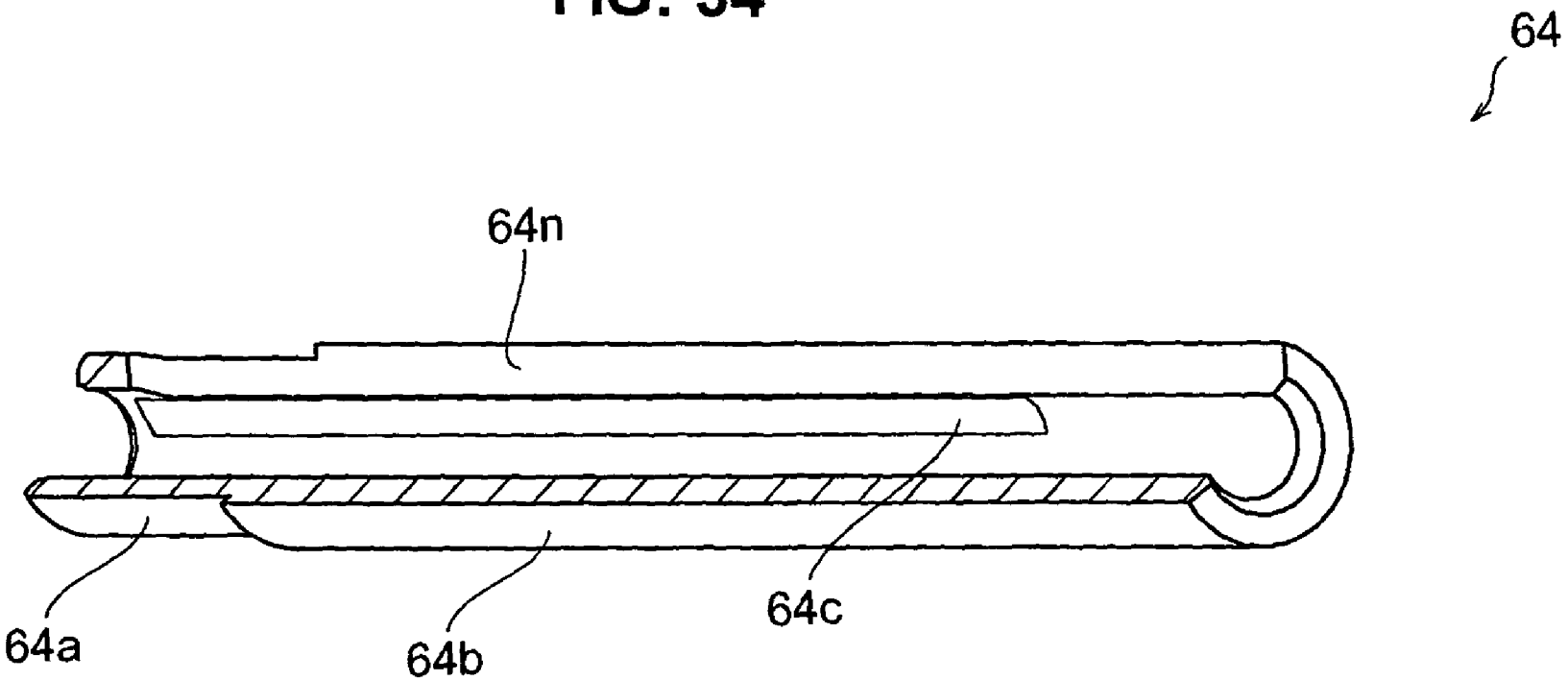
FIG. 34 is a sectional perspective view of the pipe member shown in FIG. 33.

FIG. 32 is a side view showing a pipe member used in place of the pipe member in FIGS. 19 to 23, FIG. 33 is a top view of the pipe member shown in FIG. 32, FIG. 34 is a sectional perspective view of the pipe member shown in FIG. 32, and FIG. 35 is a right side view of the pipe member shown in FIG. 33.

As shown in FIGS. 32 to 35, a pipe member 64 is different from the pipe member 54 in a point that a slit 64*n* is provided in such a manner as to extend from a rear end of an outer diameter large-diameter portion 64*b* to a portion close to a leading end of an outer diameter small-diameter portion 64*a* in a leading end side thereof and communicate between inner and outer sides, and a protruding portion 64*c* extending in an axial direction is provided at three uniform positions in an inner peripheral surface except the leading end portion and the rear end portion along a peripheral direction. The protruding portion 64*c* has a flat protruding surface, and is provided for supporting a rod-like body M1 previously manufactured and inserted by being brought into close contact with the rod-like body M1. The pipe member 64 is structured such that, when the rod-like body M1 is inserted, an inner diameter is expanded by the slit 64*n*, the rod-like body M1 can be inserted, and the rod-like body M1 is fastened by elastic force thereof. The other structures are the same as the pipe member 54.

Accordingly, when the rod-like body M1 is inserted into the pipe member 64, the rod-like body M1 is fitted and inserted to the protruding portion 64*c* so as to be brought into close contact with the protruding portion 64*c*, and is slidably accommodated in a close contact state within the pipe member 64. Therefore, the operation and the effect thereof are approximately the same as those of the case of the pipe member 54. Even in this case, since the rod-like body M1 is accommodated in the pipe member 64 so as to be protected, and is used by being fed at a necessary amount, the rod-like body M can be a thin rod-like cosmetic material. In this pipe member 64, since the protruding portion 64*c* is provided, and the piston 56*x* and the rod-like body M1 are hardly brought into close contact with each other within the pipe member 64, it is difficult to move backward the rod-like body M1 in accordance with the backward movement of the rod-like body moving body 56 after the pipe member 64 reaches the backward limit.

In the first embodiment, the structure may be made such that the pipe member protrudes from and retracts into the leading tube as in the second embodiment, and in the second embodiment, the structure may be made such that the pipe member does not appear from the leading tube as in the first embodiment.

Further, in the first and second embodiments mentioned above, the structure is made such that the engagement operation of the first engagement portions 8 and 58 is applied prior to the engagement operation of the second engagement portions 9 and 59 by making the lead of the first engagement portions 8 and 58 larger in comparison with the lead of the second engagement portions 9 and 59. However, as another structure in which the engagement operation of the first engagement portions 8 and 58 is applied prior to the engagement operation of the second engagement portions 9 and 59, there can be shown, for example, the structure in which the actuation resistance of the second engagement portions 9 and 59 is increased by differentiating the materials, differentiating the contact resistance of the threads or the like. Further, as more another structure for increasing the actuation resistance of the second engagement portions 9 and 59, there can be shown, for example, a structure caused by a sliding resistance in an axial direction of the pistons 6*x* and 56*x*.

Further, it is possible to make the lead of the first engagement portions 8 and 58 equal to the lead of the second engagement portions 9 and 59, so as to make the moving speed of the pipe members 4 and 54 equal to the moving speed of the rod-like body moving bodies 6 and 56. In this case, as mentioned above, it is necessary to employ the structure in which the engagement operation of the first engagement portions 8 and 58 is applied prior to the engagement operation of the second engagement portions 9 and 59 such as the structure in which the actuation resistance of the second engagement portions 9 and 59 is increased in comparison with the actuation resistance of the first engagement portions 8 and 58. In this connection, if the lead of the first engagement portions 8 and 58 is made smaller in comparison with the lead of the second engagement portions 9 and 59, it is possible to move the rod-like body moving bodies 6 and 56 faster than the pipe member 4.

FIG. 36 is a vertical sectional view showing a rod-like body feeding container in accordance with a third embodiment of the present invention, FIG. 37 is a vertical sectional view showing the rod-like body feeding container at a time when a pipe member moves forward to the maximum on the basis of an operation of a user and a rod-like body moving body successively moves forward so as to be in a use state, FIG. 38 is an enlarged view of a leading end portion of a rod-like body and a portion near the leading end portion, and FIG. 36 shows an original state of the rod-like body feeding container.

As shown in FIG. 36, in the rod-like body feeding container 300 in accordance with the third embodiment, a main body tube 81 is provided with a shaft body 81*b* formed in a bottom portion thereof, having a plurality of protrusions 81*c* constituting one side of a rotation preventing portion 80 in an outer peripheral surface and formed in a non-circular cross sectional shape, and is structured such that a cylindrical leading tube pressing member 82 is installed within the tube so as to be immobile in an axial direction.

The leading tube 83 is installed to the main body tube 81 via the leading tube pressing member 82 so as to be relatively rotatable in such a manner that a front side surface of a collar portion 83*a* in a rear end thereof is pressed against a rear end surface of the leading tube pressing member 82 so as to be energized to a rear side by a spring portion 82*d* of the leading tube pressing member 82, and the collar portion 83*a* is pinched between the leading tube pressing member 82 and protrusions 81*f* of the main body tube 81. Accordingly, a better rotational resistance is generated in the leading tube 83 and the main body tube 81.

The rod-like body moving body 86 is formed in a cylindrical shape, is provided with a male thread 86*b* constituting one side of a second engagement portion 89 in an outer peripheral surface thereof, is provided with a piston 86*x* in a leading end portion, is fitted around the shaft body 81*b* of the main body tube 81, and is installed to the main body tube 81 so as to be non-rotatable and movable in the axial direction by a plurality of protrusions 86*d* in an inner peripheral surface constituting the other side of the rotation preventing portion 80 being engaged with the protrusions 81*c* of the shaft body 81*b* of the main body tube 81 in a rotational direction.

A pipe member moving body 85 is formed in a stepped cylindrical shape, is provided with a sprig portion 85*d* being freely expanding and contracting in an axial direction in a rear portion, is inserted into the leading tube 83 and is fitted around the rod-like body moving body 86. Further, a female thread 85*j* in an inner peripheral surface constituting the other side of the second engagement portion 89 is engaged with the male thread 86*b* in the outer peripheral surface of the rod-like body moving body 86 constituting one side of the second engagement portion 89, a rear end surface of the spring portion 85*d* is brought into contact with a bottom portion of the main body tube 81 in this state, and an engagement projection 85*e* in an outer peripheral surface constituting one side of the first engagement portion 88 is set to a state of being pressed against a step surface 83*m* of the leading tube 83 by the spring portion 85*d* in a state in which the engagement projection 85*e* is detached from a rear end of a spiral groove 83*i* in an inner peripheral surface of the leading tube 83 constituting the other side of the first engagement portion 88 and the engagement is canceled. In this case, a first feeding mechanism is structured by the first engagement portion 88 and the rotation preventing portion 80, and a second feeding mechanism is structured by the second engagement portion 89 and the rotation preventing portion 80.

In this state, an O-ring 91 is fitted to an outer peripheral surface corresponding to the second engagement portion 89 of the pipe member moving body 85, and a portion corresponding to the second engagement portion 89 of the pipe member moving body 85 splited by slits is fastened by an elastic force of the O-ring 91, and actuation resistance of the second engagement portion 89 is increased to be set higher in comparison with actuation resistance of the first engagement portion 88 which is constituted by the engagement projection 85*e* of the pipe member moving body 85 and the spiral groove 83*i* of the leading tube 83 (the engagement is canceled so as to be in an engagement standby state in FIG. 36). Accordingly, the engagement operation of the first engagement portion 88 is applied prior to the engagement operation of the second engagement portion 89.

Further, in the first engagement portion 88 (refer to FIG. 2), and the second engagement portion 89, a lead of the first engagement portion 88 is set larger in comparison with a lead of the second engagement portion 89.

The pipe member 84 is structured in a large-diameter cylindrical shape, and is structured such as to slidably accommodate a rod-like body M2 in an inner portion in a close contact state. The rod-like body M2 may be filled in the pipe member 84 by injecting a molten state rod-like body forming material into the pipe member 84 so as to cool and solidify, or may be formed by fitting and inserting a previously manufactured rod-like body to the pipe member 84 in a close contact state. In the case of filling in the pipe member 84 by injecting the molten state rod-like body forming material into the pipe member so as to cool and solidify, it is possible to employ a method of assembling the rod-like body feeding container 300, thereafter filling the heated molten rod-like body from the leading end of the pipe member 84 and finishing (adjusting) the leading end after cooling, and a method of sealing the leading end of the pipe member 84 before assembling, filling the heated molten rod-like body from the rear end, cooling and thereafter installing to the container.

Further, the pipe member 84 is inserted into the leading tube 83 and is fitted to the piston 86*x*, and the engagement portion 84*a* in the rear portion thereof is engaged with the engagement portion 85*a* of the pipe member moving body 85, whereby the pipe member 84 is installed to the pipe member moving body 85 so as to be non-rotatable and immovable in the axial direction, thereby being integrated with the pipe member moving body 85, and is accommodated within the leading tube 83 in this state. Further, in this state, the piston 86*x* is set to a state of being tightly brought into contact with an inner peripheral surface of the pipe member 84. In this case, the leading tube 83 is covered and protected by a cap 95.

In accordance with the rod-like body feeding container 300 having the structure mentioned above, when the main body tube 81 and the leading tube 83 are relatively rotated in the feeding direction by a user in the original state shown in FIG. 36, the leading tube 83 and the pipe member moving body 85 are first relatively rotated because the actuation resistance of the second engagement portion 89 is larger in comparison with the actuation resistance of the first engagement portion 88. Accordingly, the engagement projection 85*e* of the pipe member moving body 85, which is detached from the rear end of the spiral groove 83*i* of the leading tube 83 so as to be canceled the engagement and is pressed against the stepped surface 83*m* of the leading tube 83 by the spring portion 85*d*, is engaged with the spiral groove 83*i* of the leading tube 83, and the engagement operation of the first engagement portion 88 is actuated.

Thereafter, the same motions as the first embodiment are executed. The pipe member 84 including the rod-like body moving body 86 is quickly moved forward in accordance with the large lead of the first engagement portion 88 on the basis of the further relative rotation in the feeding direction. As shown in FIG. 37, when the engagement projection 85*e* of the pipe member moving body 85 reaches the leading end 83*f* of the spiral groove 83*i* of the leading tube 83 corresponding to the forward limit of the pipe member 84, the engagement operation of the first engagement portion 88 is stopped. In this case, the leading end of the pipe member 84 appears at a predetermined length from the inner side of the leading tube 83, however, may be accommodated within the leading tube 83 as in the first embodiment.

When the main body tube 81 and the leading tube 83 are relatively rotated in the feeding direction successively, the rod-like body moving body 86 is slowly fed out in accordance with the small lead of the second engagement portion 89, and the rod-like body M2 is suitably extruded from the pipe member 84 so as to be set to the use state (refer to FIG. 38).

When the main body tube 81 and the leading tube 83 are relatively rotated in the feed-back direction after being used, the engagement operation of the first engagement portion 88 is first applied, the pipe member 84 including the rod-like body moving body 86 is quickly moved backward in accordance with the large lead of the first engagement portion 58, the leading end portions of the pipe member 84 and the rod-like body M2 are retracted from the opening of the leading end of the leading tube 83, the pipe member 84 is fed back to an accommodated position within the leading tube 83, and the engagement projection 85*e* of the pipe member moving body 85 is detached from the rear end of the spiral groove 83*i* of the leading tube 83 so as to be canceled the engagement and is set to the state of being pressed against the step surface 83*m* of the leading tube 83 by the spring portion 85*d*, as shown in FIG. 36.

Accordingly, even if the main body tube 81 and the leading tube 83 are relatively rotated further in the feed-back direction in this state, the main body tube 81 and the leading tube 83 slip, the engagement operation of the second engagement portion 89 is not applied, the rod-like body moving body 86 does not move backward, and the rod-like body M2 is in a state of protruding from the pipe member 84.

Further, when the main body tube 81 and the leading tube 83 are relatively rotated again in the feeding direction by the user so as to change the rod-like body M2 from the state shown in FIG. 36 to the use state, the same operations as mentioned above are executed thereafter.

Even in the rod-like body feeding container 300 in accordance with the third embodiment as mentioned above, it goes without saying that the same effect as the embodiment mentioned above can be obtained.

In this case, as the other structure for returning the engagement of the first engagement portion 88, there can be shown a structure in which the spring portion 85*d* of the pipe member moving body 85 is omitted, and a spring for energizing the pipe member moving body 85 to a front side is provided in a bottom portion of the main body tube 81. Further, it is possible to employ a structure in which the spring portion 85*d* of the pipe member moving body 85 is replaced by a cylinder portion having no spring characteristic, and the engagement projection 85*e* of the pipe member moving body 85 is accommodated in the spiral groove 83*i* of the leading tube 83 at a time when the rod-like body feeding container 300 is in the original state shown in FIG. 36, the rear end surface of the cylinder portion of the pipe member moving body 85 is brought into contact with the bottom portion of the main body tube 81 and the pipe member 84 reaches the backward limit. In accordance with this structure, when the main body tube 81 and the leading tube 83 are relatively rotated further in the feed-back direction in a state in which the rear end surface of the cylinder portion of the pipe member moving body 85 is brought into contact with the bottom portion of the main body tube 81 and the pipe member 84 reaches the backward limit, the leading tube 83 moves to the front side against the energizing force of the spring portion 82*d* of the leading tube pressing member 82, whereby the engagement projection 85*e* of the pipe member moving body 85 is detached from the rear end of the spiral groove 83*i* of the leading tube 83 and the engagement is canceled. In this state, the collar portion 83*a* of the leading tube 83 is energized backward by the spring portion 82*d* of the leading tube pressing member 82, and the engagement projection 85*e* of the pipe member moving body 85 is pressed to the step surface 83*m* of the leading tube 83 in the same manner as the case by the spring portion 85*d* of the pipe member moving body 85 mentioned above. Accordingly, when the main body tube 81 and the leading tube 83 are relatively rotated in the feeding direction, the engagement of the first engagement portion 88 can be returned.

Further, as mentioned above, the spring portion 82*d* of the leading tube pressing member 82 is structured such as to be replaced by the cylinder portion having no spring characteristic, in addition to the structure in which the spring portion 85*d* of the pipe member moving body 85 is replaced by the cylinder portion having no spring characteristic, and the engagement projection 85*e* of the pipe member moving body 85 is accommodated within the spiral groove 83*i* of the leading tube 83 at a time when the rod-like body feeding container 300 is in the original state shown in FIG. 36, the rear end surface of the cylinder portion of the pipe member moving body 85 is brought into contact with the bottom portion of the main body tube 81 and the pipe member 84 reaches the backward limit, the pipe member 84 immediately moves forward when the main body tube 81 and the leading tube 83 are relatively rotated in the feeding direction, because the first engagement portion 88 has been already structured. On the other hand, when the main body tube 81 and the leading tube 83 are relatively rotated in the feed-back direction from the state of the pipe member 84 being fed to the forward limit and the rod-like body M2 being fed so as to be in the use state, the pipe member 84 including the rod-like body moving body 86 is fed back to the accommodated position within the leading tube 83, and reaches the backward limit where the rear end surface of the cylinder portion of the pipe member moving body 85 is contacted to the bottom portion of the main body tube 81, the engagement operation of the first engagement portion 88 is stopped. When the main body but 81 and the leading tube 83 are relatively rotated in the feed-back direction successively, the engagement operation of the second engagement portion 89 is applied and the rod-like body moving body 86 is moved backward in cooperation with the rotation preventing portion 80 because the engagement operation of the first engagement portion 88 is stopped.

At this time, when the piston 86*x* and the rod-like body M2 are in a state of being in contact in an airtight manner within the pipe member 84, the rod-like body M2 is moved backward together with the rod-like body moving body 86. Accordingly, the leading end portion of the rod-like body M2 can be accommodated within the pipe member 84 so as to be protected. In this connection, it is preferable to arrange an O-ring between a front side surface of the collar portion 83*a* in the rear end of the leading tube 83 and a rear side surface of the leading tube pressing member 82 so as to generate a better rotational resistance at a time when the leading tube 83 and the main body tube 81 are relatively rotated.

FIG. 39 is a vertical sectional view showing a rod-like body feeding container in accordance with a fourth embodiment of the present invention, and FIG. 40 is a vertical sectional view showing the rod-like body feeding container at a time when a pipe member moves forward to the maximum on the basis of the operation of a user and a rod-like body moving body successively moves forward so as to be in the use state. FIG. 39 shows an original state of the rod-like body feeding container.

A rod-like body feeding container 400 in accordance with the fourth embodiment is mainly different from the rod-like body feeding container 300 shown in FIGS. 36 to 38 in a point that a rod-like body M3 is filled also around a piston 96*x*. Specifically, the piston 96*x* is structured as a stepped cylindrical shape in which an outer diameter in a front half portion is smaller in comparison with an outer diameter of a rear half portion and a leading end is closed, and the rod-like body M3 is filled around an entire of an outer diameter small-diameter portion 96*a* in the front half portion and a portion Z around a leading end portion of an outer diameter large-diameter portion 96*b* in the rear half portion. The rod-like body M3 is filled in the pipe member 84 by injecting a molten state rod-like body forming material into the pipe member 84 so as to cool and solidify. Accordingly, the piston 96*x* and the rod-like body M3 are in a contact state in an airtight manner within the pipe member 84.

Further, the rod-like body feeding container 400 in accordance with the fourth embodiment is different from the rod-like body feeding container 300 shown in FIGS. 36 to 38 in a point that the spring portion 85*d* of the pipe member moving body 85 is replaced by a cylinder portion 85*m* having no spring characteristic, the cylinder portion 85*m* is made shorter in an axial direction, and the engagement projection 85*e* of the pipe member moving body 85 is accommodated in the spiral groove 83*i* of the leading tube 83 at a time when the rod-like body feeding container 400 is in the original state shown in FIG. 39 and an annular step surface 85*k* provided in an inner periphery in a rear portion side of the pipe member moving body 85 is brought into contact with a leading end surface of a cylinder portion 81*d* extending from the bottom portion of the main body tube 81 and the pipe member 84 reaches the backward limit, in such a manner as to feed back the rod-like body M3 in accordance with the relative rotation in the feed-back direction between the main body tube 81 and the leading tube 83.

In accordance with the rod-like body feeding container 400 having the structure mentioned above, when the main body tube 81 and the leading tube 83 are relatively rotated in the feeding direction by a user, the engagement operation of the first engagement portion 88 is immediately applied because the engagement projection 85*e* of the pipe member moving body 85 has been engaged with the spiral groove 83*i* of the leading tube 83. Thereafter, the same operations as the rod-like body feeding container 300 shown in FIGS. 36 to 38 are executed in the feeding side and the feed-back side.

Further, when the main body tube 81 and the leading tube 83 are relatively rotated in the feed-back direction by the user, and the main body tube 81 and the leading tube 83 are relatively rotated further in the feed-back direction in the state in which the step surface 85*k* of the pipe member moving body 85 is brought into contact with the leading end surface of the cylinder portion 81*d* of the main body tube 81 and the pipe member 84 reaches the backward limit, the engagement operation of the first engagement portion 88 is stopped. When the main body tube 81 and the leading tube 83 are relatively rotated successively in the feed-back direction, the engagement operation of the second engagement portion 89 is applied because the engagement operation of the first engagement portion 88 is stopped. Then, the rod-like body moving body 86 is moved backward in cooperation with the rotation preventing portion 80.

At this time, since the piston 96*x* and the rod-like body M3 are in the state of being contact in the airtight manner within the pipe member 84, the rod-like body M3 is drawn back on the basis of a pressure reducing effect (an effect of keeping a sealed state) within the pipe member 84, and can be moved backward to the state in FIG. 39 together with the rod-like body moving body 86.

In this connection, the structure, in which the piston and the rod-like body are set in the state of being contact in the airtight manner within the pipe member by filling the rod-like body around the piston, and the rod-like body is moved backward in accordance with the backward movement of the rod-like body moving body can be applied to a container, in which a rod-like body and a pipe member can be fed out and fed back by a single engagement portion, for example, a container having a feeding and feed-back mechanism as described in Japanese Patent Publication No. 52-50578.

In this case, in order to securely apply the engagement operation of the first engagement portion 88 prior to the engagement operation of the second engagement portion 89 in the third and fourth embodiments, the structure is made such that the actuation resistance of the second engagement portion 89 is increased in comparison with the actuation resistance of the first engagement portion 88 by the O-ring 91, however, as the other structure for increasing the actuation resistance, there can be shown, for example, a structure in which the material is differentiated, the contact resistance of the thread is differentiated and the like. Further, as more another structure for increasing the actuation resistance of the second engagement portion 89, there can be shown, for example, a structure on the basis of the sliding resistance in the axial direction of the piston 86*x*. Further, as in the present embodiment, when the lead of the first engagement portion 88 is made larger in comparison with the lead of the second engagement portion 89, the engagement operation of the first engagement portion 88 is applied prior to the engagement operation of the second engagement portion 89.

Further, as mentioned above, it is possible to make the lead of the first engagement portion 88 equal to the lead of the second engagement portion 89 so as to make the moving speed of the pipe member 84 equal to the moving speed of the rod-like body moving body 86. In this case, such as the O-ring 91 increasing the actuation resistance of the second engagement portion 89 in comparison with the actuation resistance of the first engagement portion 88, it is necessary to employ a structure in which the engagement operation of the first engagement portion 88 is applied prior to the engagement operation of the second engagement portion 89. In this connection, if the lead of the first engagement portion 88 is made smaller in comparison with the lead of the second engagement portion 89, it is possible to more quickly move the rod-like body moving body 86 than the pipe member 84.

The description is specifically given above of the present invention on the basis of the embodiments, however, the present invention is not limited to the embodiments mentioned above. For example, the male thread and the female thread may be replaced by those which have the same function as a screw thread such as an intermittently arranged projection group or a spirally and intermittently arranged projection group, and the engagement projection may be constituted by a continuous screw thread.

What is claimed is:

1. A rod-shaped body feeding container comprising: a main body; a leading tube installed to a leading end side of the main body so as to be relatively rotatable; a pipe member slidably accommodated within the leading tube and slidably accommodating a rod-shaped body in an inner portion; a pipe member moving body engaged with a rear end inner portion of said leading tube; a rod-shaped body moving body, a piston of a front part of said rod-shaped body moving body being forcedly inserted into a rear end inner portion of said pipe member, the front end part of said rod-shaped body moving body being engaged with an inner portion of said pipe member moving body, and a rear end part of said rod-shaped body moving body extending toward a rear end inner portion of said main body in a longitudinal direction; a spiral groove provided on a rear end inner peripheral surface of said leading tube and engagement projections provided on an outer peripheral surface of said pipe member moving body being engaged with each other to constitute a first engagement portion; said first engagement portion adapted to move forward and backward said pipe member with respect to said leading tube in accordance with the relative rotation between said main body and said leading tube; a female thread provided on an inner peripheral surface of said pipe member moving body and a male thread provided on an outer peripheral surface of said rod-shaped body moving body being engaged with each other to constitute a second engagement portion; said second engagement portion moving forward said rod-shaped body with respect to said pipe member in accordance with the relative rotation between said main body and said leading tube.

2. The rod-shaped body feeding container as claimed in claim 1, wherein said rod-shaped body is slidably accommodated in said pipe member in a close contact state.

3. The rod-shaped body feeding container as claimed in claim 1 or 2, wherein said rod-shaped body moving body extrudes said rod-shaped body within said pipe member when moving forward, wherein said first engagement portion is structured such that a first engagement operation is actuated first before a second engagement operation of said second engagement portion is actuated, when said main body and said leading tube are relatively rotated in a feeding direction or a feed-back direction, thereby moving forward or backward said pipe member moving body, said pipe member and said rod-shaped body moving body together with one another, and the first engagement operation is stopped when said pipe member reaches a forward limit, and wherein said second engagement portion is structured such that said second engagement operation is actuated in the case that said pipe member reaches the forward limit and said main body and said leading tube are further relatively rotated in said feeding direction in a state in which the first engagement operation of said first engagement portion is stopped, thereby moving forward said rod-shaped body moving body.

4. The rod-shaped body feeding container as claimed in claim 3, wherein the first engagement operation of said first engagement portion is adapted to be applied prior to the second engagement operation of said second engagement portion due to an increased actuation resistance of said second engagement portion in comparison with an actuation resistance of said first engagement portion.

5. The rod-shaped body feeding container as claimed in claim 3, wherein a lead of said first engagement portion is set to be greater than a lead of said second engagement portion.

6. The rod-shaped body feeding container as claimed in claim 3, wherein the leading end of said pipe member protrudes from and retracts into an opening of a leading end of said leading tube on the basis of the forward movement and the backward movement of said pipe member including said rod-shaped body moving body caused by the relative rotation in said feeding direction and said feed-back direction between said main body and said leading tube.

7. The rod-shaped body feeding container as claimed in claim 4, wherein the leading end of said pipe member protrudes from and retracts into an opening of a leading end of said leading tube on the basis of the forward movement and the backward movement of said pipe member including said rod-shaped body moving body caused by the relative rotation in said feeding direction and said feed-back direction between said main body and said leading tube.

8. The rod-shaped body feeding container as claimed in claim 5, wherein the leading end of said pipe member protrudes from and retracts into an opening of a leading end of said leading tube on the basis of the forward movement and the backward movement of said pipe member including said rod-shaped body moving body caused by the relative rotation in said feeding direction and said feed-back direction between said main body mad said leading tube.

9. The rod-shaped body feeding container as claimed in claim 3, wherein said first engagement portion is structured such that, when said main body and said leading tube are relatively rotated in said feed-back direction, said pipe moving member, said pipe member and said rod-shaped body moving body are moved backward together with each other on the basis of the first engagement operation of said first engagement portion and when said pipe member moving body reaches a feed-back limit the first engagement operation is stopped; and wherein, when said main body and said leading tube are relatively rotated further in said feed-back direction in a state in which the first engagement operation is stopped, said second engagement portion retracts said pipe member and said rod-shaped body moving body together with each other.

10. The rod-shaped body feeding container as claimed in claim 3, wherein said second engagement portion is structured such as to move backward said rod-shaped body with respect to said pipe member, by utilizing said second engagement portion in accordance with the relative rotation in said feed-back direction between said main body and said leading tube.

11. The rod-shaped body feeding container as claimed in claim 10, wherein said first engagement portion is structured such that, when said main body and said leading tube are relatively rotated in said feed-back direction and said pipe member including said rod-shaped body moving body is moved backward on the basis of the first applied engagement operation of said first engagement portion and reaches a feed-back limit at which said pipe member is accommodated within said leading tube, the first engagement operation is stopped, wherein said second engagement portion is structured such that, when said main body and said leading tube are further relatively rotated in said feed-back direction in a state in which said pipe member reaches the feed-back limit and the engagement operation of said first engagement portion is stopped, the second engagement operation is applied so as to move backward said rod-shaped body moving body, and wherein said rod-shaped body moving body and said rod-shaped body are brought into contact with each other in an airtight manner within said pipe member.

* * * * *